US007630677B2

(12) United States Patent
Osada et al.

(10) Patent No.: US 7,630,677 B2
(45) Date of Patent: Dec. 8, 2009

(54) IMAGE HEATING APPARATUS

(75) Inventors: Hikaru Osada, Mishima (JP); Kazuhisa Kemmochi, Suntou-gun (JP); Takahiro Hosokawa, Susono (JP); Keisuke Abe, Suntou-gun (JP); Tsutomu Miki, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/363,995

(22) Filed: Feb. 2, 2009

(65) Prior Publication Data

US 2009/0208262 A1 Aug. 20, 2009

Related U.S. Application Data

(63) Continuation of application No. PCT/JP2008/066476, filed on Sep. 5, 2008.

(30) Foreign Application Priority Data

Sep. 6, 2007 (JP) ..... 2007-231317
Sep. 14, 2007 (JP) ..... 2007-238840

(51) Int. Cl.
*G03G 15/20* (2006.01)

(52) U.S. Cl. ..... 399/329

(58) Field of Classification Search ..... 399/329, 399/328; 219/216, 469–471
See application file for complete search history.

(56) References Cited

U.S. PATENT DOCUMENTS

| | | | | |
|---|---|---|---|---|
| 6,243,559 | B1 | 6/2001 | Kurotaka et al. | 399/329 |
| 6,476,357 | B2 | 11/2002 | Ohno et al. | 219/216 |
| 7,136,615 | B2 | 11/2006 | Oohara et al. | 399/329 |
| 7,542,711 | B2 * | 6/2009 | Nakamoto et al. | 399/329 |
| 2002/0031363 | A1 * | 3/2002 | Tomita et al. | 399/329 |
| 2004/0161271 | A1 * | 8/2004 | Tanino et al. | 399/329 |
| 2006/0045590 | A1 * | 3/2006 | Yamada | 399/329 |
| 2007/0059065 | A1 * | 3/2007 | Takada et al. | 399/329 |
| 2007/0212134 | A1 * | 9/2007 | Aoki | 399/329 |

FOREIGN PATENT DOCUMENTS

| | | |
|---|---|---|
| JP | H03-133871 | 6/1991 |
| JP | H06-318001 | 11/1994 |
| JP | H08-016008 | 1/1996 |
| JP | H10-228190 | 8/1998 |
| JP | H10-307496 | 11/1998 |
| JP | 2000-330407 | 11/2000 |
| JP | 2002-207380 | 7/2002 |
| JP | 2002-221866 | 8/2002 |
| JP | 2004-341346 | 12/2004 |
| JP | 2005-173058 | 6/2005 |
| JP | 2005-300982 | 10/2005 |

* cited by examiner

*Primary Examiner*—Susan S Lee
(74) *Attorney, Agent, or Firm*—Fitzpatrick, Cella, Harper & Scinto

(57) ABSTRACT

In an image heating apparatus, outer peripheral surfaces of two endless belts are held in contact with each other to form a nip portion, and a recording material bearing a toner image is heated at the nip portion while being pinched and conveyed. In the image heating apparatus, the nip portion has a pre-nip portion formed by regions of the endless belts with no backup by pressure members, and a pressure nip portion where one endless belt with backup by the pressure members is held in contact with another endless belt. The image heating apparatus is capable of securing a large nip width compatible with an increase in speed and free from "pressure-absence" leading to image abnormality such as misregistration, thus enabling an image having a sufficient gloss to be obtained.

6 Claims, 33 Drawing Sheets

IMAGE HEATING APPARATUS

This application is a continuation of International Application No. PCT/JP2008/066476, filed on Sep. 5, 2008, which claims the benefit of Japanese Patent Applications No. 2007-231317 filed on Sep. 6, 2007, and No. 2007-238840 filed on Sep. 14, 2007.

BACKGROUND OF THE INVENTION

1. Field of the Invention

The present invention relates to an image heating apparatus suitable for use as an image heat fixing device mounted to an image forming apparatus such as an electrophotographic copying machine and an electrophotographic printer.

2. Description of the Related Art

As an image heat fixing device (fixing unit) mounted in an electrophotographic image forming apparatus such as a copying machine or a printer, there exists a belt type fixing device. In a belt type fixing device, a nip portion for heating a recording material bearing a toner image such as a recording paper sheet or an OHP sheet while pinching and conveying the same is formed by using an endless belt. As a result, it is possible to secure a large width for the nip portion in the recording material conveyance direction. Thus, if the conveyance speed of the recording material is increased, it is possible to heat the toner image for a sufficient period of time, thus increasing the printing speed. As belt type fixing devices, there have been proposed one in which a belt and a roller are combined and one in which two belts are combined.

Examples of the fixing device in which a belt and a roller are combined are disclosed in Japanese Patent Application Laid-Open No. H10-307496 and Japanese Patent Application Laid-Open No. H06-318001. In those fixing devices, an endless fixing belt is wrapped around two rollers: a fixing roller and a heat roller containing a heat source. Further, between the fixing roller and the heat roller, a pressure roller is brought into contact with the outer peripheral surface of the fixing belt, thereby forming a fixing nip portion.

Examples of the construction in which two belts are combined are disclosed in Japanese Patent Application Laid-Open No. H03-133871 and Japanese Patent Application Laid-Open No. 2004-341346. In those fixing devices, a fixing belt wrapped around a plurality of rollers and a pressure belt wrapped around a plurality of rollers are brought into contact with each other and pressurized, thereby forming a fixing nip portion.

SUMMARY OF THE INVENTION

However, in the above-mentioned fixing device which is of the construction in which the belt is wrapped around rollers to enlarge the nip width, it is possible to elongate the period of time in which heat is conducted to the recording material within the nip. However, the period of time in which the recording material is pressurized within the nip is also elongated. Thus, especially in the case of an ordinary paper sheet (hereinafter simply referred to as paper), the toner image borne on the paper surface is likely to permeate into the paper fibers.

When the toner has thus permeated into the paper fibers, the inherent asperity feature (ground tone) of the paper becomes visible on the surface of the fixed image. That is, instead of being covered with the toner, the paper fibers are exposed on the surface of the fixed image.

When the ground tone of the paper fiber thus become visible on the surface, it is impossible to uniformly cover the paper fibers on the surface with the toner image, and hence it is rather difficult to achieve high image density. At the same time, the smoothness of the fixed image surface is impaired, and hence it is rather difficult to attain high gloss.

Further, when in the fixing device in which the belt and rollers are combined, the pre-fixing heating means is arranged on the upstream side of the nip portion with respect to the recording material conveyance direction, and the recording material and the toner image are heated in a non-contact state, it is impossible to sufficiently heat the recording material and the toner image in the case of high speed printing. Further, since the nip width is small, there is generated poor fixing due to shortage of heat amount.

Also in the fixing device in which two belts are combined, when the recording material and the toner image are heated in a non-contact fashion by radiation heat from the fixing belt on the upstream side of the nip with respect to the recording material conveyance direction, it is impossible to sufficiently heat the recording material and the toner in the case of high speed fixing. Further, since the nip width is small, there is generated poor fixing due to shortage of heat amount.

In a fixing device of the type in which two belts are combined, the nip is formed in a large width utilizing the flexibility of the belts, and the belt and the recording material are brought into contact with the toner image by holding the recording material with the long belt regions, thereby positively conducting the heat of the belt.

In this case, however, it is rather difficult to attain a pressing force distribution that would allow maintenance of close contact between the belt and the recording material bearing the toner image over the entire area of the relatively long nip. When the recording material once passes a region of high pressing force and then passes a region of low pressing force, the toner image fixed halfway in the region of high pressing force is allowed to be shifted in the region of low pressing force, with the result that the toner image is likely to be fixed in an misregistration state.

The state in which the recording material thus passes a region of high pressing force at the first stage of the fixing nip and then passes a region of lower pressing region, is generally referred to as "pressure-absence." In a state in which there is "pressure-absence," close contact between the belt and the recording paper sheet cannot be maintained, which is likely to lead to "misregistration of the image," in which the toner image T is fixed in a shifted state, or uneven gloss due to unstable contact between the belt and the recording paper, resulting in an abnormal image.

It is an object of the present invention to provide an image heating apparatus which can secure a large nip width allowing high speed recording, which is free from "pressure-absence" causing generation of image abnormality such as misregistration, and which helps to obtain an image of sufficient gloss.

It is another object of the present invention to provide an image heating apparatus comprising; a first endless belt, a second endless belt held in contact with an outer peripheral surface of the first endless belt, a heating portion for heating at least one of the first endless belt and the second endless belt, a first pressure member held in contact with an inner peripheral surface of the first endless belt, and a second pressure member held in contact with an inner peripheral surface of the second endless belt, the first pressure member and the second pressure member holding the first endless belt and the second endless belt therebetween, the image heating apparatus heating a recording material bearing a toner image while the recording material is pinched and conveyed at a nip portion formed between the first endless belt and the second endless belt, wherein at least one endless belt of the first endless belt and the second endless belt is arranged in a relaxed state, wherein the nip portion has a first nip region formed between one endless belt of the first endless belt and the second endless belt and another endless belt of the first endless belt and the second endless belt due to relaxing of one endless belt, and a second nip region formed through contact between a region of the first endless belt with backup by the first pressure member and a region of the second endless belt with backup by the second pressure member, and wherein the nip portion starts from the first nip region in the recording material conveyance direction, and has the second nip region immediately after the first nip region.

DESCRIPTION OF THE EMBODIMENTS

Embodiment 1

(1) Example of the Image Forming Apparatus

Figure 27:
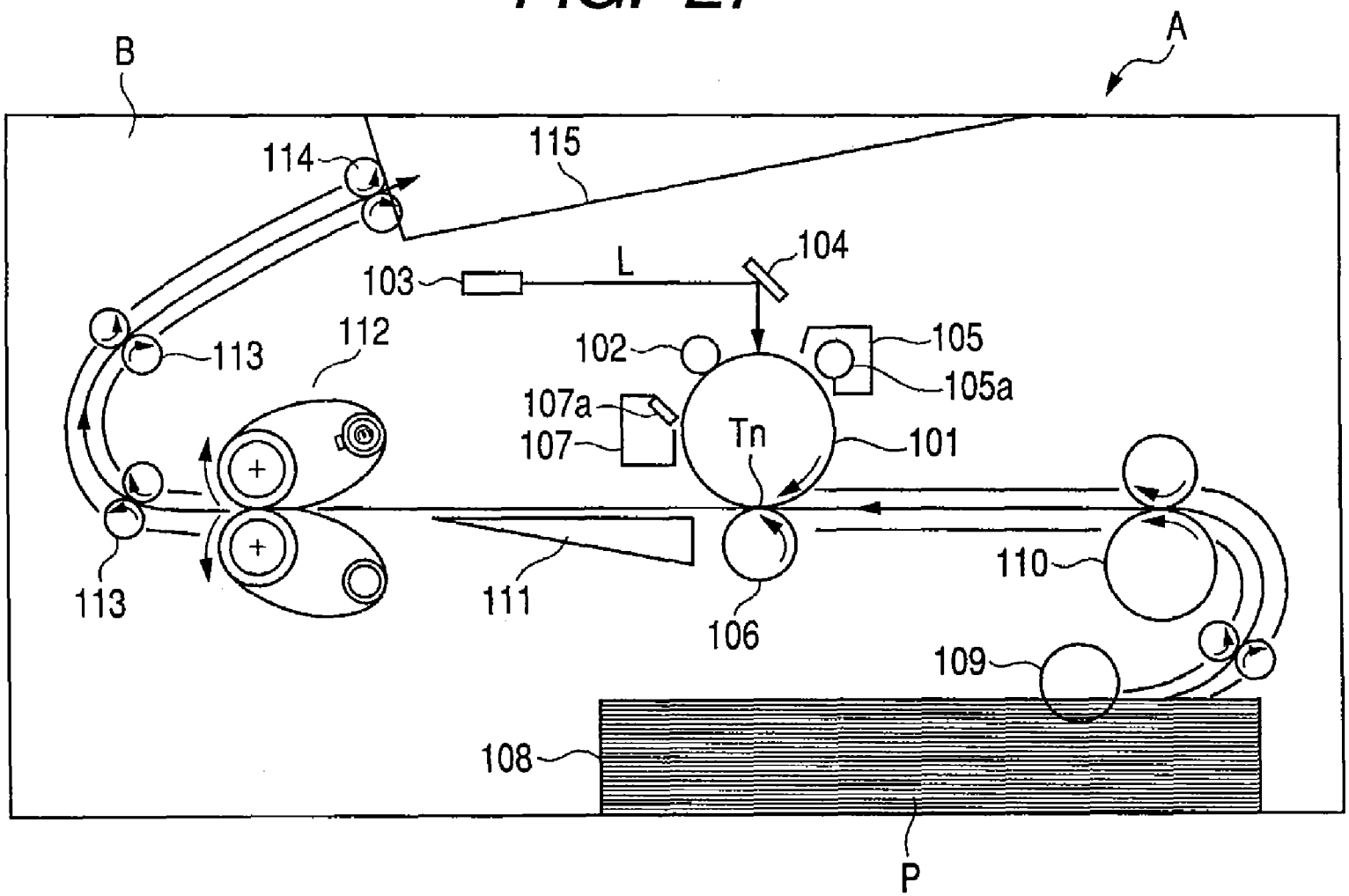
FIG. 27 is a schematic view of an example of the construction of an image forming apparatus.

FIG. 27 is a schematic diagram illustrating an example of the construction of an image forming apparatus in which an image heating apparatus according to the present invention can be mounted as an image heat fixing device. This image forming apparatus is a laser beam printer which forms an image on a recording material (such as a recording material or OHP sheet) by using the electrophotographic image forming system.

An image forming apparatus A has a drum-shaped electrophotographic photosensitive member (hereinafter referred to as photosensitive drum) 101 serving as an image bearing member. The photosensitive drum 101 is rotatably supported by an image forming apparatus main body B constituting the casing of the image forming apparatus A, and is rotated at a predetermined process speed in the direction of the arrow by a drive means (not shown). Around the photosensitive drum 101, there are arranged a charging roller (charging means) 102, a laser exposure device (exposure means) 103, a developing device (developing means) 105, a transfer roller (transfer means) 106, and a cleaning device (cleaning means) 107 in that order in the rotating direction.

During the rotating operation, the outer peripheral surface (surface) of the photosensitive drum 101 is uniformly charged in a predetermined potential and polarity by the charging roller 102. Further, scanning exposure is effected on the surface of the photosensitive drum 101 with a laser L based on target image information emitted from the laser exposure device 103 via a mirror 104, etc. As a result, the electric charge of the exposed portion is removed, and an electrostatic latent image (electrostatic image) corresponding to the image information is formed on the surface of the photosensitive drum 101. The electrostatic latent image is developed by the developing device 105 having a developing roller 105*a* using toner (developer). That is, the developing device 105 applies a developing bias to the developing roller 105*a*, and causes toner to adhere to the electrostatic latent image on the surface of the photosensitive drum 101. As a result, the electrostatic latent image is visualized as a toner image (developed image).

On the other hand, a recording material P is fed from a feeding cassette 108 by a feeding roller 109 at a predetermined timing, and a conveyance roller 110 conveys the recording material P to a transfer nip portion Tn between the photosensitive drum 101 and the transfer roller 106. Further, the recording material P is pinched and conveyed by the transfer nip portion Tn, and, in the transfer process, a transfer bias is applied to the transfer roller 106. As a result, the toner image on the surface of the photosensitive drum 101 is successively transferred onto the recording material P.

At the transfer nip portion Tn, the recording material P bearing the toner image is separated from the surface of the photosensitive drum 101, and is conveyed to an image heat fixing device 112 along a conveyance guide 111. The fixing device 112 imparts heat and pressure to the toner image on the recording material P to fix the toner image to the recording material P through heating. The recording material P having left the fixing device 112 is conveyed to delivery rollers 114 by conveyance rollers 113, and is delivered onto a delivery tray 115 on the apparatus main body B by the delivery rollers 114.

Any adhering substance such as transfer residual toner is removed from the surface of the photosensitive drum 101 after the toner image transfer by a cleaning blade 107*a* of the cleaning device 107 to prepare the surface for next image formation.

(2) Fixing Device (Fixing Unit)

In the following description, regarding the fixing device or the members constituting the fixing device, the term longitudinal direction refers to a direction orthogonal to the recording material conveyance direction. The term lateral direction refers to a direction parallel to the recording material conveyance direction on the surface of the recording material. The width refers to the dimension in the lateral direction.

Figure 1:
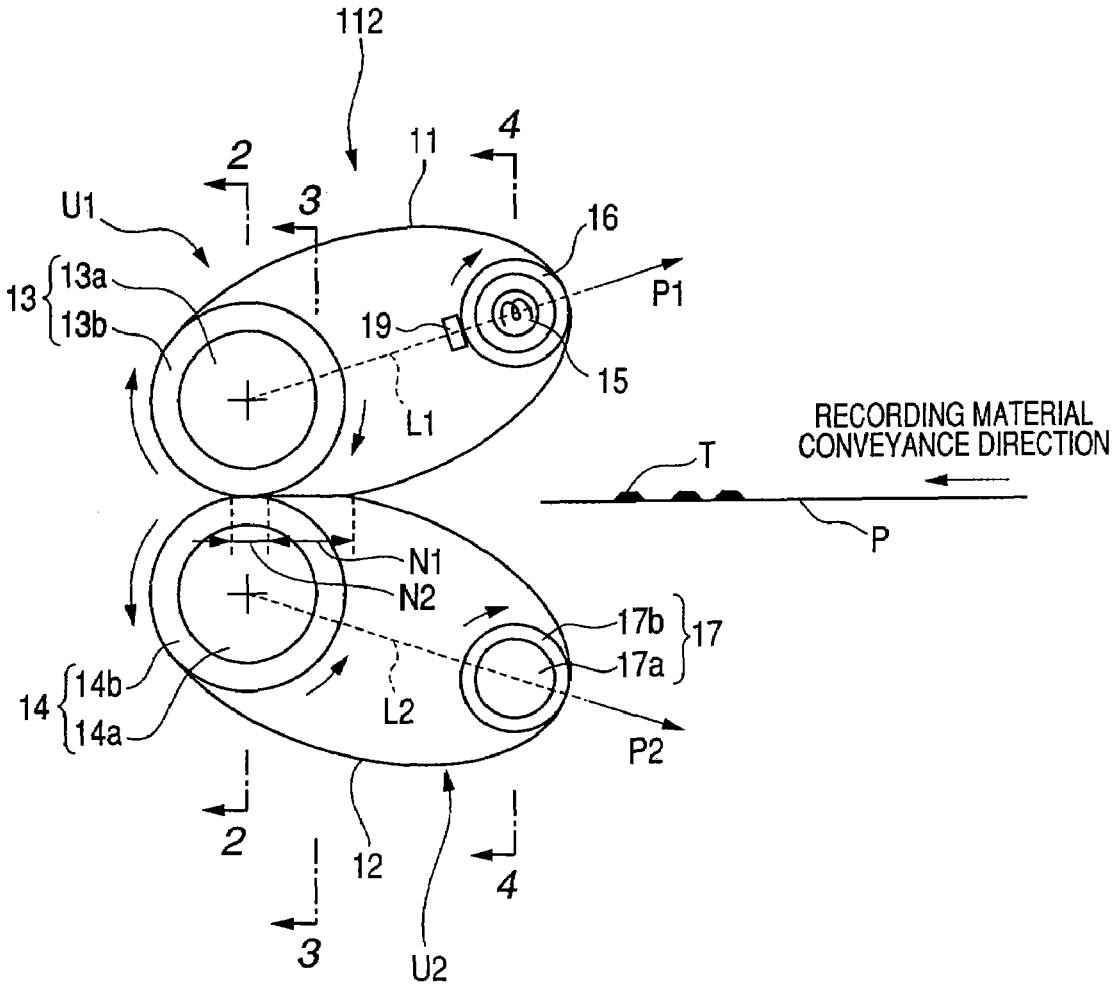
FIG. 1 is a schematic cross-sectional view of an example of a fixing device according to Embodiment 1.
Figure 2:
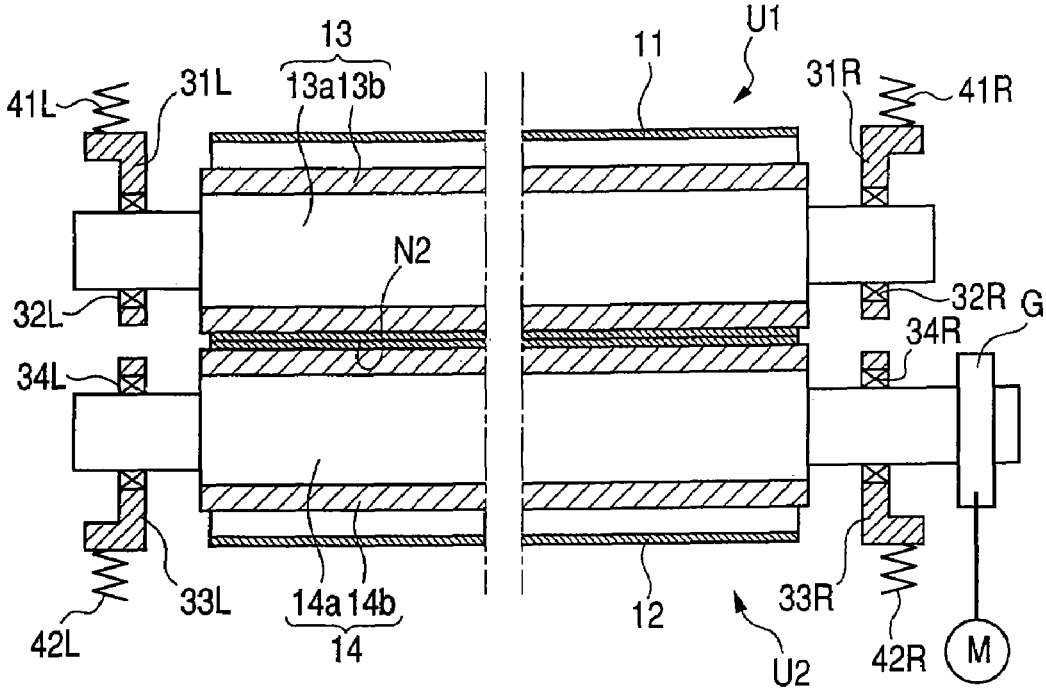
FIG. 2 is a sectional view taken along the arrow line 2-2 of FIG. 1.
Figure 3:
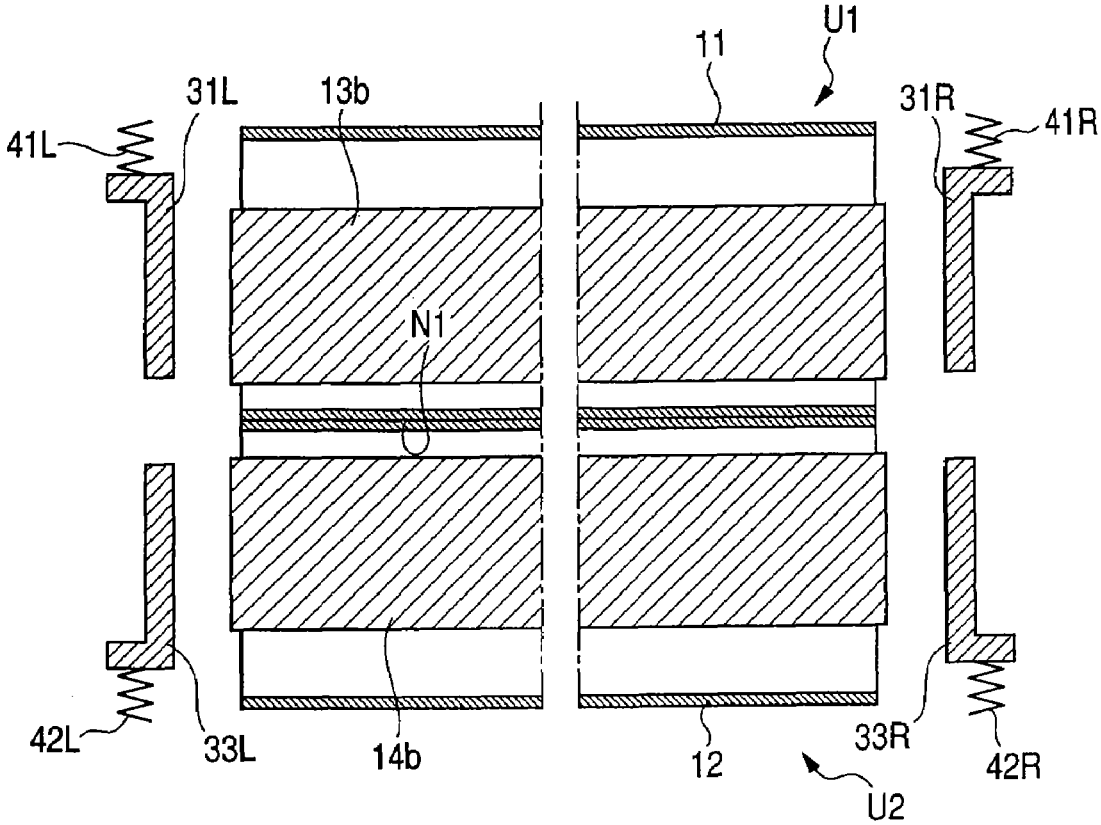
FIG. 3 is a sectional view taken along the arrow line 3-3 of FIG. 1.
Figure 4:
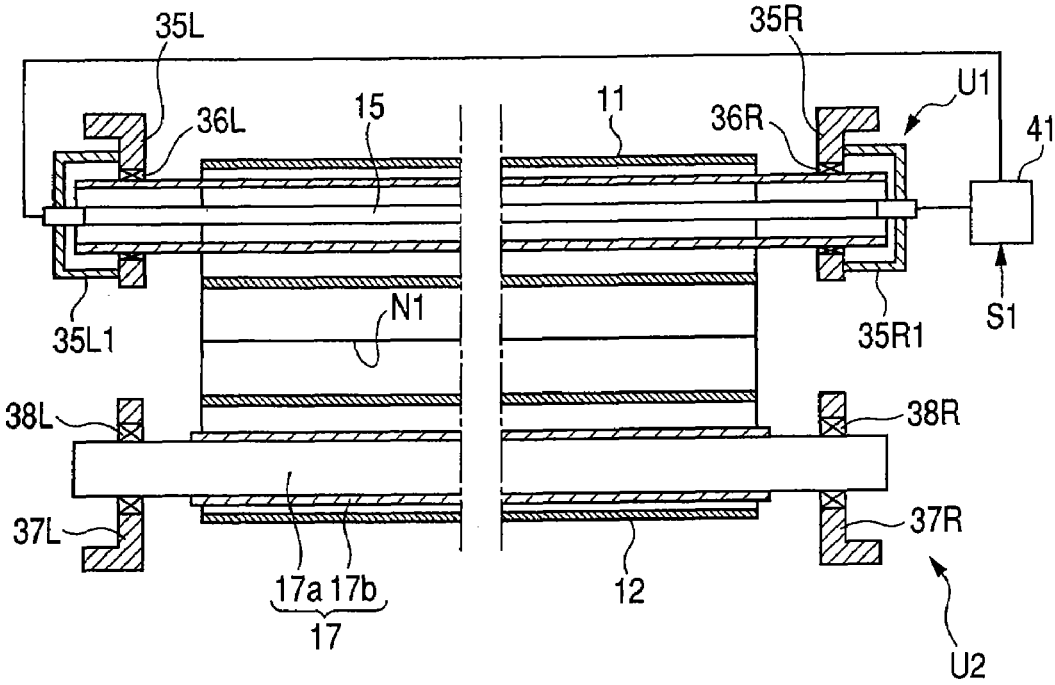
FIG. 4 is a sectional view taken along the arrow line 4-4 of FIG. 1.

FIG. 1 is a schematic cross-sectional view of an example of the fixing device 112. FIG. 2 is a sectional view of the fixing device 112 taken along the arrow line 2-2 of FIG. 1. FIG. 3 is a sectional view of the fixing device 112 taken along the arrow line 3-3 of FIG. 1. FIG. 4 is a sectional view of the fixing device 112 taken along the arrow line 4-4 of FIG. 1.

The fixing device 112 according to this embodiment has a fixing belt (first endless belt) 11 as an endless belt, a pressure belt (second endless belt) 12, a fixing roller (first pressure member) 13 as a pressure member, a pressure roller (second pressure member) 14, a heat roller 16 and a tension roller 17 as rotary members. Further, the fixing device 112 has a halogen heater 15 as a heating means (heating portion), and a temperature detection element 19 like a thermistor as a temperature detection means. Further, the fixing device 112 has a first frame 31L•31R as a support member for supporting the fixing roller 13, and a second frame 33L•33R as a support member for supporting the pressure roller 14. Further, the fixing device 112 has a third frame 35L•35R as a support member for supporting the heat roller 16, and a fourth frame 37L•37R as a support member for supporting the tension roller 17.

Further, a fixing belt unit U1 is formed by the fixing belt 11, the fixing roller 13, the heat roller 16, the heater 15, the temperature detection element 19, the first frame 31L•31R supporting the fixing roller 13, the third frame 35L•35R supporting the heat roller 16, etc.

Further, a pressure belt unit U2 is formed by the pressure belt 12, the pressure roller 14, the tension roller 17, the second frame 33L•33R for supporting the pressure roller 14, the fourth frame 37L•37R for supporting the tension roller, etc.

The fixing device 112 according to this embodiment is constructed such that, in the fixing belt unit U1, the fixing roller 13 and the heat roller 16 are provided on the inner side of the fixing belt 11 arranged in the longitudinal direction of the fixing device 112, with the fixing belt 11 being supported by the fixing roller 13 and the heat roller 16.

In the pressure belt unit U2, the pressure roller 14 and the tension roller 17 are provided on the inner side of the pressure belt 12 arranged in the longitudinal direction of the fixing device 112, with the pressure belt 12 being supported by the pressure roller 14 and the tension roller 17.

Figure 5A:
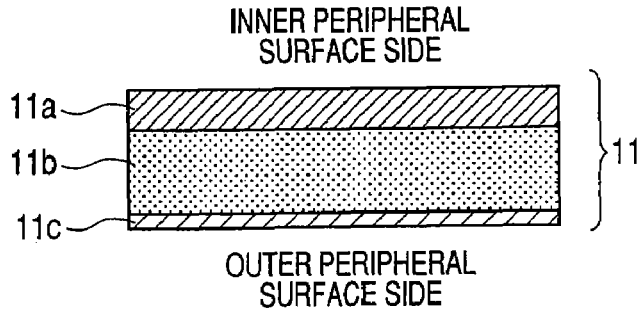
FIG. 5A is a sectional view of an example of the layer construction of a fixing belt.

The layer construction of the fixing belt 11 and the pressure belt 12 will be described with reference to FIGS. 5A and 5B. FIG. 5A is a sectional view of an example of the layer construction of the fixing belt 11, and FIG. 5B is a sectional view of an example of the layer construction of the pressure belt 12.

Figure 5B:
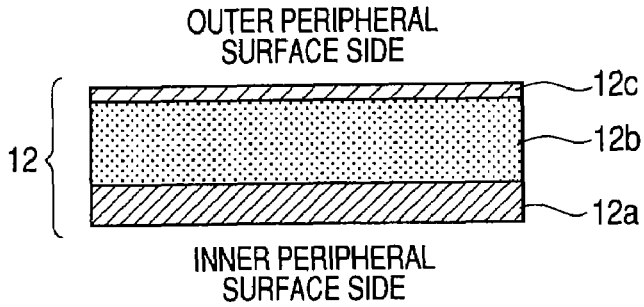
FIG. 5B is a sectional view of an example of the layer construction of a pressure belt.

The fixing belt 11 and the pressure belt 12 respectively have on their inner side endless base layers 11*a*•12*a*, and have, in the outer periphery of the base layers 11*a*•12*a*, elastic layers 11*b*•12*b*, and releasing layers 11*c*•12*c* in the outer periphery of the elastic layers 11*b*•12*b* (FIGS. 5A and 5B). The base layers 11*a*•12*a* are endless belts such as electrocast belts formed of a metal such as nickel or SUS, or belts formed of a heat resistant resin such as polyimide. The thickness of the base layers 11*a*•12*a* is approximately 50 to 150 micromillimeters in the case of metal electrocast belts, and approximately 50 to 300 micromillimeters in the case of a heat resistant resin; it is desirable for the belts themselves to have appropriate rigidity and flexibility. The elastic layers 11*b*•12*b* are silicone rubber layers formed on the base layers 11*a*•12*a* and having a thickness of approximately 50 to 300 micromillimeters. The releasing layers 11*c*•12*c* are resin layers formed on the elastic layers 11*b*•12*b* through tube covering, coating, or the like, the resin including a fluorine type resin such as PFA or PTFE and have a thickness of approximately 10 to 50 micromillimeters.

In this embodiment, belts of the following construction are adopted as the fixing belt 11 and the pressure belt 12. Endless belts formed of nickel layers of a thickness of 75 μm are used as the base layers 11*a*•12*a*, and silicone rubber layers of a thickness of 300 μm are formed as the elastic layers 11*b*•12*b* in the outer periphery of the base layers 11*a*•12*a*. Further, the elastic layers 11*b*•12*b* are covered with PFA tubes of a thickness of 50 μm as the releasing layers 11*b*•12*b*. Both the fixing belt 11 and the pressure belt 12 have an outer diameter of ø55 mm.

The fixing roller 13 and the pressure roller 14 are respectively formed as elastic rollers of an outer diameter of ø28 mm formed by providing in the outer periphery of SUS cores 13*a*•14*a* having a diameter of ø18 mm elastic layers 13*b*•14*b* formed of silicone sponge rubber layers of a thickness of 5 mm. The asker C hardness in this case is approximately 40° under a weight of 9.8 N (1 kgf).

In this embodiment, the longitudinal dimension of the elastic layers 13*b*•14*b* of the fixing roller 13 and the pressure roller 14 is set to a dimension slightly larger than the longitudinal dimension of the fixing belt 11 and the pressure belt 12 (FIG. 2). The longitudinal dimension of the elastic layers 13*b*•14*b* of the fixing roller 13 and the pressure roller 14 may be set to be substantially the same as the longitudinal dimension of the fixing belt 11 and the pressure belt 12, or smaller than the longitudinal dimension of the fixing belt 11 and the pressure belt 12.

The fixing roller 13 has a core 13*a* whose end portions are rotatably supported by the first frame 31L•31R through the intermediation of bearings 32L•32R (FIG. 2).

The pressure roller 14 is arranged below the fixing roller 13 in parallel to the fixing roller 13, and both end portions of the core 13*a* are rotatably supported by the second frame 33L•33R through the intermediation of bearings 34L•34R.

Figure 6B:
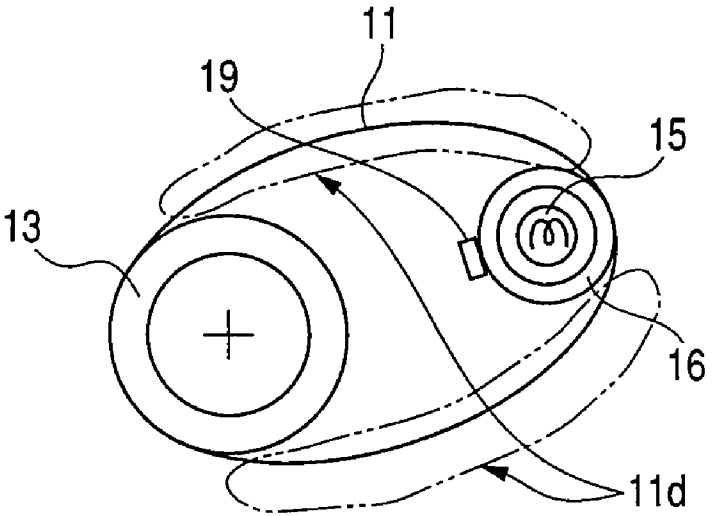
FIG. 6B is a diagram illustrating how the fixing belt is wrapped around the fixing roller and the heating roller in a route length somewhat larger than the minimum route length of the fixing belt.
Figure 6A:
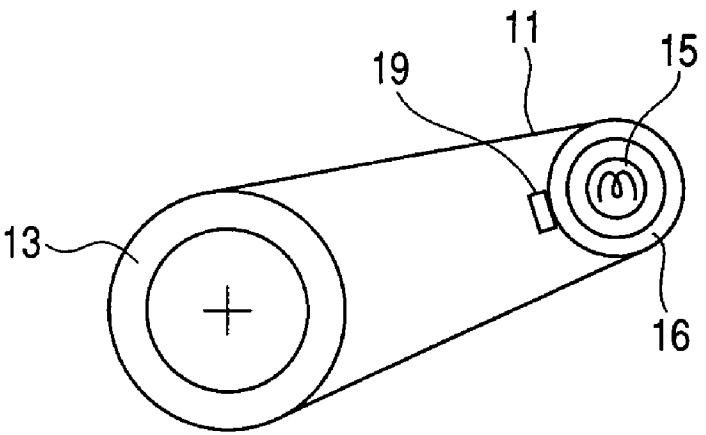
FIG. 6A is a diagram illustrating how a fixing belt is wrapped around a fixing roller and a heating roller in a minimum route length of the fixing belt.

FIGS. 6A and 6B are explanatory views illustrating the relationship between the fixing roller 13, the heat roller 16, and the fixing belt 11. FIG. 6A is a diagram illustrating a state in which the fixing belt 11 is wrapped around the fixing roller 13 and the heat roller 16 in the minimum route length of the fixing belt 11. FIG. 6B is a diagram illustrating a state in which the fixing belt 11 is wrapped around the fixing roller 13 and the heat roller 16 in a route length somewhat larger than the minimum route length of the fixing belt 11.

The heat roller 16 is an aluminum hollow cylindrical body having a wall thickness of 1 mm and an outer diameter of ø18 mm. The heat roller 16 is situated so as to cause to fixing belt 11 wrapped around the fixing roller 13 to stick out obliquely upwards from the fixing roller 13 to the upstream side with respect to the recording material conveyance direction. That is, the heat roller 16 is intentionally arranged at a position where the peripheral length of the fixing belt 11 at the time of wrapping the heat roller 16 around the fixing roller 13 and the heat roller 16 is somewhat larger than the peripheral length of the minimum route length of the fixing belt 11.

Further, at this position, both end portions of the heat roller 16 are rotatably supported by the third frame 35L•35R through the intermediation of bearings 36L•36R (FIG. 4). Alternatively, the bearings 35L•35R at both ends of the heat roller 16 are supported by the third frame 35L•35R such that the bearings 35L•35R are urged in a direction P1 (FIG. 1) away from the fixing roller 13 in the virtual line L1 connecting the rotation center of the heat roller 16 and the rotation center of the fixing roller 13. That is, instead of being wrapped around the fixing roller 13 and the heat roller 16 with tension as illustrated in FIG. 6A, the fixing belt 11 is wrapped loosely around the fixing roller 13 and the heat roller 16 in a relaxed state as illustrated in FIG. 6B. Thus, the fixing belt 11 has a relaxed portion 11*a* between the fixing roller 13 and the heat roller 16 in the peripheral direction of the fixing belt 11. In this embodiment, the distance between the axial center position of the fixing roller 13 and the rotation center position of the heat roller 16 is set to 23 (mm) to form the relaxed portion 11*d*.

Both end portion of the halogen heater 15 provided inside the heat roller 16 are supported by heater support portions 35L1•35R1 provided on the third frame 35L•35R. The inner surface of the heat roller 16 is painted black so that the radiation heat from the halogen heater 15 can be easily absorbed.

The heat roller 16 is constructed such that a part of the outer peripheral surface (surface) of the heat roller 16 is held in contact with the inner peripheral surface (inner surface) of the fixing belt 11, and that the heat due to the halogen heater 15 is conducted from the contact region to the fixing belt 11 to heat the fixing belt 11. That is, the fixing belt 11 is heated by the halogen heater 15 via the heat roller 16.

Figure 7B:
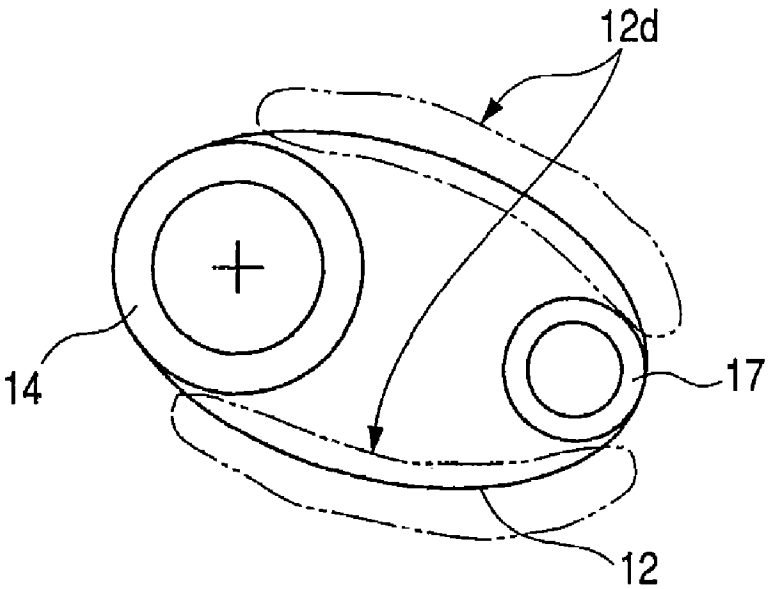
FIG. 7B is a diagram illustrating how the pressure belt is wrapped around the pressure roller and the tension roller in a route length somewhat larger than the minimum route length of the pressure belt.
Figure 7A:
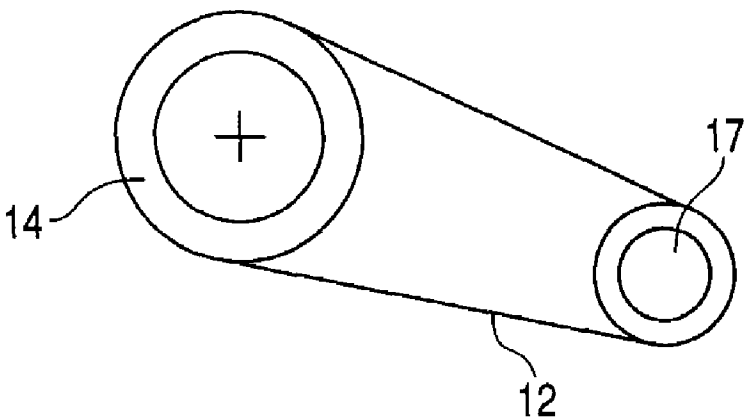
FIG. 7A is a diagram illustrating how a pressure belt is wrapped around a pressure roller and a tension roller in a minimum route length of the pressure belt.

FIGS. 7A and 7B are explanatory views illustrating the relationship between the pressure roller 14, the tension roller 17 and the pressure belt 12. FIG. 7A is a diagram illustrating a state in which the pressure belt 12 is wrapped around the pressure roller 14 and the tension roller 17 in the minimum route length of the pressure belt 12. FIG. 7B is a diagram illustrating a state in which the pressure belt 12 is wrapped around the pressure roller 14 and the tension roller 17 in a route length somewhat larger than the minimum route length of the pressure belt 12.

The tension roller 17 is a roller having an outer diameter of ø18 mm, and has a core 17*a* formed of SUS and having a diameter of ø10 mm and an elastic layer 17*b* provided in the outer periphery thereof and formed of a silicone sponge rubber layer having a thickness of 4 mm. The longitudinal dimension of the elastic layer 17*b* is equal to the longitudinal dimension of the elastic layers 13*b*•14*b* of the fixing roller 13 and the pressure roller 14. The tension roller 17 is situated so as to cause the pressure belt 12 wrapped around the pressure roller 14 to stick out obliquely downwards from the pressure roller 14 to the upstream side with respect to the recording material conveyance direction. That is, the tension roller 17 is intentionally situated such that the peripheral length of the pressure belt 12 when the tension roller 17 is wrapped around the pressure roller 14 and the tension roller 17 is somewhat larger than the minimum route length of the pressure belt 12 of the pressure belt 12. Further, at this position, both end portions of the core 17*a* of the tension roller 17 are rotatably supported by the fourth frame 37L•37R through the intermediation of bearings 38L•38R (FIG. 4). Alternatively, the bearings 38L•38R at both ends of the core 17*a* are supported by the fourth frame 37L•37R so as to be urged by a spring or the like in the direction P2 (FIG. 1) in which the bearings 38L•38R move away from the pressure roller 14 in the virtual line L2 connecting the rotation center of the pressure roller 14 and the rotation center of the tension roller 17. That is, instead of being wrapped around the pressure roller 14 and the tension roller 17 with tension as illustrated in FIG. 7A, the pressure belt 12 is loosely wrapped around the pressure roller 14 and the tension roller 17 in a relaxed state as illustrated in FIG. 7B. Thus, in the peripheral direction of the pressure belt 12, the pressure belt 12 has a relaxed portion 12*d* between the pressure roller 14 and the tension roller 17. In this embodiment, the relaxed portion 12*d* is formed, with the distance between the axial center position of the pressure roller 14 and the center position of the tension roller 17 being set to 23 (mm).

Thus, in this embodiment, both of the two endless belts, the fixing belt 11 and the pressure belt 12, have the relaxed portions 11*d*•12*d*.

Next, the nip portion formed by the fixing belt 11 of the fixing belt unit U1 and the pressure belt 12 of the pressure belt unit U2 is described in detail.

In the following, in the fixing unit construction according to this embodiment, for the sake of convenience, the nip portion is described as divided, in terms of function, into a "pre-nip portion (first nip region)" and a "pressure nip portion (second nip region)." The "pre-nip portion" is a nip region formed between one endless belt and the other endless belt due to relaxing of one endless belt. In this embodiment, the "pre-nip portion" is a nip portion formed by the belt regions in which the fixing belt 11 and the pressure belt 12 are not held in contact with the fixing roller 13 and the pressure roller 14 (FIG. 1). The "pressure nip portion" is a nip portion formed by regions where there is a backup of the fixing roller 13 and the pressure roller 14 respectively arranged on the inner surfaces of the fixing belt 11 and the pressure belt 12 (FIG. 1). Further, the nip region formed by joining together the "pre-nip portion N1" and the "pressure nip portion N2" will be referred to as "total nip." The total nip, which is a nip portion, is formed by bringing into contact with each other the outer peripheral surfaces of the two endless belts, the fixing belt 11 and the pressure belt 12. The nip portion starts at the pre-nip portion (first nip region) in the recording material conveyance direction, and has the pressure nip portion (second nip region) immediately after the pre-nip portion.

In the fixing belt unit U1 and the pressure belt unit U2, pressure springs 41L•41R and 42L•42R as the pressure means are arranged on the first frame supporting the fixing roller 13 and the second frame supporting the pressure roller (FIG. 2). The fixing roller 13 and the pressure roller 14 are urged toward each other by the pressure springs 41L•41R and 42L•42R. In the fixing roller 13 and the pressure roller 14, the fixing belt 11 and the pressure belt 12 are held and pressurized by the respective elastic layers 13*b*•14*b*, whereby the outer peripheral surface (surface) of the fixing belt 11 and the outer peripheral surface (surface) of the pressure belt 12 are brought into contact with each other. As a result, the pressure nip portion N2 is formed through contact between the surface of the fixing belt 11 and the surface of the pressure belt 12 (FIG. 1). In this embodiment, the total pressure of the pressurizing force applied to the fixing roller 13 and the pressure roller 14 by the pressure springs 41L•41R and 42L•42R is 196 N(20 kgf), thereby setting the width of the pressure nip portion N2 to 5 mm.

Figure 8:
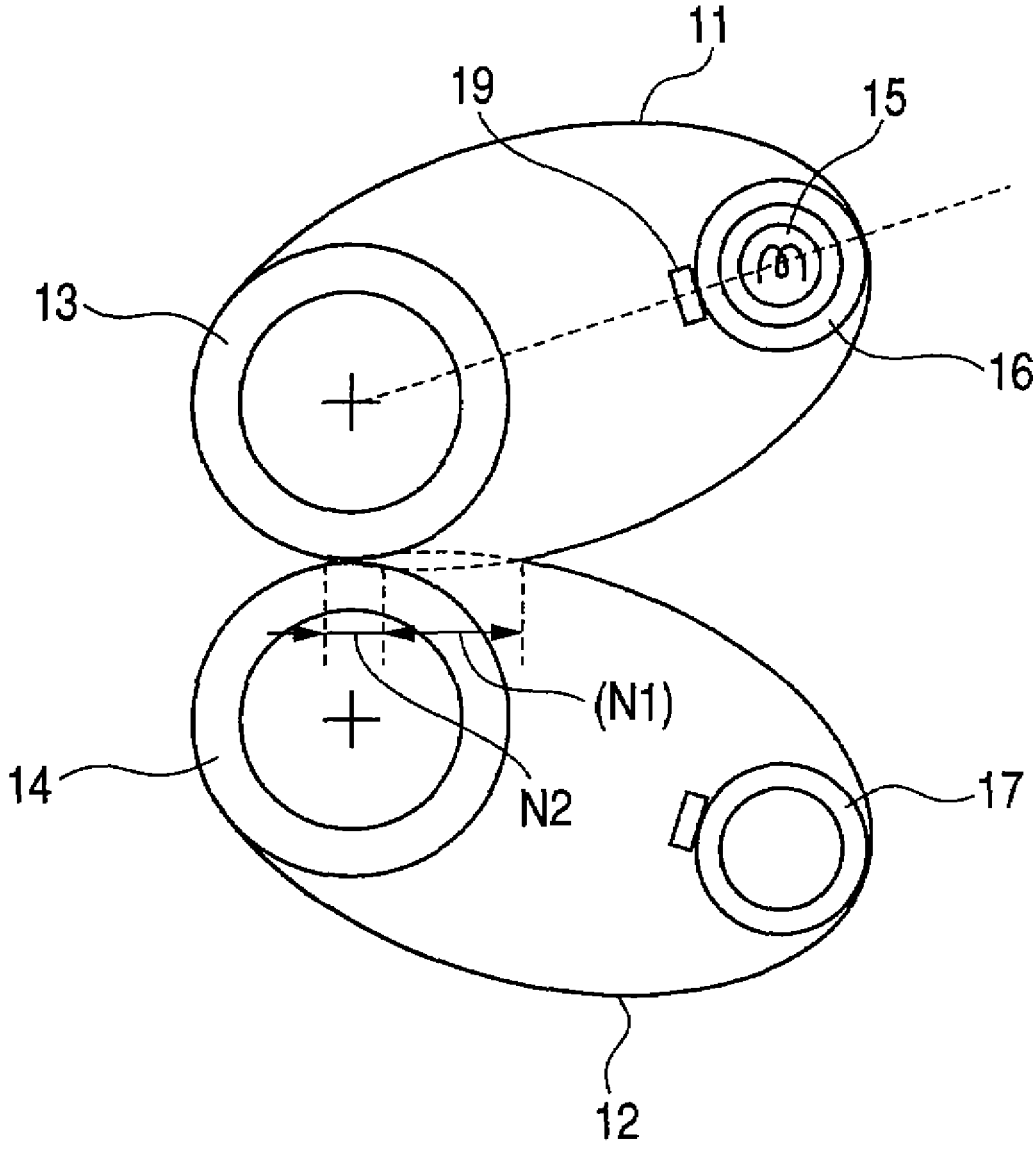
FIG. 8 is an explanatory view illustrating how a pre-nip portion is formed by the respective relaxed portions of the fixing belt and the pressure belt when a pressure nip portion is formed.

FIG. 8 is an explanatory view of the pre-nip portion N1 formed by the relaxed portions 11*d*•12*d* of the fixing belt 11 and the pressure belt 12 when the pressure nip portion N2 is formed.

As described above, in the fixing belt unit U1 in the non-pressurized state, there exists the relaxed portion 11*d* as illustrated in FIG. 6B. In the pressure belt unit U2 in the non-pressurized state, there exists the relaxed portion 12*d* as illustrated in FIG. 7B. The fixing roller 13 and the pressure roller 14 are urged toward each other, and the fixing belt 11 and the pressure belt 12 are brought into contact with each other, whereby the pressure nip portion N2 is formed. Then, from the upper end in the recording material conveyance direction of the pressure nip portion N2, there is generated in the relaxed portions 11*d*•12*d* of the fixing belt 11 and the pressure belt 12 a range where the relaxed portions 11*d*•12*d* overlap each other over a predetermined range (as indicated by the dashed line in FIG. 8). In the relaxed portions 11*d*•12*d*, the surface of the fixing belt 11 and the surface of the pressure belt 12 are brought into contact with each other in the overlapping range. As a result, the fixing belt 11 and the pressure belt 12 are deformed to an appropriate degree so as to maintain equilibrium in the peripheral direction. As a result, the pre-nip portion N1 is formed in the overlapping region (FIG. 1). Thus, the nip pressure in the pre-nip portion N1 is due to the elastic force of the fixing belt 11 and the pressure belt 12 causing the fixing belt 11 and the pressure belt 12 to be restored to the non-contact state illustrated in FIGS. 6B and 7B from the contact state illustrated in FIG. 1.

That is, the nip pressure in the pre-nip portion N1 is due to the restoring force of the belts 11•12 tending to be restored to their configuration in the non-contact state depending mainly upon the rigidity and flexibility of the base layers 11*a*•12*a* of the fixing belt 11 and the pressure belt 12. The width of the pre-nip portion N1 thus formed is approximately 15 mm.

The pre-nip portion N1 thus formed is formed through contact of the fixing belt 11 and the pressure belt 12, which have flexibility and deformability. Thus, within the range of the pre-nip portion N1, the pressure distribution is substantially uniform, and it is possible to maintain a stable contact state. The pre-nip portion N1 is a range where the belts are held in contact with each other without any backup of the fixing roller 13 and the pressure roller 14. The pressure nip N2 is a range where the belts are held in contact with each other under a backup from the back sides of the belts by the fixing roller 13 and the pressure roller 14.

Further, the pre-nip portion N1 is formed so as to be continuous with the pressure nip portion N2 formed by urging the fixing roller 13 contained by the fixing belt 11 and the pressure roller 14 contained by the pressure belt 12. Thus, when pinching and conveying the recording material, closeness in contact between the recording material P, and the fixing belt 11 and the pressure belt 12 is maintained in the total nip including the pre-nip portion N1 and the pressure nip portion N2.

Figure 9:
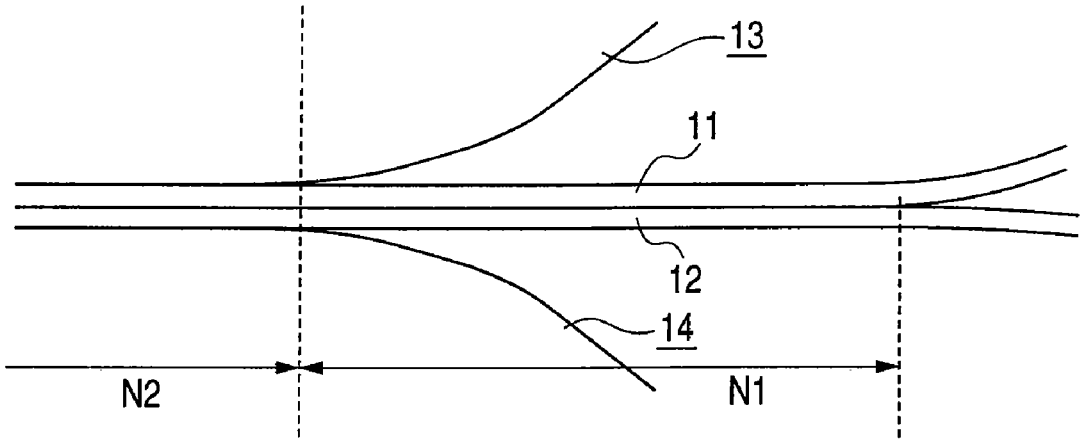
FIG. 9 is an explanatory view illustrating how the fixing belt and the pressure belt of the pressure nip portion and the pressure nip portion of Embodiment 1 are held in contact with each other.

FIG. 9 illustrates the contact state of the pre-nip portion and the pressure nip portion formed at this time.

In this embodiment, the fixing belt 11 and the pressure belt are of the same specifications, and the fixing roller 13 and the pressure roller 14 are both elastic rollers of the same specifications, and hence their deformation amounts due to the urging load are the same. That their deformation amounts are the same means that the length by which the fixing roller 13 arranged in the fixing belt 11 is held in contact with the inner surface of the fixing belt 11 and the length by which the pressure roller 14 arranged in the pressure belt 12 is held in contact with the inner surface of the pressure belt 12 are substantially equal to each other. That is, the length by which the fixing roller 13 backs up the fixing belt 11 and the length by which the pressure roller 14 backs up the pressure belt 12 are substantially equal to each other. Thus, within the region of the pressure nip portion N2, there exists a portion formed by the regions of the endless belts under a backup of the fixing roller 13 and the pressure roller 14, which are pressure members, that is, the regions of the fixing belt 11 and the pressure belt 14. In this embodiment, that portion is the entire pressure nip portion N2. Thus, as illustrated in FIG. 9, in this state, there exists the pre-nip portion N1 formed through contact between the belts from the upstream side with respect to the recording material conveyance direction. Then, there is attained a state in which the pressure nip portion N2 formed through contact between the belts backed up by the rollers is formed so as to be continuous with the pre-nip portion N1. That is, the total nip supports the two endless belts, the fixing belt 11 and the pressure belt 12, such that the pressure nip portion N2 is formed, starting from the pre-nip portion N1, so as to be continuous with the downstream side with respect to the recording material conveyance direction.

Figure 10:
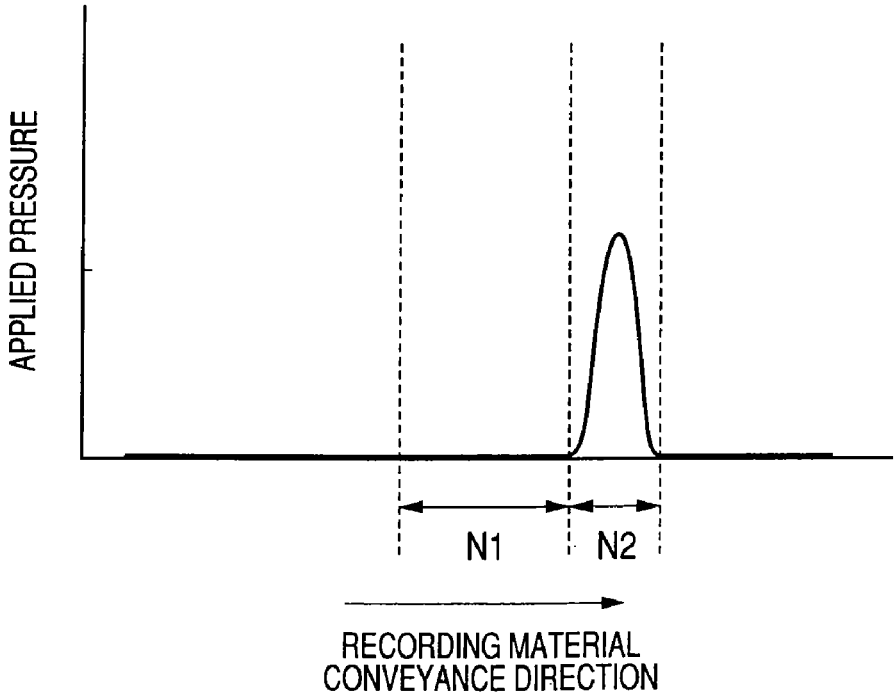
FIG. 10 is an explanatory view illustrating the pressure distribution in the pre-nip portion and the pressure nip portion.

Using the pressure distribution measurement system PINCH, manufactured by Nitta Corporation, the pressure distribution of the total nip according to this embodiment, formed by the pre-nip portion N1 and the pressure nip portion N2, was measured. FIG. 10 illustrates the pressure distribution as measured.

As illustrated in FIG. 10, the fixing roller 13 and the pressure roller 14 are urged toward each other, and hence the pressurizing force (applied pressure) is maximum at the pressure nip portion N2 formed through contact of the fixing belt 11 and the pressure belt 12 at a position corresponding to this portion.

In contrast, in the pre-nip portion N1, the surface of the fixing belt 11 and the surface of the pressure belt 12 are held in contact with each other solely by the elastic force (restoring force) of the fixing belt 11 and the pressure belt 12, and hence the pressurizing force is considerably smaller as compared with the pressurizing force at the pressure nip portion N2. Further, in the pre-nip portion N1, the fixing belt 11 and the pressure belt 12, which are provided with rigid endless belts as the base layers 11*a*•12*a*, and hence a uniform pressure distribution is attained.

(3) Heat Fixing Operation of the Fixing Device

A drive gear G (FIG. 2) provided at an end of the core 14*a* of the pressure roller 14 is rotated by a fixing motor M, whereby the pressure roller 14 is rotated at a predetermined peripheral speed in the direction of the arrow (FIG. 1). When the pressure roller 14 rotates, the rotation of the pressure roller 14 is transmitted to the pressure belt 12 at the pressure nip portion N2, and the pressure belt 12 moves around the pressure roller 14 and the tension roller 17 in the direction of the arrow as the pressure roller 14 rotates. The rotation of the pressure belt 12 is transmitted to the tension roller 17, and the tension roller 17 is driven to rotate in the direction of the arrow as the pressure belt 12 runs. Further, at the pressure nip portion N2, the rotation of the pressure belt 12 is transmitted to the surface of the fixing belt 11, and the fixing belt 11 moves around the fixing roller 13 and the heat roller 16 in the direction of the arrow at the same speed as that of the pressure belt 12 as the pressure belt 12 runs. The running of the fixing belt 11 is transmitted to the heat roller 16, and the heat roller 16 is driven to rotate in the direction of the arrow as the fixing belt 11 runs. In this embodiment, the running speed (traveling speed) of the pressure belt 12 and the fixing belt 11 is 200 mm/s.

Also in the case in which, as in this embodiment, the fixing belt 11 and the pressure belt 12 are intentionally relaxed (FIGS. 6B and 7B), the base layers 11*a*•12*a* of the fixing belt 11 and the pressure belt 12 have rigidity and flexibility. Thus, the fixing belt 11 and the pressure belt 12 run while maintaining the relaxed state.

Also at the time of heat fixing operation, the fixing belt 11 and the pressure belt 12 run while maintaining the relaxed state. Thus, as compared with the case in which the fixing belt 11 and the pressure belt 12 run with tension (FIGS. 6A and 7A), undulation (swelling in the belt longitudinal direction) is less likely to be generated. Thus, it is advantageously possible to hold the surface of the fixing belt 11 uniformly in contact with the recording material P.

Before and after or simultaneously with the rotation of the pressure roller 14, the heater 15 is energized by an energization control portion 41 (FIG. 4) as an energization control means. As a result, the heater 15 generates heat, and the rotating heat roller 16 is heated by the heater 15, with the running fixing belt 11 being heated by the heat roller 16. The heat of the fixing belt 11 is conducted to the running pressure belt 12 via the pressure nip portion N2 and the pre-nip portion N1, thereby heating the pressure belt 12. The temperature of the heat roller 16 is detected by a temperature detection element 19 (FIG. 1), and, based on an output signal S1 from the temperature detection element 19, the energization control portion 41 controls the power energized to the heater 15 to perform temperature control on the heater 15. That is, the energization control portion 41 controls the energization to the heater 15 based on the output signal S1 from the temperature detection element 19 such that there can be maintained a predetermined set temperature (target temperature) for heating the toner image T at the pre-nip portion N1 to a temperature substantially equal to or higher than the outflow start temperature at the flow tester.

The outflow start temperature Tfb at the flow tester used in this embodiment is obtained under the following conditions.

Using Flow Tester CFT-500D (manufactured by Shimadzu Corporation), toner pellets are heated and melted for flowing out under the conditions: die hole diameter: 1 mm, load value: 405 kgf, and temperature rise rate: 4° C./min. At this time, the temperature at the point in time when the toner starts to flow out of the die hole is regarded as the "outflow start temperature Tfb."

In the fixing roller 13, the pressure roller 14, and the tension roller 17, the elastic layers 13*b*•14*b*•17*b* are formed of silicone sponge rubber layers having heat insulating property.

Thus, it is possible to reduce the requisite heat capacity of the above-mentioned members 13•14•17 for heating the fixing belt 11 and the pressure belt 12 for heat-fixing the toner image T to the recording material P. Thus, in the image forming apparatus A in which the fixing device 112 according to this embodiment is mounted, it is possible to shorten the requisite time for the first image to be output after the input of a printer command (first print out time: FPOT). That is, it is possible to shorten the warming-up time. Further, in the fixing device 112 according to this embodiment, it is possible to reduce the power consumption during the standby time in which a printer command is waited for.

In the state in which the running of the pressure belt 12 and the fixing belt 11 and the energization to the heater 15 are being effected, the recording material P bearing the toner image T is introduced to the pre-nip portion N1, with the toner image bearing surface facing upwards.

In the pre-nip portion N1, the recording material P is pinched weakly and uniformly by the fixing belt 11 and the pressure belt 12 due to the elasticity (restoring force) of the fixing belt 11 and the pressure belt 12, and is conveyed in this condition.

At the same time, due to the pre-heating of the fixing belt 11 and the pressure belt 12, the recording material P is pre-heated from both the toner image bearing surface on the fixing belt 11 side and the toner image non-bearing surface on the pressure belt 12 side. As illustrated in FIG. 3, the pre-nip portion N1 is formed solely through contact between the fixing belt 11 and the pressure belt 12, and hence, in the state in which the recording material P is pinched, the pre-nip portion N1 is a region where the fixing belt 11 and the pressure belt are solely held in contact with the recording material.

That is, the fixing belt 11 in the pre-nip portion N1 is solely held in contact with the toner image bearing surface of the recording material P, and is not held in contact with the fixing roller 13 and other components.

Further, the pressure belt 12 in the pre-nip portion N1 is solely held in contact with the toner image non-bearing surface of the recording material P, and is not held in contact with the pressure roller 14 and other components. Thus, the heat maintained by the fixing belt 11 and the pressure belt 12 can be efficiently conducted to the recording material P.

In this way, the recording material P is pinched between the surface of the fixing belt 11 and the surface of the pressure belt 12 due to the elasticity of the fixing belt 11 and the pressure belt 12, and hence the entire surface of the recording material P is pressurized weakly and uniformly, and pre-heated uniformly.

The toner image T borne by the recording material P is sufficiently heated at the pre-nip portion N1 to a temperature substantially equal to or higher than the outflow start temperature, and continues to be pressurized while being pinched and conveyed by the surface of the fixing belt 11 and the surface of the pressure belt 12 at the pressure nip portion N2.

As a result, the toner image T borne by the recording material P is heat-fixed to the surface of the recording material P as a fixed image having sufficient fixing property and gloss.

That is, after the time for sufficiently melting the toner image T at the pre-nip portion N1, it is possible to obtain, due to the pre-nip portion N1 and the pressure nip portion N2, the temperature distribution and the pressure distribution for the pressure fixing of the toner image T to the recording material P at the pressure nip portion N2. As a result, it is possible to substantially reduce the generation of poor fixing, blister, offset, etc. of the toner image T. Further, the recording material P is delivered from the pressure nip portion N2.

Throughout the heat fixing process in which the recording material passes through the pre-nip portion N1 and the pressure nip portion N2, there was measured the way the temperature of the toner image T changes at each point in the total nip of the toner image T borne on the recording material P.

The measurement of the temperature profile was performed as follows. A thermocouple whose heat capacity at the temperature detecting portion is small (e.g., Type K thermocouple of a wire diameter of 50 μm, manufactured by Anritsu Meter Co., Ltd.) was affixed onto the recording material P, and the recording material P was pinched and conveyed by the pre-nip portion N1 and the pressure nip portion N2 of the fixing device 112 under temperature control. Further, the potential difference signal emitted from the thermocouple at that time was measured by Memory High-Coder (8842) manufactured by Hioki E.E Corporation.

In this way, it is possible to measure the way the temperature changes with respect to time at the time of passage through the nip portion. By multiplying this by the recording material conveyance speed, it is possible to obtain the temperature profile at each position in the total nip.

Figure 11:
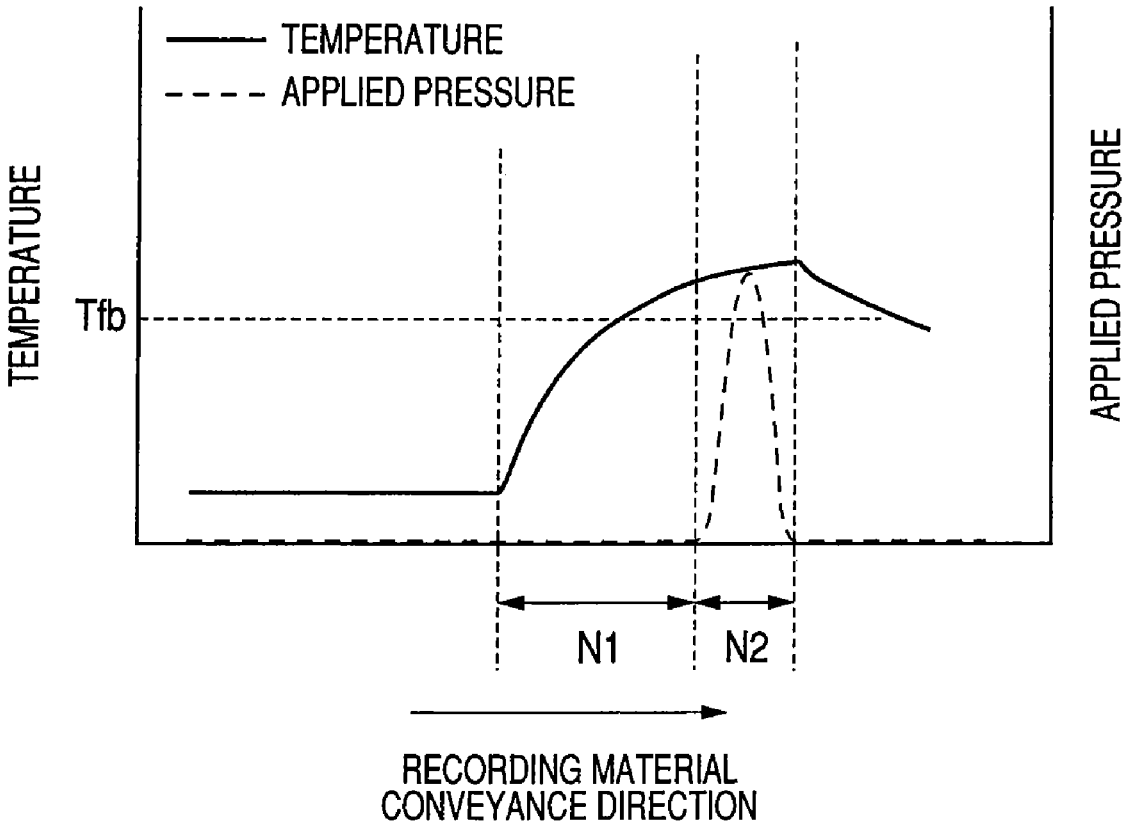
FIG. 11 is an explanatory view illustrating changes in the toner temperature in the pre-nip portion and the pressure nip portion in a heat fixing process.

FIG. 11 illustrates the temperature profile thus measured in the pre-nip portion N1 and the pressure nip portion N2 of the fixing device 112 according to this embodiment. In this drawing, the pressurizing force distribution illustrated in FIG. 10 is superimposed on the temperature profile, with each position of the total nip being matched in the horizontal axis direction.

Figure 12A:
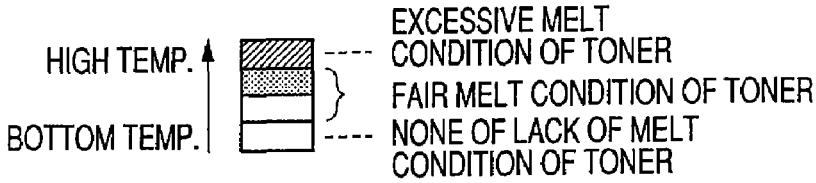
FIGS. 12A, 12B, and 12C are model diagrams illustrating how the recording material and the toner image are melted in the fixing process of Embodiment 1.
Figure 12A:
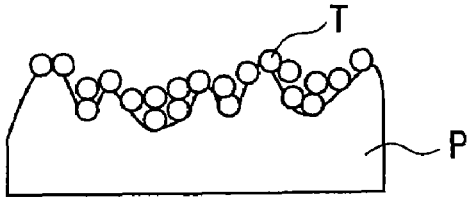
Figure 12B:
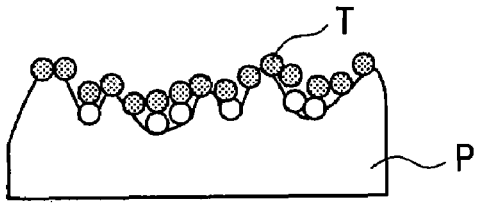
Figure 12C:
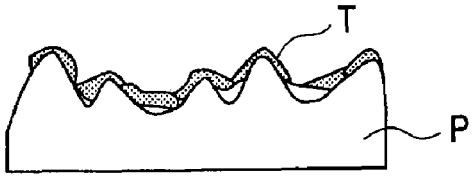

FIGS. 12A, 12B, and 12C are model diagrams illustrating the condition of the recording material P and the toner image T in this fixing process for describing the melting/fixing process.

FIG. 12A illustrates differences in toner condition in the following toner layer model diagrams in terms of differences in patterns.

FIG. 12A is a diagram illustrating the condition of the recording material P and the toner image T before entering the pre-nip portion N1. Similarly, FIG. 12B illustrates the condition thereof immediately after the passage through the pre-nip portion N1. FIG. 12C illustrates the condition thereof immediately after the passage through the pressure nip portion N2.

In the state illustrated in FIG. 12A, the toner image T has not been fixed to the recording material P yet. FIG. 12B illustrates the toner melting state immediately after passage through the pre-nip portion N1. FIG. 12C illustrates the toner melting state immediately after passage through the pressure nip portion N2.

In the following, the process by which the toner image T is fixed by using the fixing unit according to this embodiment is described with reference to FIG. 11 illustrating the temperature profile and the pressurizing force (applied pressure) distribution, and FIGS. 12A, 12B, and 12C which are model diagrams illustrating the condition of the recording material P and the toner image T. In FIG. 12A, the recording material (recording paper) P bearing the toner image T is first introduced to the pre-nip portion N1.

As illustrated in FIG. 11, in the pre-nip portion N1, the toner image T is gradually pre-heated, with its temperature rising. At this time, the temperature profile at the pre-nip portion N1 rises, and its inclination becomes gradually gentler as the rear half of the pre-nip portion N1 is approached, indicating a tendency toward saturation.

As illustrated in FIG. 11, at this time, the temperature within the range of the pre-nip portion N1 has reached a level substantially equal to or higher than the outflow start temperature in the flow tester.

First, it is desirable to attain a temperature substantially equal to or higher than the outflow start temperature in the flow tester for the following reason.

In order for the toner image T to be actually fixed to the recording paper P with a sufficient strength, it is necessary to effect the fixing with an anchor effect at least causing the image to permeate into the paper fibers and be embedded for fixation among the fibers. Further, in order to cause the image to thus permeate into the paper fibers, it is first necessary for the toner to be melted and be in a deformable condition.

From the measurement principle thereof, the outflow start temperature Tfb in the flow tester illustrates a temperature at which the toner thus starts to be melted and deformed.

That is, in the flow tester, when the temperature is gradually increased for the toner pellet under a fixed load, the temperature at which the toner starts to flow out of the die hole is the temperature at which the toner starts to be melted and deformed. This has also been experimentally confirmed as follows.

When the recording paper P bearing the toner image T was left to stand under no pressure and at a temperature equal to or lower than the outflow start temperature Tfb, the toner image T borne on the recording paper underwent no change at all.

On the other hand, when left to stand in an environment of a temperature equal to or higher than the outflow start temperature Tfb, the toner image T borne on the recording paper has started to be melted, which obviously indicated an improvement in terms of the adhesion force for the image with respect to the recording paper.

Next, the reason why it is desirable for the temperature of the toner image T to be equal to or higher than Tfb, in particular, in the pre-nip portion N1, is that a sufficiently melted state should be attained before the pressure nip portion N2, in which a pressurizing force is applied, is reached.

The recording paper P bearing the toner image T appropriately causes the toner image T to permeate into the paper fibers of the recording paper by receiving the pressurizing force in the pressure nip portion N2 under the pressurizing force, whereby a fixed image is obtained.

At this time, when, in the pre-nip portion N1, a temperature equal to or higher than Tfb has already been attained, the toner image T can maintain a temperature substantially equal to or higher than the outflow start temperature over the entire area of the pressure nip portion N2 under the pressurizing force. That is, the toner image T is in a state in which the toner image T is melted and deformed over the entire area in the pressure nip portion N2, and hence the pressurizing force imparted at the pressure nip portion N2 is used, without waste, to cause the toner image T to permeate into the recording paper P.

On the other hand, when there is a portion, in the pressure nip portion N2, in which the toner has not attained a temperature equal to or higher than the outflow start temperature Tfb, the toner image T is in a state in which the toner image T undergoes no deformation. Thus, the pressurizing force imparted in that portion is used wastefully as a force to press the granular toner against the recording paper, and the force with which the image is caused to effectively permeate into the recording paper P decreases.

In this way, in order to effectively utilize the imparted pressurizing force and to fix the toner image T with a minimum requisite pressurizing force, the temperature of the toner image T is made equal to or higher than Tfb over the entire area in the pressure nip portion N2 under the pressurizing force. That is, in the pre-nip portion N1, it is desirable for the temperature of the toner image T to be equal to or higher than the outflow start temperature Tfb in the flow tester.

It goes without saying that the desired effect is not eliminated if the temperature of the toner image T has not reached Tfb in the pre-nip portion N1. In this case also, by raising the temperature of the toner image T as high as possible in the pre-nip portion N1, it is possible to approximate a condition in which an optimum effect can be attained.

By thus being slowly pre-heated, the toner image T is melted substantially uniformly also in the thickness direction thereof, thus attaining a fair melting state from the upper layer to the lower layer of the toner layer. At the same time, in the pre-nip portion N1, there is exerted practically no pressure, and hence, as illustrated in FIG. 12B, the toner image T on the recording paper P remains in a state in which the toner image T is melted without permeating into the recording paper P so much.

In this way, after a sufficiently melted state has been attained in the pre-nip portion N1, the recording paper P reaches the pressure nip portion N2, and receives a pressurizing force as illustrated in FIG. 11.

At this time, the toner image T has attained a temperature equal to or higher than the outflow start temperature Tfb in the pre-nip portion N1, and the toner image T is sufficiently melted in the thickness direction thereof, and hence the applied pressurizing force can be effectively utilized to cause the toner image T to appropriately permeate into the recording paper P. That is, the toner image T has been sufficiently melted, and hence the toner image T permeates appropriately into the paper fibers if no high pressurizing force is applied, thus providing the requisite fixing property. At this time, there is no need for a high pressurizing force, and hence the toner image T does not permeate into the paper fibers to an excessive degree.

The recording paper P pressurized in the pressure nip portion N2 is delivered from the pressure nip portion N2 after the toner image T has appropriately permeated, thereby providing a fixed image having a satisfactory fixing property (FIG. 12C).

The fixing process realized by the fixing unit according to this embodiment, which effects fixing by the above-mentioned process, has the following three features.

The first feature of the fixing process using the fixing unit according to this embodiment is that substantially no pressurizing force is imparted until the temperature of the toner image T has been increased to a sufficient degree.

When pressurizing is effected in the state in which the toner has not been melted, the pressurizing force only presses the powder-like toner against the recording paper P, and hence the pressurizing force does not contribute to fixing at all. The pressurizing force at this time is wasted. That is, in order to perform fixing efficiently, it is necessary to apply the pressurizing force in a state in which the toner image T has been melted to a sufficient degree.

As illustrated in FIG. 11, in the range of the pre-nip portion N1, which is in the process of heating the toner image T, no pressurizing force is applied.

In this embodiment, a construction in which pre-heating is effected on the recording paper P bearing the toner image T in the region of the pre-nip portion N1 without positively applying a pressurizing force thereto, is realized by forming the pre-nip portion N1 pinched between the fixing belt 11 and the pressure belt 12.

The second feature of the fixing unit according to this embodiment is that, over the region of the pressure nip portion N2 under pressurizing force, the temperature of the toner image T is maintained at a level equal to or higher than the outflow start temperature Tfb in the flow tester.

As illustrated in FIG. 11, in the region of the pressure nip portion N2 under pressurizing force, the temperature of the toner image T is maintained at a level equal to or higher than the outflow start temperature Tfb in the flow tester.

As a result, when the temperature of the toner image T attains a level equal to or higher than Tfb, and pressurization is effected in a sufficiently melted state, it is possible to effect fixing to the recording material P with a minimum requisite pressurizing force.

The reason why it is necessary for the image temperature in the pressure nip portion N2 to be, in particular, at a level equal to or higher than "the outflow start temperature in the flow tester" is as described above.

In this way, by effecting pressurization in a state in which the toner is melted to a sufficient degree, the pressurizing force is not wasted, and it is possible to cause the melted toner to appropriately permeate into the paper fibers, thereby performing the fixing efficiently.

The third feature of the fixing unit according to this embodiment is that pressurization is effected in a state in which the difference between the temperature of the upper layer of the toner image T and the temperature of the lower layer of the toner image T is small, that is, when the toner has been melted approximately uniformly in the thickness direction of the toner image T.

As illustrated in FIG. 11, the temperature profile of the fixing unit according to this embodiment is obtained such that the temperature of the toner image T increases in the pre-nip portion N1 to attain a level equal to or higher than Tfb. The gradient of the temperature change of the toner image T becomes gradually gentler as the rear half of the pre-nip portion N1 is reached, exhibiting a tendency toward saturation.

That the temperature change thus exhibits a tendency toward saturation indicates that the temperature gradient is reduced in the vicinity thereof.

That is, it indicates that the heat of the fixing belt 11 has been sufficiently conducted to the recording paper P side, with the difference in temperature between the fixing belt and the recording paper P being reduced.

This also applies to the thickness direction of the recording paper P.

That is, it indicates that, at this time, the temperature distribution in the thickness direction of the recording paper P, that is, the temperature distribution in the thickness direction of the toner image T in the state in which the toner image T is actually borne, is reduced.

That the temperature distribution in the thickness direction of the toner image T is reduced means that the toner melting state in the upper layer of the toner image T is close to that in the lower layer thereof, indicating that it is possible to effect melting substantially uniformly in the thickness direction (FIG. 12B).

When the toner image T is thus in the same melting state in the upper layer and the lower layer thereof, pressurization is effected in the pressure nip N2, whereby the melted toner is caused to appropriately permeate into the paper, and, at the same time, a sufficient gloss is realized.

As described above, in the fixing device according to this embodiment, in the pre-nip portion N1, the recording paper P bearing the toner image T is pre-heated sufficiently, and a state is attained in which the temperature difference between the upper layer of the toner image T and the lower layer of the toner image T is small. That is, there is attained a toner melting state that is substantially uniform in the thickness direction of the toner image T. Further, after the toner has been melted, pressurization is effected in the pressure nip portion N2, whereby the melted toner is caused to appropriately permeate into the paper to fix thereto, and a sufficient degree of gloss is realized.

Actually, the above-mentioned effect could also be obtained within a range of approximately ±5° C. with respect to the outflow start temperature Tfb in the flow tester.

Thus, the same effect can be obtained when the "substantially outflow start temperature" is approximately in the range: outflow start temperature Tfb±5° C.

Figure 13:
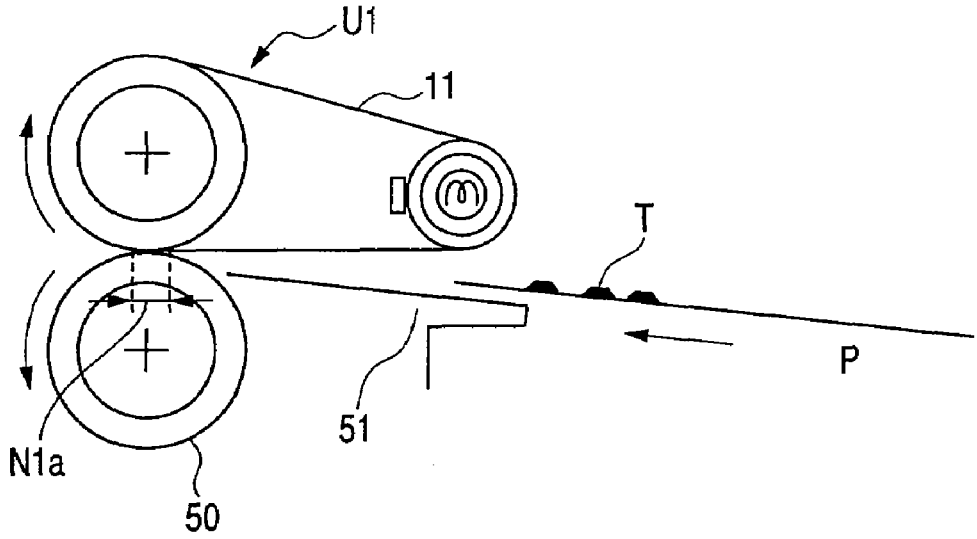
FIG. 13 is a schematic cross-sectional view of a fixing device according to Comparative Example 1.
Figure 14:
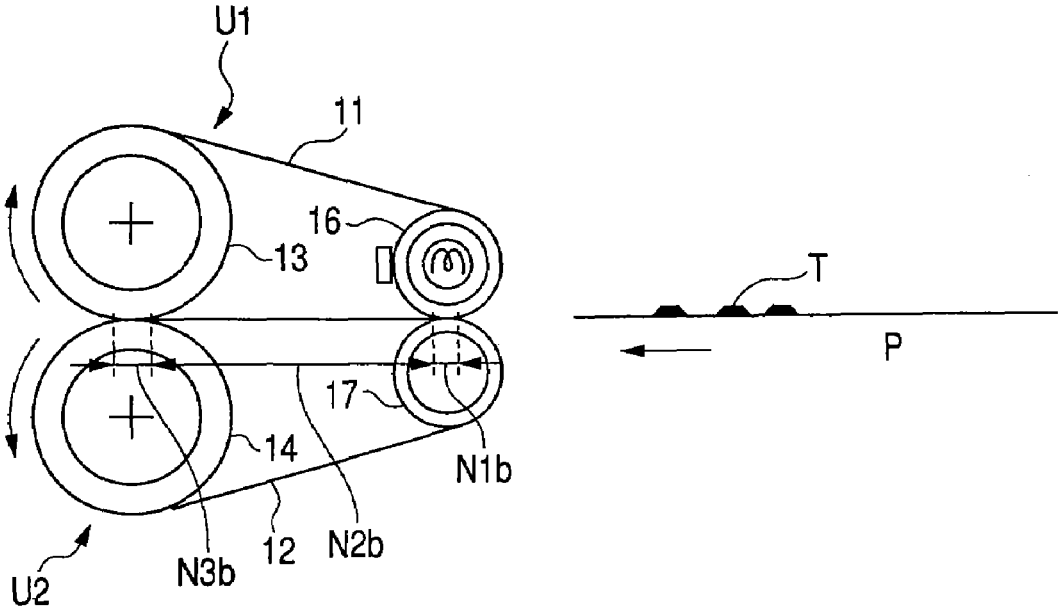
FIG. 14 is a schematic cross-sectional view of a fixing device according to Comparative Example 2.
Figure 15:
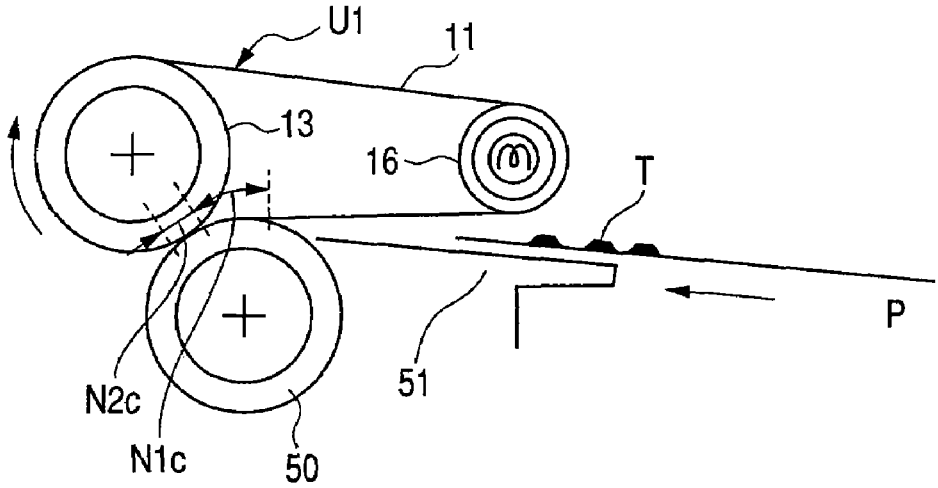
FIG. 15 is a schematic cross-sectional view of a fixing device according to Comparative Example 3.

FIGS. 13, 14, and 15 are sectional views of fixing devices (fixing units) according to Comparative Examples 1, 2, and 3 prepared for comparison with the fixing device (fixing unit) 112 according to this embodiment. Here, the members and portions that are the same as those of the fixing unit 112 according to this embodiment are denoted by the same reference symbols, and a redundant description thereof is omitted.

In the fixing unit according to Comparative Example 1 illustrated in FIG. 13, a nip portion N1*a* is formed by a fixing belt unit U1 in which a belt is wrapped as illustrated in FIG. 6A, and a roller 50 having a releasing layer in the surface layer. Here, a fixing inlet guide 51 for guiding the recording material P is arranged along the fixing belt 11, and pre-heating of the toner image T and the recording material P is effected by radiation heat from the fixing belt 11.

As in the fixing unit according to this embodiment, in the fixing unit according to Comparative Example 2 illustrated in FIG. 14, two endless belts are respectively wrapped around two rollers 13•16 and 14•17, and the endless belts 11•12 are held in press contact with each other to form nip portions N1*b*-N2*b*-N3*b*. The fixing unit of this comparative example differs from that according to this embodiment in that rollers corresponding to the heat roller 16 and the tension roller 17 are urged so as to be held in contact with each other, and that the surfaces of the belts 11•12 wrapped around the heat roller 16 and the tension roller 17 are held in contact with each other.

In the fixing unit according to Comparative Example 3 illustrated in FIG. 15, instead of the pressure belt unit U2 of the fixing unit according to this embodiment, there is used a roller 50 having a releasing layer in the surface layer, and the fixing belt 11 of the fixing belt unit U1 is wrapped around the circumference of the roller 50, thereby forming a nip of a width relatively larger than that of the heat roller fixing unit according to Comparative Example 1.

Regarding the fixing units according to Comparative Examples 1 through 3, the measurement of the pressurizing force distribution and the temperature profile was conducted by the same method as that for the fixing unit according to this embodiment.

Figure 16:
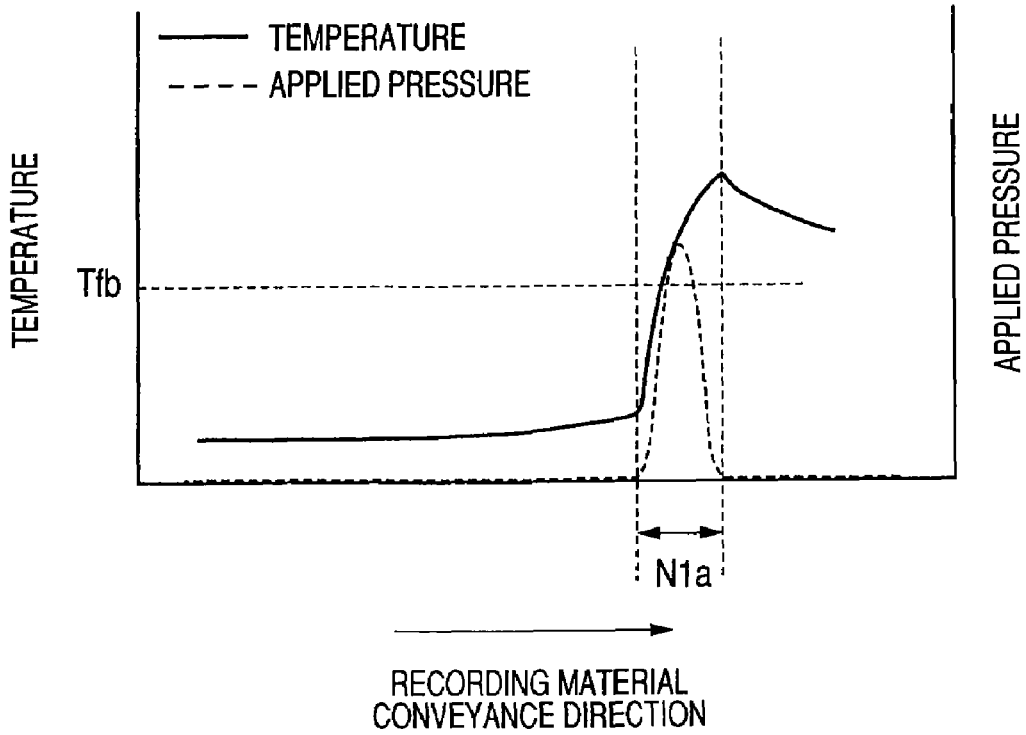
FIG. 16 is an explanatory view illustrating the pressing force distribution and temperature profile of the fixing device according to Comparative Example 1.
Figure 17:
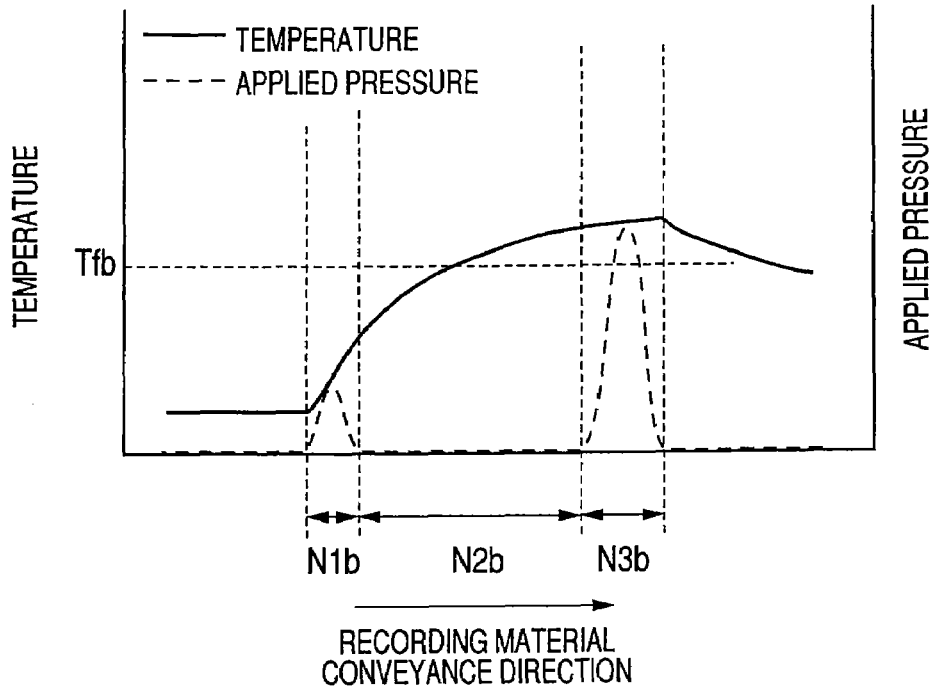
FIG. 17 is an explanatory view illustrating the pressing force distribution and temperature profile of the fixing device according to Comparative Example 2.
Figure 18:
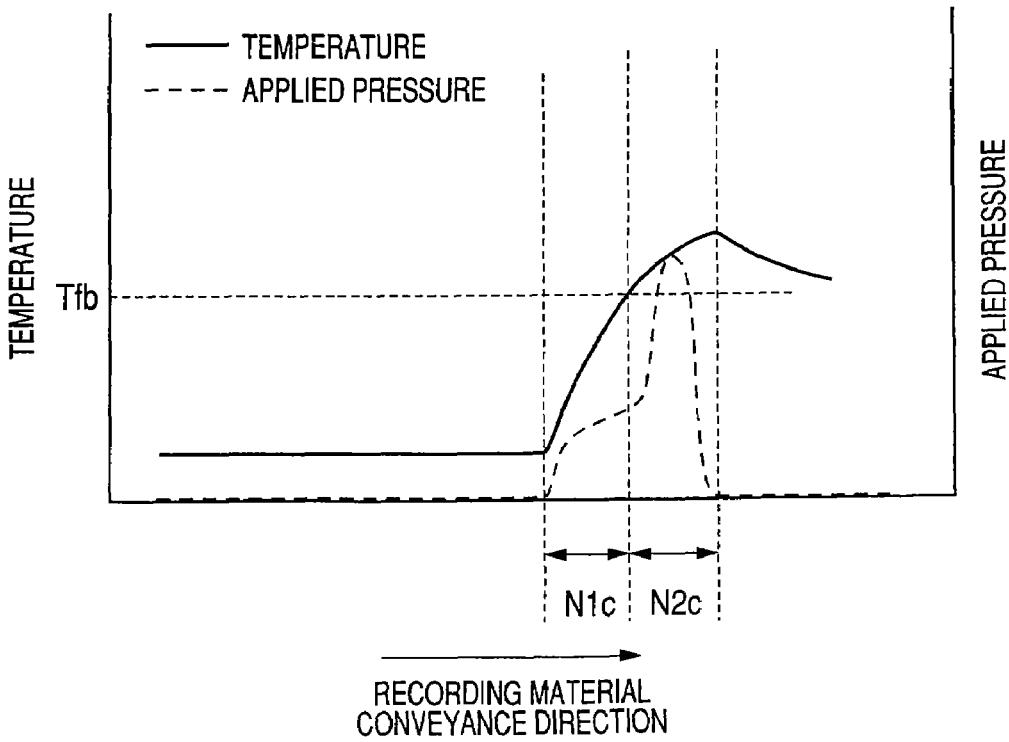
FIG. 18 is an explanatory view illustrating the pressing force distribution and temperature profile of the fixing device according to Comparative Example 3.

FIGS. 16 through 18 illustrate the measurement results of pressurizing force distribution and temperature profile in Comparative Examples 1 through 3. FIGS. 19A through 21F are model diagrams illustrating the melting state of the recording material P and the toner image T in Comparative Examples 1 through 3.

First, the result of fixing operation conducted by using the fixing unit according to Comparative Example 1 illustrated in FIG. 13 is described.

Figure 19A:
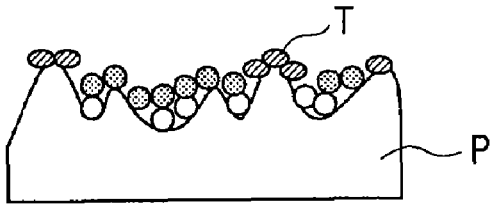
FIGS. 19A, 19B, 19C, and 19D are model diagrams illustrating how the recording material P and the toner image are melted in the fixing process of the fixing device according to Comparative Example 1.
Figure 19B:
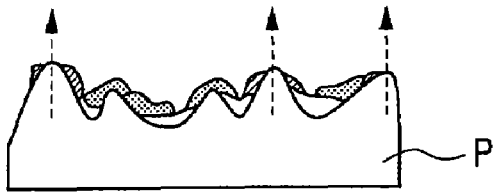

FIG. 19A is a diagram illustrating the condition of the recording paper P and the toner image T immediately before the recording paper enters the nip portion N1*a* in the fixing unit according to Comparative Example 1. Similarly, FIG. 19B is a model diagram illustrating the condition after the recording paper has left the nip portion N1*a*.

In the fixing unit according to Comparative Example 1, the recording paper P bearing the toner image T is first conveyed along the fixing inlet guide 51. At this time, the recording paper P is heated by radiation heat from the toner image T bearing surface side. However, the quantity of heat conducted by radiation is small, and hence the temperature of the recording paper P hardly increases. Subsequently, the recording paper P bearing the toner image T enters the nip portion N1*a*, and is brought into contact with the fixing belt 11 to receive heat therefrom, and is simultaneously pressurized before being delivered.

The same toner image T as used in this embodiment was fixed by the fixing unit according to Comparative Example 1. It was impossible to obtain a fixed image having a gloss of a level that is the same as or higher than the fixed image obtained by the fixing unit according to this embodiment.

The fixed image obtained by the fixing unit according to Comparative Example 1 was observed. Then, the toner situated at the convex portions of the recording paper P having the asperity feature permeated into the recording paper P, and the ground tone of the paper fibers became easily visible, resulting in an uneven fixed image in which the fixed toner image T and the ground tone of the paper are visible in a mixed state. As a result, it was impossible to realize a gloss of a level equal to that of the fixed image as obtained by the fixing unit according to this embodiment.

It is to be inferred that this is due to the following mechanism.

FIG. 16 illustrates the result of measurement of pressurizing force distribution and temperature profile in the fixing unit according to Comparative Example 1. The fixing unit according to Comparative Example 1 greatly differs from the fixing unit according to this embodiment in the temperature in the region of the nip portion N1*a* under pressurizing force.

First, in the fixing unit according to Comparative Example 1, the temperature of the toner image T scarcely increases until the nip portion N1*a* is reached, and hence it is necessary to impart heat in the region of the nip portion N1*a*, which is of a length smaller than the total nip width in the fixing unit according to this embodiment. In order to conduct heat with a small nip width, it is necessary to increase the temperature gradient with respect to the recording paper, that is, to set the temperature of the fixing belt according to Comparative Example 1 higher than the temperature of the fixing belt 11 of the fixing unit according to this embodiment.

However, if an attempt is made to thus conduct heat abruptly, the temperature difference in the toner image layer direction becomes obviously likely to be generated. That is, a state is attained in which the difference in temperature between the upper layer of the toner image T and the lower layer of the toner image T is large. This means that the melting state in the upper layer of the toner image T greatly differs from that of the lower layer thereof.

FIGS. 19A and 19B are model diagrams illustrating the case in which pressure is applied at a timing involving this great difference between the upper layer and the lower layer of the toner image in terms of the melting stage.

FIG. 19A illustrates the condition of the toner image T in the nip portion N1*a*. FIG. 19B illustrates the condition of the toner image T immediately after the toner image T has left the nip portion N1*a*.

As illustrated in FIG. 19A, when, in the nip portion N1*a* region, the toner lower layer temperature attains an optimum level for allowing the toner to appropriately permeate into the paper, the melting state in the upper layer of the toner image T is already an excessive melted state. Thus, when pressure is applied in this condition, the toner in the upper layer of the toner image is allowed to excessively permeate into the paper fibers, and hence the ground tone of the paper fibers is exposed on the surface of the fixed image.

When the ground tone of the paper fibers becomes visible on the surface of the fixed image, the convex portions of the paper fibers cease to be covered with the toner image, and a "see-through" state as indicated by the arrows of FIG. 19B is generated. At the same time, the fibers on the paper surface cannot be uniformly covered with the toner image, and hence it is rather difficult to attain high image density.

Further, the smoothness of the fixed image surface is impaired, and hence it is difficult to attain a high level of gloss.

Figure 19C:
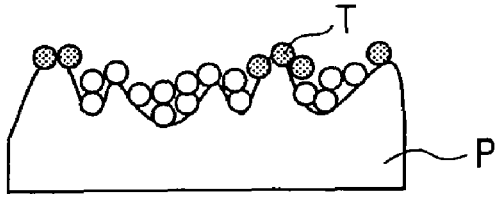
Figure 19D:
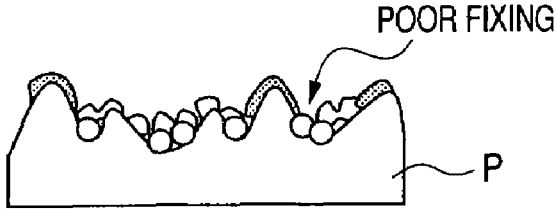

On the other hand, in order to suppress this excessive melting of the upper layer of the toner image T, an attempt was made to effect fixing, with the temperature of the fixing belt being lowered so that the temperature of the upper layer of the toner image T would become lower than this. FIGS. 19C and 19D are model diagrams illustrating the melting state of the toner layer at this time.

Like FIGS. 19A and 19B, FIG. 19C illustrates the condition of the toner image T in the region of the nip portion N1*a*, and FIG. 19D illustrates the condition of the toner image T immediately after the toner image T has left the region of the nip portion N1*a*.

In this case, the toner of the upper layer of the toner image T did not attain so high a temperature as to cause excessive melting, and non see-through state was generated. At the same time, however, the temperature of the lower layer of the paper fibers is reduced, and hence the toner of the paper fiber lower layer is not melted to a sufficient degree, resulting in generation of cold offset (FIGS. 19C and 19D).

In this way, in the fixing unit according to Comparative Example 1, if the temperature of the fixing belt 11 is varied, there are involved the problems of a reduction in gloss due to permeation into the recording paper P as a result of excessive melting of the toner image T, and generation of cold offset due to insufficient melting of the toner. Thus, in the fixing unit according to Comparative Example 1, it was impossible to obtain a fixed image of a sufficient gloss due to the two problems involved.

Next, the result of fixing conducted by using the fixing unit according to Comparative Example 2 is described.

In the fixing unit according to Comparative Example 2, in addition to the nip portions (pre-nip portion N1 and pressure nip portion N2) of the fixing unit according to this embodiment, there is provided a nip region formed through contact between portions of the belt wrapped around the heat roller 16 and the tension roller 17.

In the fixing unit according to Comparative Example 2 illustrated in FIG. 14, there are provided, successively from the upstream side with respect to the recording material conveyance direction, the nip portion N1*b* formed by portions of the belts 11•12 wrapped around the heat roller 16 and the tension roller 17, and the nip portion N2*b* in which portions of the belts 11•12 are held in contact with each other. Further, a nip portion in which portions of the belts 11•12 wrapped around the fixing roller 13 and the pressure roller 14 are held in contact with each other is referred to as nip portion N3*b*.

Figure 20A:
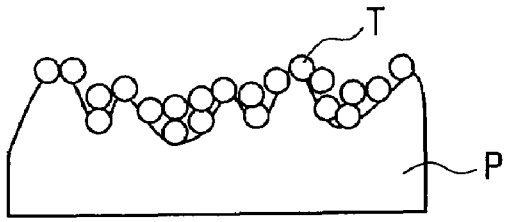
FIGS. 20A, 20B, 20C, and 20D are model diagrams illustrating how the recording material P and the toner image are melted in the fixing process of the fixing device according to Comparative Example 2.

FIG. 20A is a diagram illustrating the condition of the recording paper P and the toner image T immediately before the recording paper enters the nip region. In this state, the toner image T has not been fixed to the recording material yet.

Figure 20B:
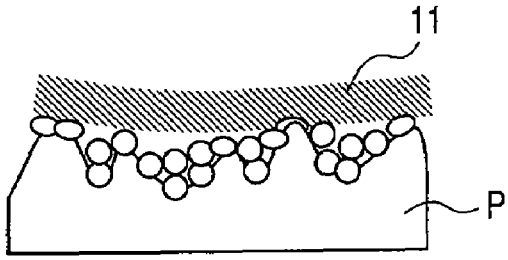
Figure 20C:
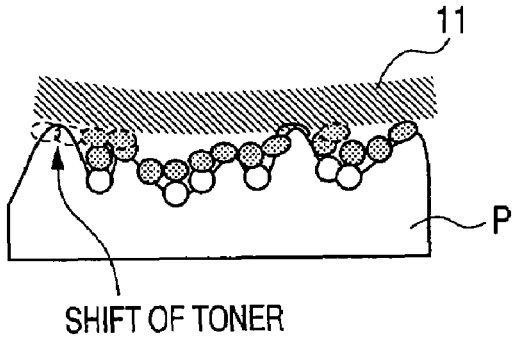
Figure 20D:
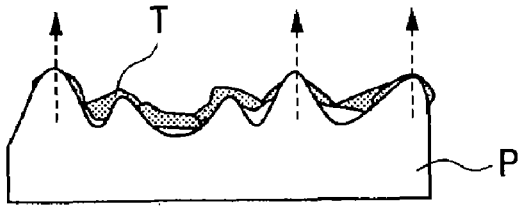

FIGS. 20B, 20C, and 20D are model diagrams illustrating the condition of the recording paper P and the toner image T immediately after their passage through the nip portions N1*b*, N2*b*, and N3*b*.

The fixing process using the fixing unit according to Comparative Example 2 is described sequentially.

First, the recording paper P bearing the toner image T is introduced to the nip portion N1*b* formed by the portions of the belts 11•12 wrapped around the heat roller 16 and the tension roller 17, and heat is imparted thereto as illustrated in FIG. 17. At the same time, pressurization is effected by the heat roller 16 and the tension roller 17 urged through an intermediation of the belts 11•12, whereby the toner image T starts melting to some degree, and starts to permeate into the recording paper P (FIG. 20B). When the recording paper P then reaches the nip portion N2*b*, the force with which the recording paper is pinched is weaker in the region of the nip portion N2*b*, and hence a reduction in pressure occurs with respect to the nip portion N1*b*. That is, the closeness between the belts 11•12 and the recording paper P is insufficient, resulting in generation of so-called pressure-absence (FIG. 20C). When such pressure-absence is generated, misregistration of an image occurs regardless of the temperature of the toner image T.

When the fixing belt 11 is once pressed against the recording paper P, and then separated therefrom, the toner image T borne on the recording paper P is divided into a portion adhering to the recording paper P side and a portion adhering to the belt 11 side. This is the same if the toner is not melted but in the granular state, or if it is in the melted state.

In the nip portion N2*b*, heat is incessantly imparted to the recording paper P, and hence a contracting force is acting on the recording paper P. When, in this state, the force with which the fixing belt 11 pressurizes the paper is weakened, there is generated a deviation in toner position between the fixing belt 11 and the paper, between which there is a relative difference in contraction degree (FIGS. 20B and 20C).

In this disturbed image state, the image is pressurized and fixed in the nip portion N3*b* (FIG. 20D). Thus, the image obtained after fixing is an abnormal image in the so-called "image misregistration" state, resulting in an uneven fixed image.

In this way, in the fixing unit of the construction according to Comparative Example 2, while it is possible to realize a large nip width, a trough is generated in the pressurization force distribution within the nip, and hence pressure-absence is generated, which makes it very difficult to prevent misregistration of an image.

Next, the result of fixing operation using the fixing unit according to Comparative Example 3 is described.

In the fixing unit according to Comparative Example 3 illustrated in FIG. 15, a roller 50 having a releasing layer on its surface as in the case of the fixing unit according to Comparative Example 1, is held in contact with the fixing belt unit U1 of the fixing unit according to this embodiment, thereby forming the nip portion. In this process, the fixing belt 11 of the fixing belt unit U1 is arranged so as to be wrapped around the roller 50. As a result, on the upstream side in the recording material conveyance direction of a nip portion N2*c* formed by the press contact region of the fixing roller 13 and the roller 50 contained in the fixing belt 11, there is formed a nip portion N1*c* through contact between the surface of the fixing belt 11 and the surface of the roller 50.

In this way, in the fixing unit according to Comparative Example 3, the nip portion N1*c* is formed on the upstream side in the recording material conveyance direction of the nip portion N2*c*, whereby a large nip width is secured for the entire fixing unit.

In the fixing unit according to Comparative Example 3, when wrapping the fixing belt 11, the nip portion N1*c* is formed in a closer state, and hence the fixing belt 11 and the fixing roller 13 are maintained in an appropriately tense state by the fixing roller 13 and the heat roller 16. Further, the fixing roller 13 contained in the fixing belt 11 is urged toward the roller 50, applying a pressurizing force necessary for fixing.

Figure 21A:
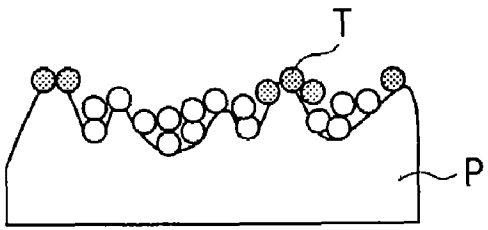
FIGS. 21A, 21B, 21C, 21D, 21E, and 21F are model diagrams illustrating how the recording material P and the toner image are melted in the fixing process of the fixing device according to Comparative Example 3.
Figure 21B:
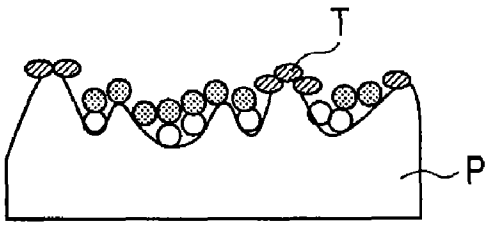
Figure 21C:
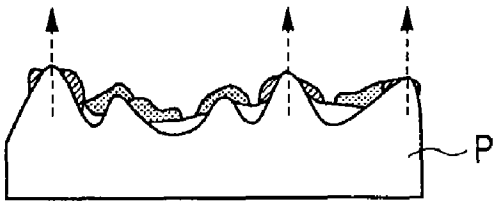

FIG. 21A is a diagram illustrating the condition of the recording paper P and the toner image T in the nip portion N1*c*. FIGS. 21B and 21C are model diagrams respectively illustrating the condition of the recording paper P and the toner image T in the nip portion N2*c*, and the condition of the recording paper P and the toner image T immediately after their passage through the nip portion N2*c*.

The fixing process conducted by using the fixing unit according to Comparative Example 3, and the features of the fixed image obtained by this fixing process are sequentially described. First, the recording paper P bearing the toner image T is introduced to the nip portion N1*c* formed by the fixing belt 11 and the roller 50. Here, the recording paper P bearing the toner image T receives heat from the belt 11. At the same time, as illustrated in FIG. 18, also in the nip portion N1*c*, which is the wrapping portion for the belt 11, a certain degree of pressurizing force is exerted, and hence, simultaneously with its melting, the toner is pressed against the recording paper P. Subsequently, the recording paper enters the nip portion N2*c*, and receives a pressurizing force as indicated by the pressurizing force distribution of FIG. 18, and, at the same time, the toner temperature increases, and hence the melting of the toner gradually progresses, with the toner permeating into the recording paper P to be fixed thereto.

Observation of the fixed image obtained by using the fixing unit according to Comparative Example 3 illustrated that it was the same as the fixed image obtained by using the fixing unit according to Comparative Example 1. That is, the portion of the toner situated at the convex portion of the asperity feature of the recording paper P was allowed to excessively permeate into the recording paper P to make the ground tone of the paper fibers easily visible, thus generating a "see-through" state. At the same time, the fixed toner image T and the ground tone of the paper were visible in a mixed state, resulting in an uneven fixed image. When the ground tone of the paper is thus exposed to be visible on the fixed image surface, the smoothness of the fixed image surface is impaired, and hence the gloss naturally tends to be rather low.

Thus, in the fixed image obtained by the fixing unit according to Comparative Example 3, it is was impossible to realize a gloss equivalent to that of the fixed image obtained by the fixing unit according to this embodiment.

It is to be assumed that the fixed image obtained by the fixing unit according to Comparative Example 3 exhibits such a fixed image surface for the following reason.

FIG. 18 illustrates the pressurizing force distribution and temperature profile in the fixing unit according to Comparative Example 3. This fixing unit greatly differs from the fixing unit according to this embodiment in that the width of the nip width formed by the nip portion N1*c* and the nip portion N2*c* is smaller as compared with the total nip width realized in this embodiment.

It is possible to form the nip portion N2*c* under pressurizing force in a length equivalent to that of the pressure nip width N2 according to this embodiment through adjustment of the pressurizing force, etc. However, in the fixing unit according to Comparative Example 3, it is rather difficult to form the nip portion N1*c* formed on the upstream side in the recording material conveyance direction of the nip portion N2*c* in a dimension equivalent to or larger than that of the pre-nip portion N1 according to this embodiment.

This is due to the fact that, in the fixing unit according to Comparative Example 3, the nip portion N1*c* is formed by wrapping the belt 11 around the roller 50, and it is not easy to elongate the nip portion N1*c*. As a means for elongating the nip portion N1*c*, it might be possible to further wrap the fixing belt 11 around the roller 50. In such a method, however, the recording paper is curved over a long region in the fixing process, and hence the curling of the paper after fixing is deteriorated.

As another means, it might be possible to elongate N1*c* by enlarging the outer diameter of the roller 50 while keeping the curvature small. However, in this case also, the size of the fixing unit increases, and the heat capacity increases as the diameter of the roller 50 increases. Thus, due to an increase in warming-up time, an increase in heat dissipation area, etc., the energy saving property of the fixing unit deteriorates.

In this way, in the construction of the fixing unit according to Comparative Example 3, it is rather difficult to form a nip width equivalent to or larger than that of the fixing unit according to this embodiment without involving any problems.

Thus, in the fixing unit construction according to Comparative Example 3, it is necessary to impart heat with the nip portions N1*c*•N2*c* of a smaller width than the total nip width of the fixing unit according to this embodiment.

In order to conduct heat with a small nip width, it is necessary to make the temperature gradient with respect to the recording paper large as in Comparative Example 1, that is, to set the temperature of the fixing belt according to Comparative Example 3 higher than the temperature of the fixing belt 11 of the fixing unit according to this embodiment.

However, it is apparent that an attempt to thus conduct heat abruptly, that is, to enlarge the temperature gradient of the fixing belt 11 and the recording paper P, results in a difference in temperature being easily generated within the layer direction of the toner image T and the recording paper P, which are the objects of heating. That is, as illustrated in FIGS. 21A and 21B, in the regions of the nip portions N1*c* and N2*c*, there is generated a difference in temperature between the upper layer and the lower layer of the toner image T, and hence it is impossible to warm the image sufficiently over the entire thickness thereof.

As illustrated in FIGS. 21A and 21B, when the temperature of the lower layer of the toner image T has attained an optimum level for permeation into the paper, the upper layer of the toner image T is already in an excessively melted state.

As a result, the toner of the upper layer of the toner image T is allowed to excessively permeate into the paper fibers, and hence the ground tone of the paper fibers is exposed on the fixed image surface to generate a "see-through" state (FIG. 21C). At the same time, it is impossible to uniformly cover the fibers on the paper surface with the toner image, and hence high image density cannot be attained.

At the same time, the smoothness of the fixed image surface is impaired, and hence it is also impossible to attain a high gloss that is equivalent to that of the fixed image obtained by the fixing unit according to this embodiment.

Figure 21D:
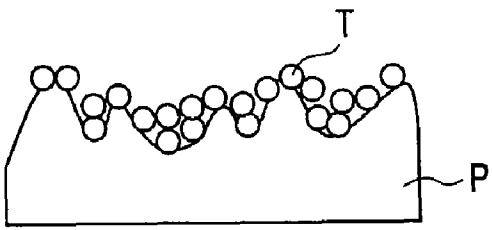
Figure 21E:
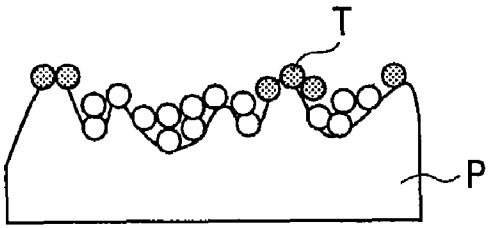
Figure 21F:
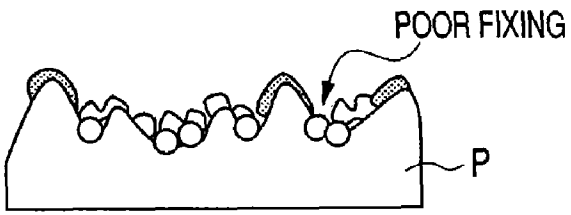

On the other hand, in order to suppress the excessive melting of the upper layer of the toner image T, an attempt was made to perform fixing with the temperature of the fixing belt 11 lowered so that the temperature of the upper layer of the toner image T would be lower than that. FIGS. 21D, 21E, and 21F are model diagrams illustrating the toner image melting state at this time.

FIG. 21D is a model diagram illustrating the condition of the recording paper P and the toner image T in the nip portion N1*c* when fixing is performed with the temperature of the fixing belt 11 lowered. FIG. 21E is a model diagram illustrating the condition of the recording paper P and the toner image T in the nip portion N2*c* when fixing is performed with the temperature of the fixing belt 11 lowered. FIG. 21F is a model diagram illustrating the condition of the recording paper P and the toner image T immediately after their passage through the nip portion N2*c* when fixing is performed with the temperature of the fixing belt 11 lowered.

In this case, the toner of the upper layer of the toner image T did not reach a temperature causing excessive melting (FIGS. 21D and 21E), and no see-through state was attained. However, since the temperature of the lower layer of the paper fibers is reduced, the toner of the lower layer of the paper fibers is not sufficiently melted, resulting in generation of cold offset (poor fixing) (FIG. 21F).

In this way, as in Comparative Example 1, also in the fixing unit construction according to Comparative Example 3, pressurization is effected, with a difference in temperature being generated between the upper layer and the lower layer of the toner image T in the nip portion. Thus, also in the fixing unit according to Comparative Example 3, due to the problems of a reduction in gloss attributable to permeation of the toner image T into the recording paper P as a result of excessive melting, and generation of cold offset attributable to insufficient melting of the toner, it is impossible to obtain a fixed image having sufficient gloss.

As described above, in the fixing device 112 according to this embodiment, the fixing belt unit U1 (FIG. 6B) and the fixing belt unit U2 (FIG. 7B) each having a relaxed portion are intentionally held in contact with each other, thus forming the pre-nip portion N1 formed solely by the elasticity of the belts. Thus, in the fixing process using the fixing unit according to this embodiment, it is possible to realize the pressurizing force distribution and temperature profile as illustrated in FIG. 11 having the following features (i) through (iii).

(i) Scarcely any pressurizing force is imparted until the temperature of the toner image T increases to a sufficient degree.

(ii) Over the region of the pressure nip portion N2 under pressurizing force, the temperature of the toner image T is maintained substantially at the outflow start temperature Tfb in the flow tester or more.

(iii) Pressurization is effected in a state in which the difference in temperature between the upper layer of the toner image T and the lower layer of the toner image T is small, that is, in a toner melting state practically uniform in the thickness direction of the toner image T.

By realizing such pressurizing force distribution and temperature profile, it is possible to realize a large nip width adaptable for an increase in speed, and, at the same time, it is possible to obtain a fixed image free from pressure-absence leading to image abnormality such as misregistration of an image and having a sufficient gloss.

While in this embodiment, there is described a fixing unit construction formed by the fixing belt unit U1 (FIG. 6B) and the pressure belt unit U2 (FIG. 7B) each having a relaxed portion, the fixing unit construction is not restricted to this one. That is, the same effects can be attained as long as there is adopted a fixing device in which the pre-nip portion N1 formed solely by the elasticity of the belts 11•12 is formed on the upstream side with respect to the recording material conveyance direction of the pressure nip portion N2.

As illustrated in FIG. 9, in the fixing device 112 according to this embodiment, there is described a case in which, the fixing belt 11 and the pressure belt 12 are of the same specifications, and the fixing roller 13 and the pressure roller 14 are of the same specifications.

The fixing device 112 has the pre-nip portion N1 which is formed through contact between the fixing belt 11 and the pressure belt 12, from the upstream side with respect to the recording material conveyance direction, without any backup of the fixing roller 13 and the pressure roller 14. Further, subsequent to the pre-nip portion N1, there is provided the pressure nip portion N2, which is held so as to be continuous with the pre-nip portion N1 through contact between the fixing belt 11 and the pressure belt 12 with backup by the fixing roller 13 and the pressure roller 14.

Figure 22:
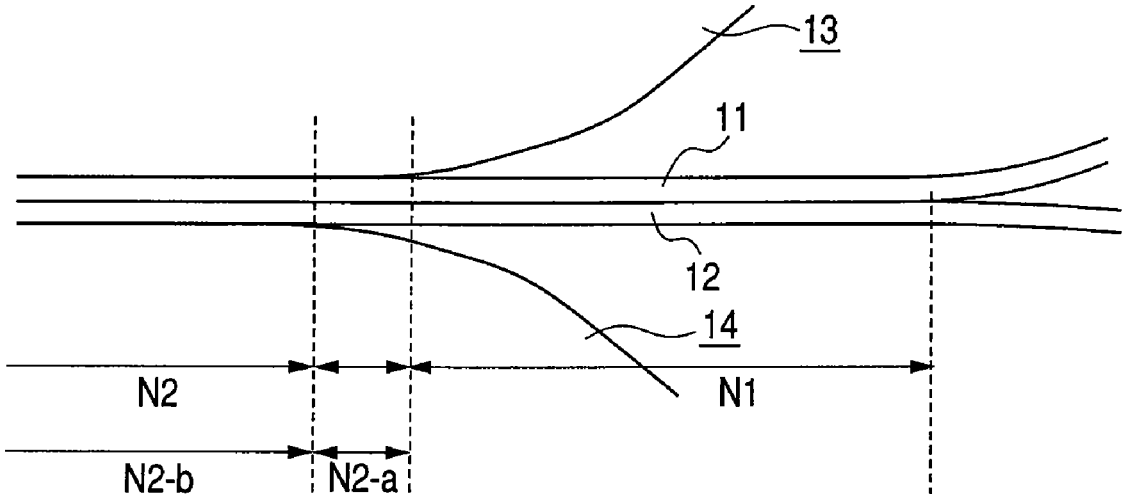
FIG. 22 is an explanatory view illustrating another contact state of the fixing belt and the pressure belt of the fixing device of Embodiment 1.

If the fixing belt 11 and the pressure belt 12 are in a contact state, as illustrated, for example, in FIG. 22, it is possible to obtain the same effects.

FIG. 22 is an explanatory view illustrating another contact state of the fixing belt 11 and the pressure belt 12 of the fixing device 112 according to this embodiment, and illustrates a contact state of the fixing belt 11 and the pressure belt 12 in the total nip. In FIG. 22, there is used as the pressure roller 14 an elastic roller of an outer diameter of ø28 mm and an asker C hardness (under a load of 9.8 N) of 40°. As the fixing roller 13, there is used an elastic roller of an outer diameter of ø36 mm and an asker C hardness (under a load of 9.8 N) of 40°.

In this case, the outer diameter of the fixing roller 13 is larger than the outer diameter of the pressure roller 14, and hence the length by which the fixing roller 13 backs up the fixing belt 11 while in contact with the inner surface thereof is slightly larger than the length by which the pressure roller 14 backs up the pressure belt 12.

As a result, an intermediate nip portion N2-*a* is formed after the pre-nip portion N1 formed through contact between the fixing belt 11 and the pressure belt 12 without any backup of the fixing roller 13 and the pressure roller 14. The intermediate nip portion N2-*a* is formed through contact between the region of the pressure belt 12 not backed up by the pressure roller 14 from the back side and the region of the fixing belt 11 backed up by the fixing roller 13 from the back side. The region of the pressure belt 12 not backed up by the pressure roller 14 from the back side is formed through relaxing of the belt, and hence the intermediate nip portion N2-*a* also corresponds to the first nip region.

Further, subsequently, there is formed a main nip portion (second nip region) N2-1 where the region of the pressure belt 12 backed up by the pressure roller 14 from the back side and the region of the fixing belt 11 backed up by the fixing roller 13 from the back side are in contact with each other. Thus, in the region of the pressure nip portion N2, there is provided the main nip portion N2-*b* as a portion formed by the endless belt regions backed up by the fixing roller 13 and the pressure roller 14, which are pressure members, that is, by the regions of the fixing belt 11 and the pressure belt 14. That is, as the pressure nip portion N2 formed subsequent to the pre-nip portion N1, there are formed the intermediate nip portion N2-*a* and the main nip portion N2-*b*.

In this case, there exist, from the upstream side with respect to the recording material conveyance direction, the pre-nip portion N1 formed through contact between the belts 11•12 with no backup, and then the intermediate nip portion N2-*a* formed through contact between the fixing belt 11 with backup and the pressure belt 12 with no backup. Further, subsequent to the intermediate nip N2-*a*, there is formed the pressure nip portion N2-*b* through contact between the belts 11•12 backed up by the rollers 13•14 so as to be continuous with the intermediate nip N2-*a*.

Another contact state of the fixing belt 11 and the pressure belt 12 over the entire nip region illustrated in FIG. 22 is also applicable to the fixing devices 112 illustrated in FIGS. 23, 24, 25, and 26.

In this contact state also, in the fixing device 112 according to this embodiment, the pre-nip portion N1 is formed through contact between the belts 11•12 with no backup. As a result, it is possible to sufficiently pre-heat the recording paper P bearing the toner image T to attain a state in which the difference in temperature between the upper layer of the toner image T and the lower layer of the toner image T is small. That is, it is possible to attain a toner melting state that is substantially uniform in the thickness direction of the toner image T. Further, after the toner melting state has been attained, pressurization is effected in the pressure nip portion N2, thereby causing the melted toner to appropriately permeate into the paper to undergo fixing. That is, it is essential that the recording paper P bearing the toner image T should be sufficiently pre-heated in the pre-nip portion N1 to place the toner in the melted state, causing the toner melted by the pressure nip portion N2 to appropriately permeate into the paper to effect fixing, and hence it is possible to obtain completely the same effect as that illustrated in FIG. 9.

That is, it is possible to realize a large nip width adaptable to high speed, and, at the same time, to realize a fixed image free from pressure-absence causing image abnormality such as misregistration of an image and having sufficient gloss.

In the case described above, the intermediate nip portion N2-*a* is formed through contact between the region of the pressure belt 12 not backed up by the pressure roller 14 from the back side and the region of the fixing belt 11 backed up by the fixing roller 13 from the back side.

In the case in which, contrary to the above-mentioned case, the intermediate nip portion is formed through contact between the region of the pressure belt 12 backed up by the pressure roller 14 from the back side and the region of the fixing belt 11 not backed up by the fixing roller 13 from the back side, the formation of the pre-nip portion N1 suffices. Also in this fixing unit construction, the effect obtained is substantially the same.

On the other hand, there is a contact state as illustrated in FIG. 22, in which there is the pre-nip portion N1 formed through contact between the belts 11•12 with no backup, and then the intermediate nip portion N2-*a* formed through contact between the belt 11 with backup and the belt 12 with no backup. Further, subsequent to the intermediate nip portion N2-*a*, there is provided the main nip portion N2-*b* formed through contact between the belts 11•12 backed up by the rollers 13•14 so as to be continuous with the intermediate nip portion N2-*a*. Examples of such a construction include the following cases:

A case in which there is a difference in outer diameter between the fixing roller 13 and the pressure roller 14;

A case in which there is a difference in hardness between the fixing roller 13 and the pressure roller 14;

A case in which there is a difference in outer diameter between the fixing belt 11 and the pressure belt 12;

A case in which there is a difference in layer construction between the fixing belt 11 and the pressure belt 12, with the belts differing in rigidity; and A case in which the outer diameters and arrangement of the tension roller 17 and the heat roller 16 are different from those according to this embodiment.

In all of the above-mentioned cases, it is essential that the pre-nip portion N1 should be formed through contact between the belts 11•12 with no backup, and hence it is possible to obtain the same effect as described above.

For example, also in the case in which there are used the fixing belt unit U1 with the fixing belt 11 as illustrated in FIG. 6A being looped, and the pressure belt unit U2 with the pressure belt 12 illustrated in FIG. 7B being relaxed, there is formed a region where the belts 11•12 overlap each other. Thus, the belts 11•12 are elastically held in contact with each other, forming the pre-nip portion N1.

That is, there is provided in the total nip the pre-nip portion N1 as the nip portion, which is a "relaxed contact portion"

formed by forming a relaxed portion in at least one belt of the two endless belts, i.e., the fixing belt 11 and the pressure belt 12, with the relaxed portion being held in contact with the other belt. Further, the pre-nip portion N1 is formed on the most upstream side with respect to the recording material conveyance direction of the total nip.

This also applies to the case in which, conversely, the fixing belt unit U1 with the fixing belt 11 illustrated in FIG. 6B being relaxed, and the pressure belt unit U2 with the pressure belt 12 illustrated in FIG. 7A being looped, are combined with each other. In this case, of the fixing belt 11 and the pressure belt 12, the fixing belt 11 opposed to the toner image bearing surface on the recording material has a relaxed portion.

Further, the same effect can be obtained also in the case in which there is a slight curvature over the entire contact region of the belts 11•12.

Figure 23:
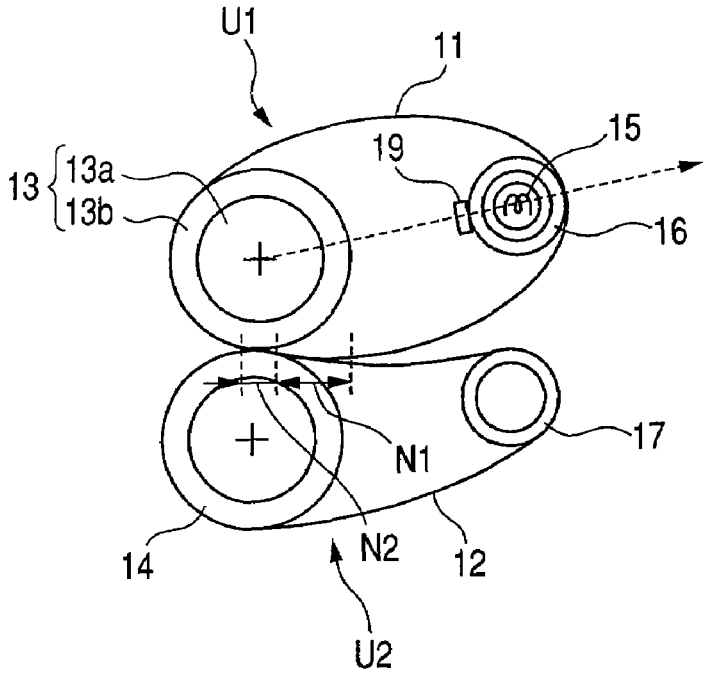
FIG. 23 is a schematic sectional view of another belt form of the fixing device of Embodiment 1.

For example, the fixing belt unit U1 illustrated in FIG. 6B with the fixing belt 11 being relaxed, and the belt unit U2 illustrated in FIG. 23 with the pressure belt 12 being relaxed so as to be concave in the same direction, are closely installed so as to be urged toward each other. Further, the same effect can be obtained when the pre-nip portion N1 is formed through contact between the belts 11•12 with no backup.

While in the fixing device according to this embodiment, the halogen heater 15 is used as the heat source, and the heater 15 is arranged within the heat roller 16 of the fixing belt unit U1 to heat the fixing belt 11, the arrangement of the heater 15 is not restricted to the one described above. For example, it is also possible to arrange the heater 15 at the position of the fixing roller 13. Further, no problem is involved if the heater 15 is provided within a plurality of rollers (not shown) around which the fixing belt 11 is wrapped.

Embodiment 2

Another example of the fixing device is described.

The members and portions that are the same as those of the fixing device 112 of Embodiment 1 are indicated by the same reference symbols, and a redundant description thereof is omitted. This also applies to Embodiments 3 through 5.

Figure 24:
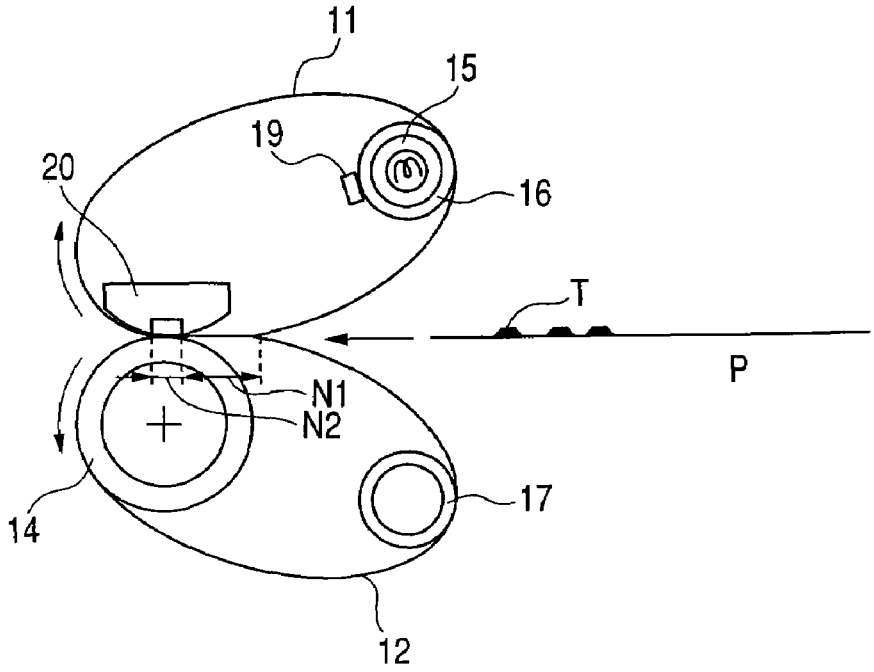
FIG. 24 is a schematic sectional view of an example of a fixing device according to Embodiment 2.

FIG. 24 is a schematic cross-sectional view of an example of a fixing device according to this embodiment.

A fixing device 113 according to this embodiment is of the same construction as the fixing device 112 of Embodiment 1 except that, instead of the rotatable fixing roller 13 of the fixing device 112 of Embodiment 1, there is used a stationary member (pressure member) 20 elongated in the longitudinal direction (direction perpendicular to the recording material conveyance direction).

The fixing roller 13 of the fixing device 112 of Embodiment 1 rotates while in contact with the fixing belt 11, whereas the stationary member 20 of the fixing device 112 according to this embodiment slides with the fixing belt 11. As a result, in the fixing device 112 according to this embodiment, it is possible to achieve a reduction in heat capacity, and to shorten the spin-up time of the fixing unit.

In this way, if the fixing roller 13 of the fixing device 112 of Embodiment 1 is replaced by the stationary member 20, it is possible to obtain the same effect as long as the pre-nip portion N1 formed solely by the elasticity of the belts is formed on the upstream side of the pressure nip portion N2 with respect to the recording material conveyance direction.

Further, use of the stationary member 20 is not restricted to the portion of the fixing device 112 of Embodiment 1 corresponding to the fixing roller 13. No problem is involved if the other roller supporting the belt is changed to a stationary member, and it is possible to obtain the same effect as that of the fixing device 112 of Embodiment 1.

Embodiment 3

Another example of the fixing device is described.

Figure 25:
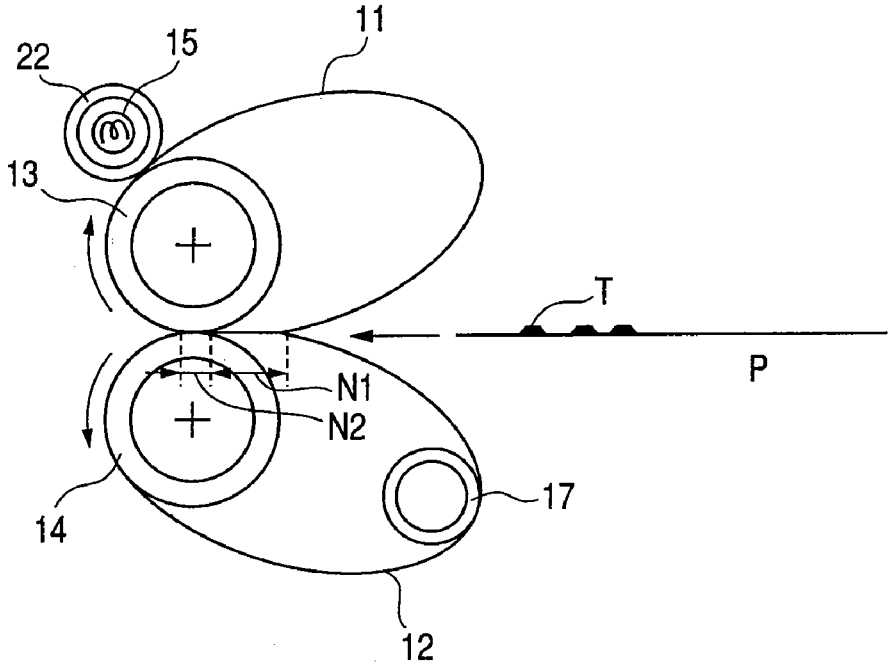
FIG. 25 is a schematic sectional view of an example of a fixing device according to Embodiment 3.

FIG. 25 is a schematic cross-sectional view of an example of a fixing device according to this embodiment.

In the fixing device 112 according to this embodiment, the heat roller 16 is abolished in the fixing device 112 of Embodiment 1. Instead, a heat roller 22 containing the halogen heater 15 as the heat source is arranged so as to be in contact with the outer peripheral surface of the fixing roller 13.

The heat roller 22 is held in contact with the outer peripheral surface (surface) of the fixing belt 11 in direct contact with the recording material P bearing the toner image T, and hence there is provided a releasing layer on the outer peripheral surface (surface) of the heat roller 22. Further, at the position where it is held in contact with the surface of the fixing belt 11, the heat roller 22 brings the inner peripheral surface of the fixing belt 11 into contact with the surface of the fixing roller 13. As a result, the running path of the fixing belt 11 is regulated, and the running of the fixing belt 11 is stabilized.

In this way, also by arranging on the outer peripheral surface of the fixing roller 13 the heat roller 22 for heating the fixing belt 11 and regulating the running path of the fixing belt 11, it is possible to form the pre-nip portion N1 solely by the elasticity of the belts 11•12 as in the case of the fixing device of Embodiment 1. Further, since the pre-nip portion is formed on the upstream side of the pressure nip portion with respect to the recording material conveyance direction, it is possible to obtain the same effect as that of the fixing device 112 of Embodiment 1.

Embodiment 4

Another example of the fixing device is described.

Figure 26:
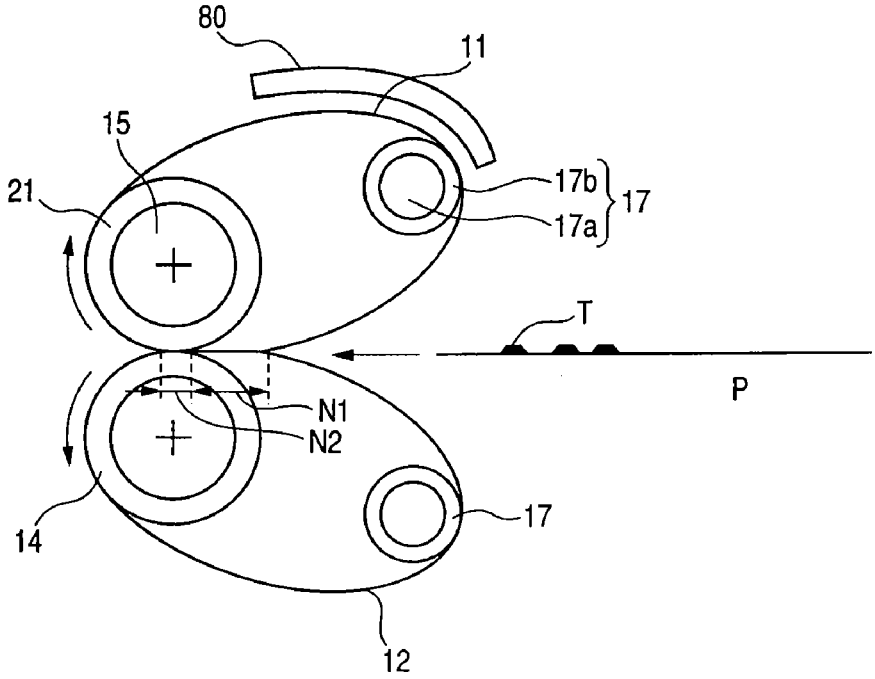
FIG. 26 is a schematic sectional view of an example of a fixing device according to Embodiment 4.

FIG. 26 is a schematic cross-sectional view of an example of a fixing device according to this embodiment.

In the fixing device 112 according to this embodiment, an induction heating type heating means is adopted in the fixing device 112 of Embodiment 1.

That is, the heat roller 16 of the fixing device 112 of Embodiment 1 is replaced by an upper tension roller 17 formed by providing an elastic layer 17*b* formed of a silicone sponge rubber layer of a thickness of 4 mm in the outer periphery of a core 17*a* of SUS (stainless steel) having a diameter of ø10 mm. Further, an electromagnetic induction heating portion 80 as a magnetic flux generating means is arranged along the outer peripheral surface of the fixing belt 11. Except for the above-mentioned two points, it is of the same construction as the fixing device 112 of Embodiment 1.

Like the heat roller 16 of the fixing device 112 of Embodiment 1, the upper tension roller 17 is rotatably supported by a third frame 35L•35R.

Although not shown, the electromagnetic induction heating portion 80 is provided with an induction heating portion casing formed of an electrically insulating resin, and a magnetic body core (hereinafter simply referred to as core) and an induction heating coil (hereinafter simply referred to as coil) that are contained in the induction heating portion casing. The core is formed, for example, by a ferrite core or a laminate core. The coil is formed, for example, by winding a plurality of turns a copper wire having on its surface a fusion layer and an insulating layer.

The electromagnetic induction heating portion 80 is a horizontally elongated, thin-plate-like member including an induction heating portion casing which is formed of an electrically insulating resin and contains a coil formed by spirally winding, for example, a Litz wire, into a horizontally elongated flat sheet and a core covering this coil. Within the induction heating portion casing, the core is arranged so as to prevent leakage of magnetic flux out of the surface of the region opposed to the fixing belt 11. The electromagnetic induction heating portion 80 is arranged close to the outer peripheral surface of the fixing belt 11 at a predetermined distance therefrom.

In the induction heating system, fluctuation in heat generation amount is likely to occur depending on the distance between the electromagnetic induction heating portion generating a magnetic flux and the heated body absorbing the magnetic flux to generate heat. In view of this, the electromagnetic induction heating portion 80 is fixed to the third frame 35L•35R supporting the upper tension roller 17, whereby the distance from the outer peripheral surface of the upper tension roller 17 to the electromagnetic induction heating portion 80 does not fluctuate. At the same time, the portion where the fixing belt 11 wrapped around the upper tension roller 17 is in contact with the upper tension roller 17 overlaps the region where heat generation occurs due to the generated magnetic flux from the electromagnetic induction heating portion 80.

In the fixing device 112 according to this embodiment, during fixing operation, an alternating current of 10 k to 1 MHz is caused to flow through the coil from an excitation circuit (not shown), thereby induction-heating a base layer 11*a* of the fixing belt 11 formed of metal. That is, by energizing the coil, there is generated a magnetic flux to be supplied to the fixing belt 11. In the region where the electromagnetic induction heating portion 80 and the fixing belt 11 are opposed to each other, this magnetic flux is absorbed by the base layer 11*a*, which is the heat generating layer of the fixing belt 11, and an eddy induction current is generated in the base layer 11*a*, with the base layer 11*a* generating heat due to its specific resistance.

When, as in this embodiment, an induction heating type heating means is adopted, the pre-nip portion N1 formed solely by the elasticity of the belts 11•12 is formed on the upstream side of the pressure nip portion N2 with respect to the recording material conveyance direction, and hence it is possible to obtain the same effect as that of the fixing device 112 of Embodiment 1.

<Others>

1) The layer construction, thickness, outer diameter, etc. of the members such as the fixing belt 11, the pressure belt 12, the fixing roller 13, the pressure roller 14, the heat roller 15, and the tension roller 17 are not restricted to those according to this embodiment but are set as appropriate according to the fixing device actually produced.

2) The supply of heat to the surface of the fixing belt 11 may be effected by heating through radiation or heating with hot air or by induction heating in the case of a belt base layer formed of metal.

3) Also regarding the construction of the fixing roller 13 and the pressure roller 14, they naturally allow changing of the width of the pressure nip portion N1 through appropriate changing of their outer diameter, core diameter, elastic layer material, thickness, etc. according to the requirements of the specifications of the fixing device actually produced.

Embodiment 5

Next, an image heating apparatus according to an embodiment capable of effecting satisfactory image heating regardless of the kind of recording material is described.

In the following description, regarding the fixing device or the members constituting the fixing device, the term longitudinal direction refers to a direction orthogonal to the recording material conveyance direction on the surface of the recording material. The term lateral direction refers to a direction parallel to the recording material conveyance direction on the surface of the recording material. The width refers to the dimension in the lateral direction.

Figure 28:
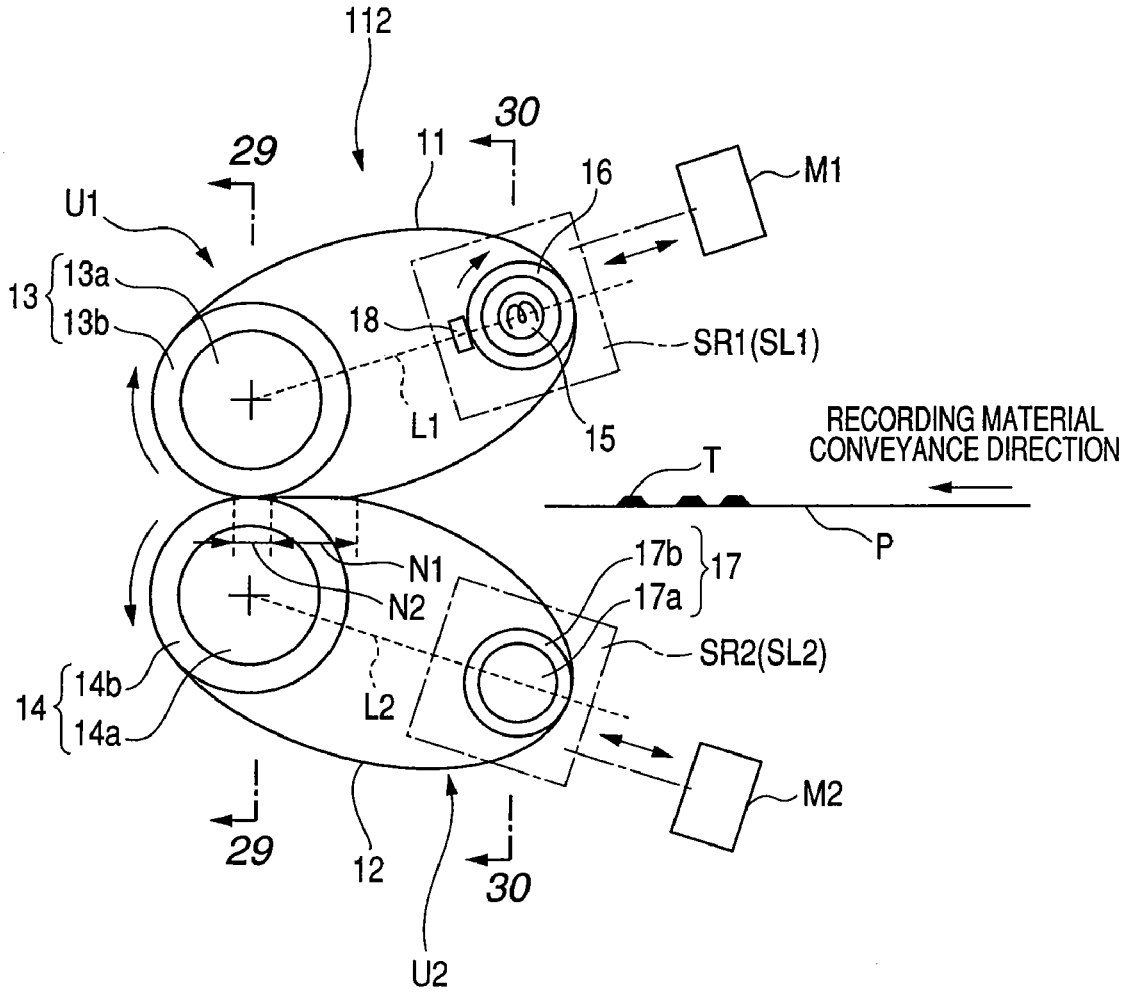
FIG. 28 is a schematic cross-sectional view of an example of a fixing device according to Embodiment 5.
Figure 29:
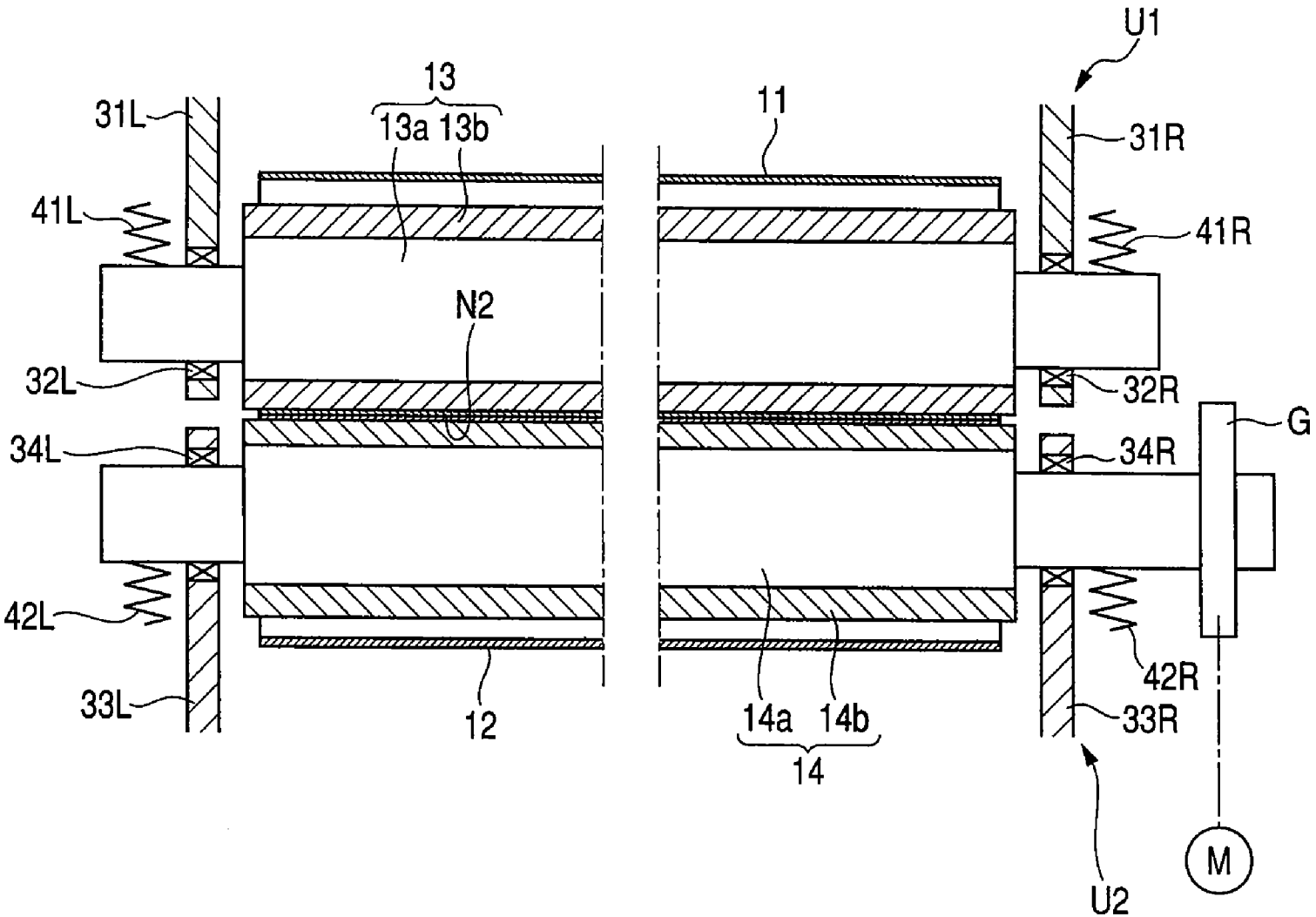
FIG. 29 is a sectional view of the fixing device of FIG. 28 taken along the arrow line 29-29.
Figure 30:
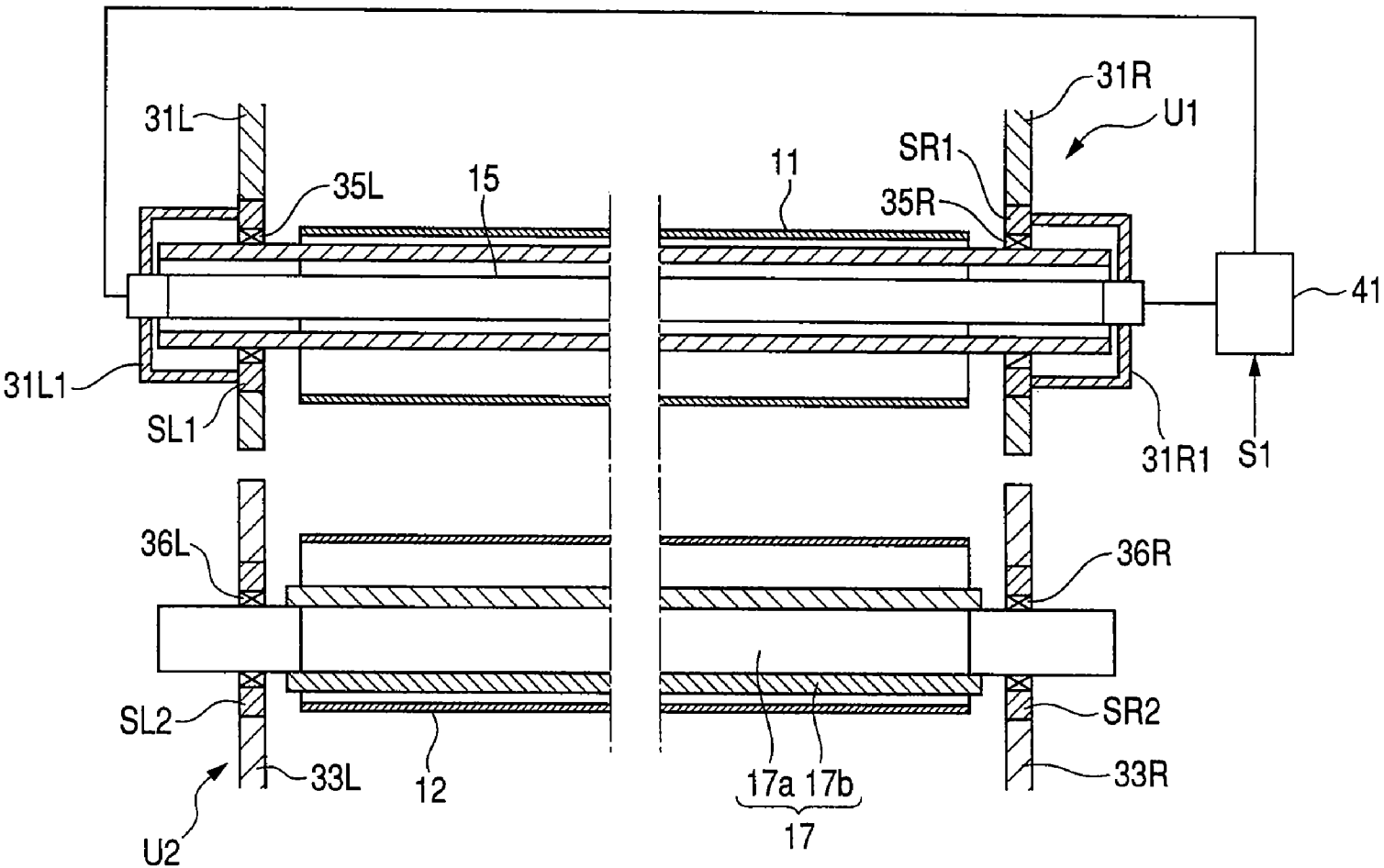
FIG. 30 is a sectional view of the fixing device of FIG. 28 taken along the arrow line 30-30.

FIG. 28 is a schematic cross-sectional view of an example of the fixing device 112. FIG. 29 is a sectional view of the fixing device 112 taken along the arrow line 29-29 of FIG. 28. FIG. 30 is a sectional view of the fixing device 112 taken along the arrow line 30-30 of FIG. 28.

The fixing device 112 according to this embodiment has a fixing belt 11 as an endless belt, a pressure belt 12, a fixing roller 13 as a pressure member, a pressure roller 14, a heat roller 16 as a support member, and a tension roller 17. Further, the fixing device 112 has a halogen heater 15 as a heating means, and a temperature detection element 18 like a thermistor as a temperature detection means. Further, the fixing device 112 has a first frame 21L•21R and a second frame 22L•22R as support members. Further, a fixing belt unit U1 is formed by the fixing belt 11, the fixing roller 13, the heat roller 16, the heater 15, the temperature detection element 18, and the first frame 21L•21R. Further, a pressure belt unit U2 is formed by the pressure belt 12, the pressure roller 14, the tension roller 17, and the second frame 22L•22R.

The fixing device 112 according to this embodiment is constructed such that, in the fixing belt unit U1, the fixing roller 13 and the heat roller 16 are provided on the inner side of the fixing belt 11 arranged in the longitudinal direction of the fixing device 112, with the fixing belt 11 being supported by the fixing roller 13 and the heat roller 16. Further, in the pressure belt unit U2, the pressure roller 14 and the tension roller 17 are provided on the inner side of the pressure belt 12 arranged in the longitudinal direction of the fixing device 112, with the pressure belt 12 being supported by the pressure roller 14 and the tension roller 17.

The layer construction of the fixing belt 11 and the pressure belt 12 is described with reference to FIGS. 31A and 31B.

Figure 31A:
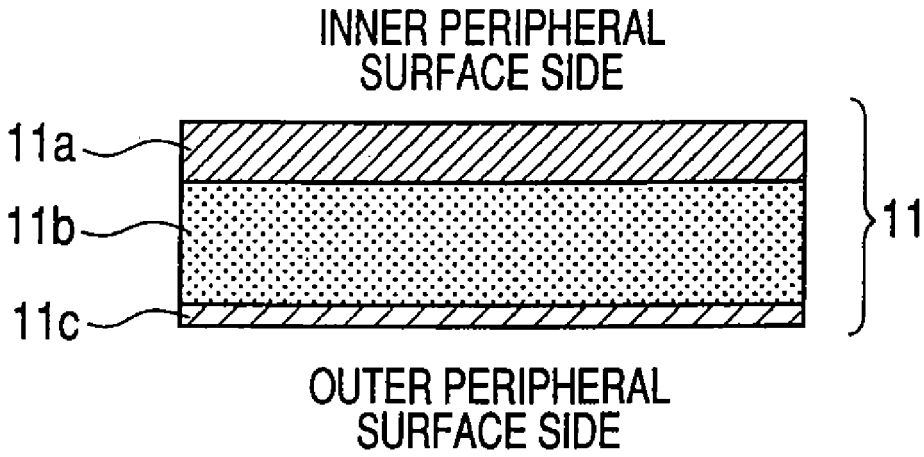
FIG. 31A is a sectional view of an example of the layer construction of the fixing belt.
Figure 31B:
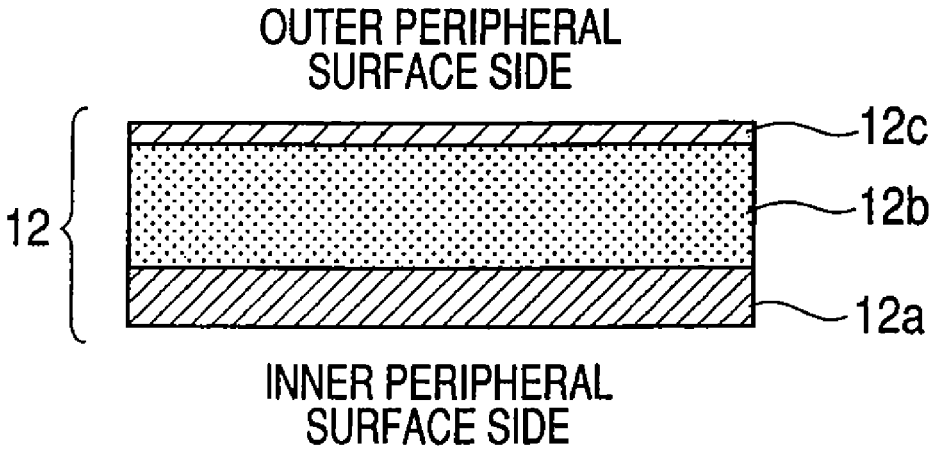
FIG. 31B is a sectional view of an example of the layer construction of the pressure belt.

FIG. 31A is a sectional view of an example of the layer construction of the fixing belt 11, and FIG. 31B is a sectional view of an example of the layer construction of the pressure belt 12.

The fixing belt 11 and the pressure belt 12 respectively have, on their inner side, endless base layers 11*a*•12*a*, and have, in the outer periphery of the base layers 11*a*•12*a*, elastic layers 11*b*•12*b*, and releasing layers 11*c*•12*c* in the outer periphery of the elastic layers 11*b*•12*b* (FIGS. 31A and 31B). The base layers 11*a*•12*a* are endless belts such as electrocast belts formed of a metal such as nickel or SUS or belts formed of heat resistant resin such as polyimide. The thickness of the base layers 11*a*•12*a* is approximately 50 to 150 micromillimeters in the case of metal electrocast belts, and approximately 50 to 300 micromillimeters in the case of heat resistant resin. It is desirable for the belts themselves to have appropriate rigidity and flexibility. The elastic layers 11*b*•12*b* are silicone rubber layers formed on the base layers 11*a*•12*a* and having a thickness of approximately 50 to 300 micromillimeters. The releasing layers 11*c*•12*c* are resin layers which are formed on the elastic layers 11*b*•12*b*, are formed of a fluorine type resin such as PFA or PTFE and have a thickness of approximately 10 to 50 micromillimeters. The elastic layers 11*b*•12*b* are formed on the elastic layers 11*b*•12*b* through tube covering, coating or the like.

In this embodiment, belts of the following construction are adopted as the fixing belt 11 and the pressure belt 12. That is, endless belts formed of nickels layers of a thickness of 75 μm are used as the base layers 11*a*•12*a*, and silicone rubber layers of a thickness of 300 μm are formed as the elastic layers 11*b*•12*b* in the outer periphery of the base layers 11*a*•12*a*. Further, the elastic layers 11*b*•12*b* are covered with PFA tubes of a thickness of 50 μm as the releasing layers 11*b*•12*b*. Both the fixing belt 11 and the pressure belt 12 have an outer diameter of ø60 mm.

The fixing roller 13 and the pressure roller 14 are respectively formed as elastic rollers of an outer diameter of ø30 mm formed by providing, in the outer periphery of SUS cores 13*a*•14*a* of ø20, elastic layers 13*b*•14*b* formed of silicone sponge rubber layers of a thickness of 5 mm. The asker C hardness in this case is approximately 50° under a weight of 9.8 N (1 kgf). The outer diameter of the fixing roller 13 is smaller than the inner diameter of the fixing belt 11. Thus, the fixing belt 11 is loosely fitted onto the fixing roller 13. Further, the outer diameter of the pressure roller 14 is smaller than the inner diameter of the pressure belt 12. Thus, the pressure belt 12 is loosely fitted onto the pressure roller 14. The longitudinal dimension of the elastic layers 13*b*•14*b* of the fixing roller 13 and the pressure roller 14 is set to a dimension slightly larger than the longitudinal dimension of the fixing belt 11 and the pressure belt 12 (FIG. 29). Alternatively, the longitudinal dimension of the elastic layers 13*b*•14*b* of the fixing roller 13 and the pressure roller 14 may be set to be substantially the same as the longitudinal dimension of the fixing belt 11 and the pressure belt 12.

The fixing roller 13 has a core 13*a* whose end portions are rotatably supported by the first frame 31L•31R through the intermediation of bearings 32L•32R (FIG. 29). The pressure roller 14 is arranged below the fixing roller 13 so as to be parallel to the fixing roller 13, and both end portions of the core 13*a* are rotatably supported by the second frame 33L•33R through the intermediation of bearings 34L•34R.

Figure 32B:
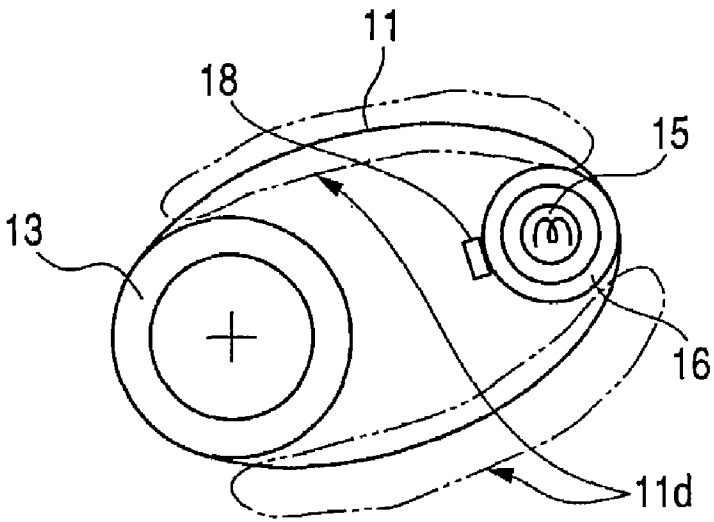
FIG. 32B is a diagram illustrating how the fixing belt is wrapped around the fixing roller and the heat roller in a route length somewhat larger than the minimum route length of the fixing belt.
Figure 32A:
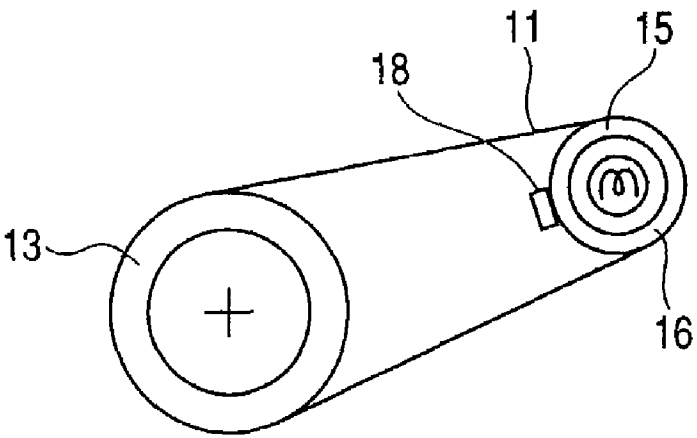
FIG. 32A is a diagram illustrating how the fixing belt is wrapped around the fixing roller and the heat roller in a minimum route length of the fixing belt.

FIGS. 32A and 32B are explanatory views illustrating the relationship between the fixing roller 13, the heat roller 16, and the fixing belt 11. FIG. 32A is a diagram illustrating a state in which the fixing belt 11 is wrapped around the fixing roller 13 and the heat roller 16 in the minimum route length thereof. FIG. 32B is a diagram illustrating a state in which the fixing belt 11 is wrapped around the fixing roller 13 and the heat roller 16 in a route length somewhat larger than the minimum route length thereof.

The heat roller 16 is an aluminum hollow cylindrical body having a thickness of 1 mm and an outer diameter of ø18 mm. The heat roller 16 is situated so as to cause the fixing belt 11 wrapped around the fixing roller 13 to stick out obliquely upwards from the fixing roller 13 to the upstream side with respect to the recording material conveyance direction. That is, the heat roller 16 is intentionally arranged at a position where the peripheral length of the fixing belt 11 when it is wrapped around the fixing roller 13 and the heat roller 16 is somewhat larger than the peripheral length of the minimum route length of the fixing belt 11. That is, instead of being wrapped around the fixing roller 13 and the heat roller 16 with tension as illustrated in FIG. 32A, the fixing belt 11 is wrapped loosely around the fixing roller 13 and the heat roller 16 in a relaxed state as illustrated in FIG. 32B. Thus, the fixing belt 11 has a relaxed portion 11*d* between the fixing roller 13 and the heat roller 16 in the peripheral direction of the fixing belt 11. Further, at that position, the heat roller 16 is supported by the first frame 31L•31R so as to be displaced along the virtual line L1 connecting the rotation center of the fixing roller 13 and the rotation center of the heat roller 16. That is, at both ends of the heat roller 16, there are provided the bearings 35L•35R (FIG. 30) rotatably supporting the heat roller 16. Further, both end portions of the heat roller 16 are supported, through the intermediation of the bearings 35L•35R, by sliders SL1•SR1 as moving members movably provided on the first frame 31L•31R so as to move toward and away from the fixing roller 13 along the virtual line L1.

Both end portion of the halogen heater 15 provided inside the heat roller 16 are supported by heater support portions 31L1•31R1 provided on the sliders SL1•SR1. The inner surface of the heat roller 16 is painted black so that the radiation heat from the halogen heater 15 can be easily absorbed.

The heat roller 16 is constructed such that a part of the outer peripheral surface (surface) of the heat roller 16 is held in contact with the inner peripheral surface (inner surface) of the fixing belt 11, and that the heat due to the halogen heater 15 is conducted from the contact region to the fixing belt 11 to heat the fixing belt 11. That is, the fixing belt 11 is heated by the halogen heater 15 via the heat roller 16. Further, through the contact region of the surface of the heat roller 16 held in contact with the inner surface of the fixing belt 11, a change in the traveling position in the longitudinal direction due to the running of the fixing belt 11 (inclination of the fixing belt 11) is restrained.

Figure 33B:
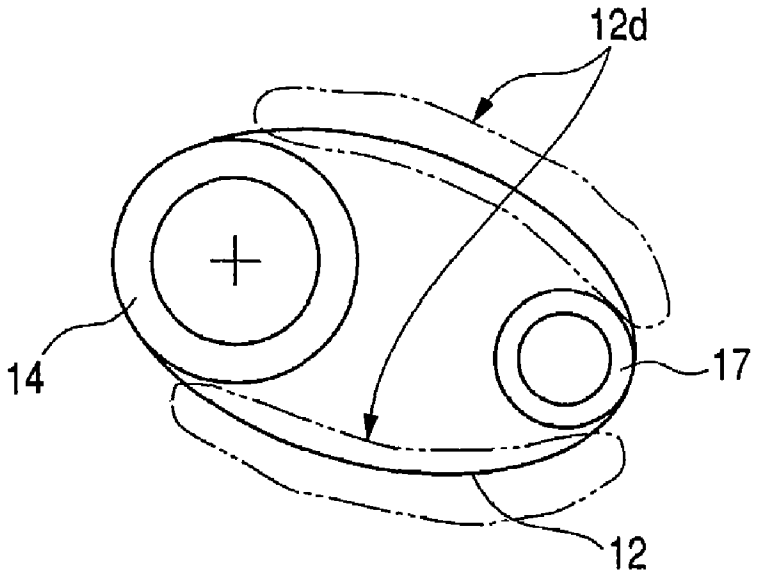
FIG. 33B is a diagram illustrating how the pressure belt is wrapped around the pressure roller and the tension roller in a route length somewhat larger than the minimum route length thereof.
Figure 33A:
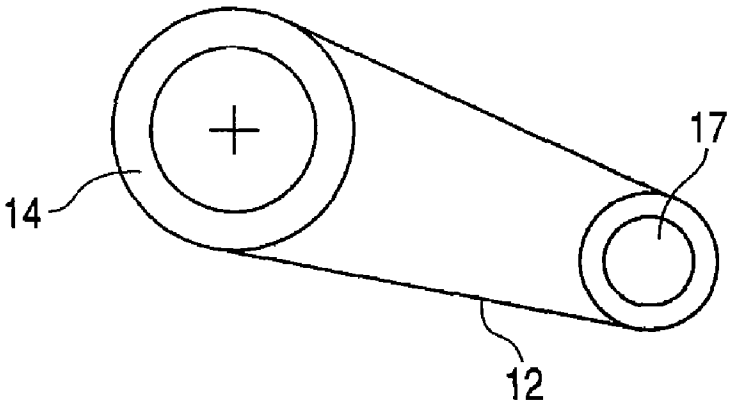
FIG. 33A is a diagram illustrating how the pressure belt is wrapped around the pressure roller and the tension roller in a minimum route length of the pressure belt.

FIGS. 33A and 33B are explanatory views illustrating the relationship between the pressure roller 14 and the tension roller 17 and the pressure belt 12. FIG. 33A is a diagram illustrating a state in which the pressure belt 12 is wrapped around the pressure roller 14 and the tension roller 17 in the minimum route length thereof. FIG. 33B is a diagram illustrating a state in which the pressure belt 12 is wrapped around the pressure roller 14 and the tension roller 17 in a route length somewhat larger than the minimum route length thereof.

The tension roller 17 is a roller having an outer diameter of ø18 mm, and has a core 17*a* formed of SUS and having a diameter of ø14 mm and an elastic layer 17*b* provided in the outer periphery thereof and formed of a silicone sponge rubber layer having a thickness of 2 mm. The longitudinal dimension of the elastic layer 17*b* is equal to the longitudinal dimension of the elastic layers 13*b*•14*b* of the fixing roller 13 and the pressure roller 14. The tension roller 17 is situated so as to cause the pressure belt 12 wrapped around the pressure roller 14 to stick out obliquely downwards from the pressure roller 14 to the upstream side with respect to the recording material conveyance direction. That is, the tension roller 17 is intentionally situated such that the peripheral length of the pressure belt 12 when the pressure belt 12 is wrapped around the pressure roller 14 and the tension roller 17 is somewhat larger than the minimum route length of the pressure belt 12 when the pressure belt 12 is wrapped around the pressure roller 14 and the tension roller 17. That is, the pressure belt 12 is not wrapped around the pressure roller 14 and the tension roller 17 with tension as illustrated in FIG. 33A, but is loosely wrapped around the pressure roller 14 and the tension roller 17 in a relaxed state as illustrated in FIG. 33B. Thus, the pressure belt 12 has a relaxed portion 12*d* in the circumferential direction thereof and between the pressure roller 14 and the tension roller 17. Further, at that position, the tension roller 17 is supported by the second frame 33L•33R so as to be displaced along the virtual line L2 connecting the rotation center of the pressure roller 14 and the rotation center of the tension roller 17. That is, at both ends of the tension roller 17, there are provided the bearings 36L•36R (FIG. 30) rotatably supporting the tension roller 17. Further, both end portions of the tension roller 17 are supported, through the intermediation of the bearings 36L•36R, by sliders SL2•SR2 as moving members movably provided on the second frame 33L•33R so as to move toward and away from the pressure roller 14 along the virtual line L2.

Further, through the contact region of the outer peripheral surface of the elastic layer 17*b* (the surface of the tension roller 17) held in contact with the inner peripheral surface (inner surface) of the pressure belt 12, a change in the traveling position in the longitudinal direction due to the running of the pressure belt 12 (inclination of the pressure belt 12) is restrained by the tension roller 17.

Next, the nip portion formed by the fixing belt 11 of the fixing belt unit U1 and the pressure belt 12 of the pressure belt unit U2 is described in detail.

In the fixing belt unit U1 and the pressure belt unit U2, pressure springs 41L•41R and 42L•42R as the pressure means are arranged on both the end portions of the core 13*a* of the fixing roller 13 and both end portions of the core 14*a* of the pressure roller 14 (FIG. 29). The fixing roller 13 and the pressure roller 14 are urged toward each other by the pressure springs 41L•41R and 42L•42R. In the fixing roller 13 and the pressure roller 14, the fixing belt 13 and the pressure belt 14 are held and pressurized by the respective elastic layers 13*b*•14*b*, whereby the outer peripheral surface (surface) of the fixing belt 13 and the outer peripheral surface (surface) of the pressure belt 14 are brought into contact with each other. As a result, the pressure nip portion N2 is formed as a nip portion through the surface of the fixing belt 13 and the surface of the pressure belt 14 (FIG. 28). In this embodiment, the total pressure of the pressurizing force applied to the fixing roller 13 and the pressure roller 14 by the pressure springs 41L•41R and 42L•42R is 196 N(20 kgf), thereby setting the width of the pressure nip portion N2 to 5 mm. That is, the fixing roller 13 and the pressure roller 14 as the pressure members hold the outer peripheral surfaces of the two endless belts, i.e., the fixing belt 13 and the pressure belt 14, in contact with each other to support the fixing belt 13 and the pressure belt 14 so as to form the pressure nip portion N2.

Figure 34:
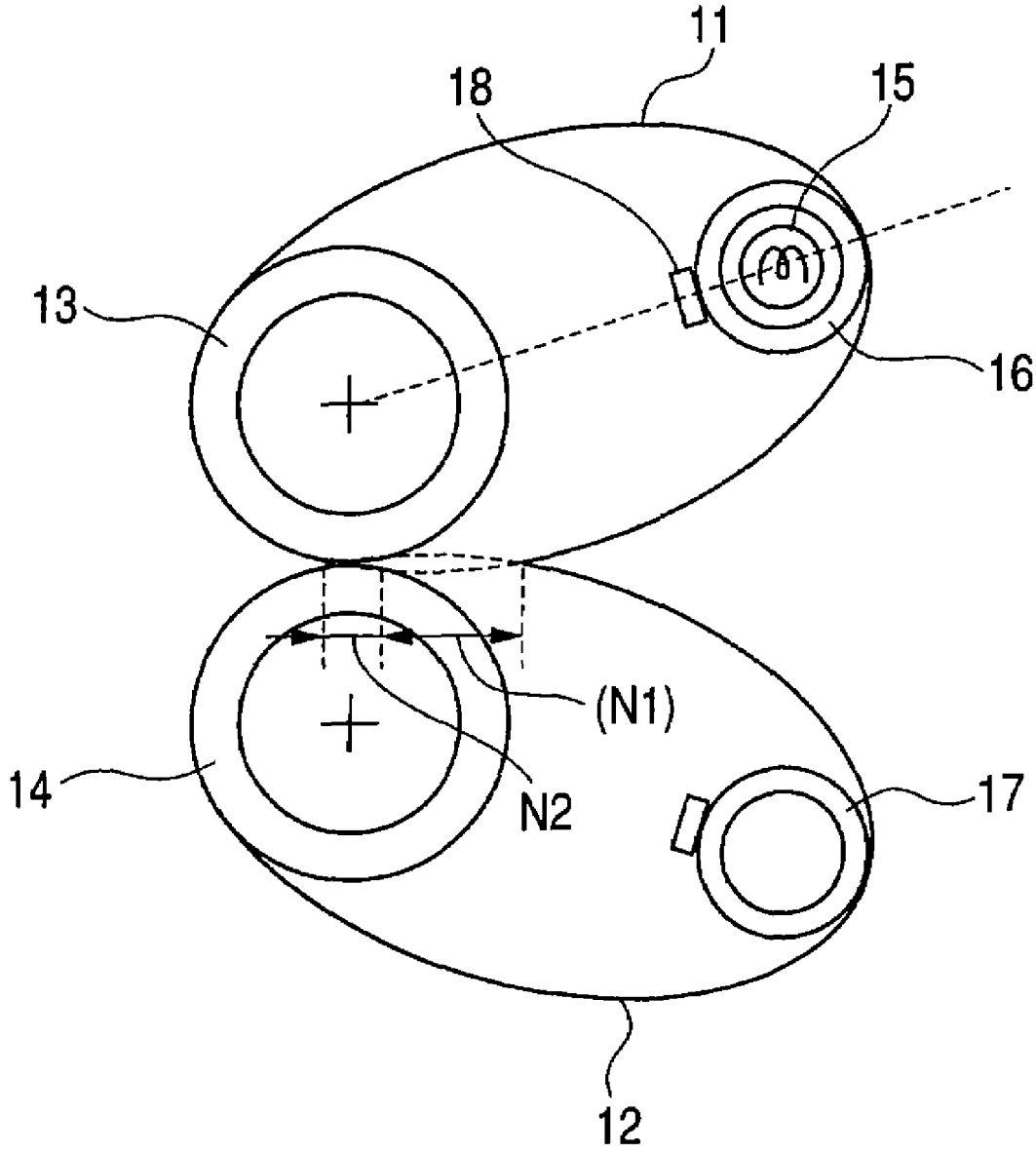
FIG. 34 is an explanatory view of a pre-nip portion formed by the respective relaxed portions of the fixing belt and the pressure belt when the pressure nip portion is formed.

FIG. 34 is an explanatory view of the pre-nip portion N1 serving as a first nip region formed by the relaxed portions 11*d*•12*d* of the fixing belt 11 and the pressure belt 12 when the pressure nip portion N2 is formed.

As described above, the fixing belt 11 and the pressure belt 12 have the relaxed portions 11*d*•12*d*. When the pressure nip portion N2 is formed by the fixing belt 11 and the pressure belt 12, from the upper end in the recording material conveyance direction of the pressure nip portion N2, there is generated in the relaxed portions 11*d*•12*d* of the fixing belt 11 and the pressure belt 12 a range where the relaxed portions 11*d*•12*d* overlap each other over a predetermined range (as indicated by the dashed line of FIG. 34). In the relaxed portions 11*d*•12*d*, the surface of the fixing belt 11 and the surface of the pressure belt 12 are brought into linear contact with each other in the overlapping range. As a result, the fixing belt 11 and the pressure belt 12 are deformed to an appropriate degree so as to maintain equilibrium in the peripheral direction. As a result, the pre-nip portion N1 is formed in the overlapping region (FIG. 28). Thus, the nip pressure in the pre-nip portion N1 is due to the elastic force of the fixing belt 11 and the pressure belt 12 causing the fixing belt 11 and the pressure belt 12 to be restored to the non-contact state illustrated in FIGS. 32B and 33B from the contact state illustrated in FIG. 1. That is, the nip pressure in the pre-nip portion N1 is due to the restoring force of the belts 11•12 tending to be restored to their configuration in the non-contact state depending upon the rigidity and flexibility of the base layers 11*a*•12*a* of the fixing belt 11 and the pressure belt 12. The width of the pre-nip portion N1 thus formed is approximately 15 mm. It is not necessary for the pre-nip portion N1 to be linear; it may also be curved in an arcuate form.

Figure 35:
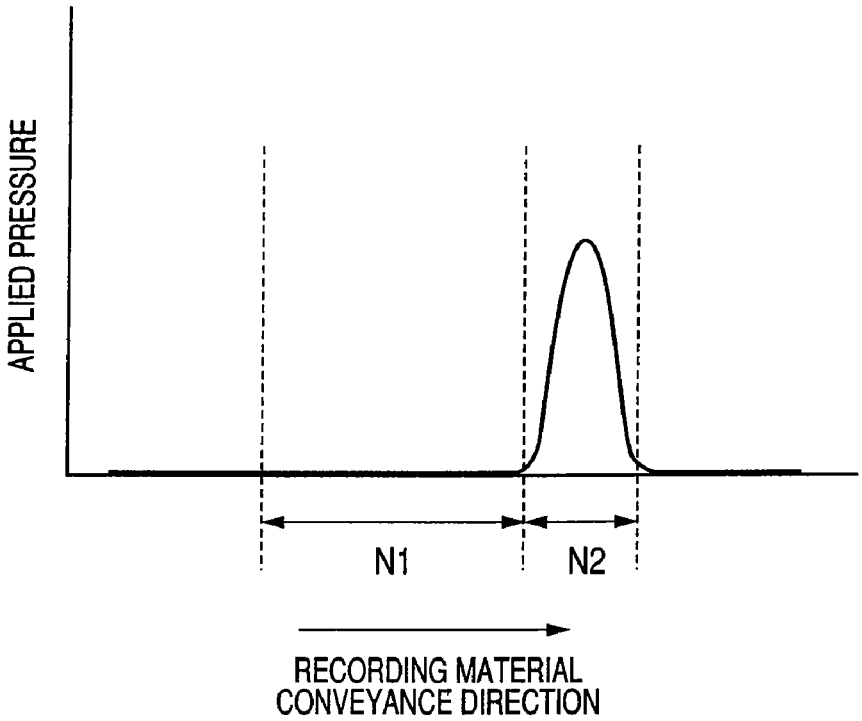
FIG. 35 is an explanatory view illustrating the pressure distribution in the pre-nip portion and the pressure nip portion.

The pressure distribution in the pre-nip portion N1 and the pressure nip portion N2 was measured by using the pressure distribution measuring system PINCH manufactured by Nitta Corporation. FIG. 35 illustrates the pressure distribution in the pre-nip portion N1 and the pressure nip portion N2.

As illustrated in FIG. 35, in the pressure nip portion N2, the surface of the fixing belt 11 and the surface of the pressure belt 12 are held in contact with each other in a pressurized state by the fixing roller 13 and the pressure roller 14, and hence the pressurizing force is at its peak at the contact position between the surface of the fixing belt 11 and the surface of the pressure belt 12. In contrast, in the pre-nip portion N1, the surface of the fixing belt 11 and the surface of the pressure belt 12 are held in contact with each other solely by the elastic force (restoring force) of the fixing belt 11 and the pressure belt 12, and hence the pressurizing force is considerably smaller as compared with the pressurizing force at the pressure nip portion N2. Further, in the pre-nip portion N1, the fixing belt 11 and the pressure belt 12, which are provided with rigid endless belts as the base layers 11*a*•12*a* are held in contact with each other, and hence a uniform pressure distribution is attained.

Heat Fixing Operation of the Fixing Device

A drive gear (FIG. 29) provided at an end of the core 14*a* of the pressure roller 14 is rotated by a fixing motor M, whereby the pressure roller 14 is rotated at a predetermined peripheral speed in the direction of the arrow (FIG. 28). When the pressure roller 14 rotates, the rotation of the pressure roller 14 is transmitted to the pressure belt 12 at the pressure nip portion N2, and the pressure belt 12 moves around the pressure roller 14 and the tension roller 17 in the direction of the arrow as the pressure roller 14 rotates. The rotation of the pressure belt 12 is transmitted to the tension roller 17, and the tension roller 17 is driven to rotate in the direction of the arrow as the pressure belt 12 runs. Further, at the pressure nip portion N2, the rotation of the pressure belt 12 is transmitted to the surface of the fixing belt 11, and the fixing belt 11 moves around the fixing roller 13 and the heat roller 16 in the direction of the arrow at the same peripheral speed as the pressure belt 12 as the pressure belt 12 runs. The running of the fixing belt 11 is transmitted to the heat roller 16, and the heat roller 16 is driven to rotate in the direction of the arrow as the fixing belt 11 runs. In this embodiment, the running speed (traveling speed) of the pressure belt 12 and the fixing belt 11 is 200 mm/s.

Also in the case in which, as in this embodiment, the fixing belt 11 and the pressure belt 12 are intentionally relaxed (FIGS. 32B and 32B), the base layers 11*a*•12*a* of the fixing belt 11 and the pressure belt 12 have rigidity and flexibility, and hence the fixing belt 11 and the pressure belt 12 run while maintaining the relaxed state. Thus, as compared with the case in which the fixing belt 11 and the pressure belt 12 run in a tense state (FIGS. 32A and 33A), the fixing belt 11 and the pressure belt 12 do not easily involve generation of undulation in the belts themselves. Thus, it is advantageously possible to bring the surface of the fixing belt 11 into uniform contact with the surface of the recording material P bearing the unfixed toner image T. Thus, image disturbance or the like is not easily generated in the unfixed toner image T on the recording material P.

Figure 36A:
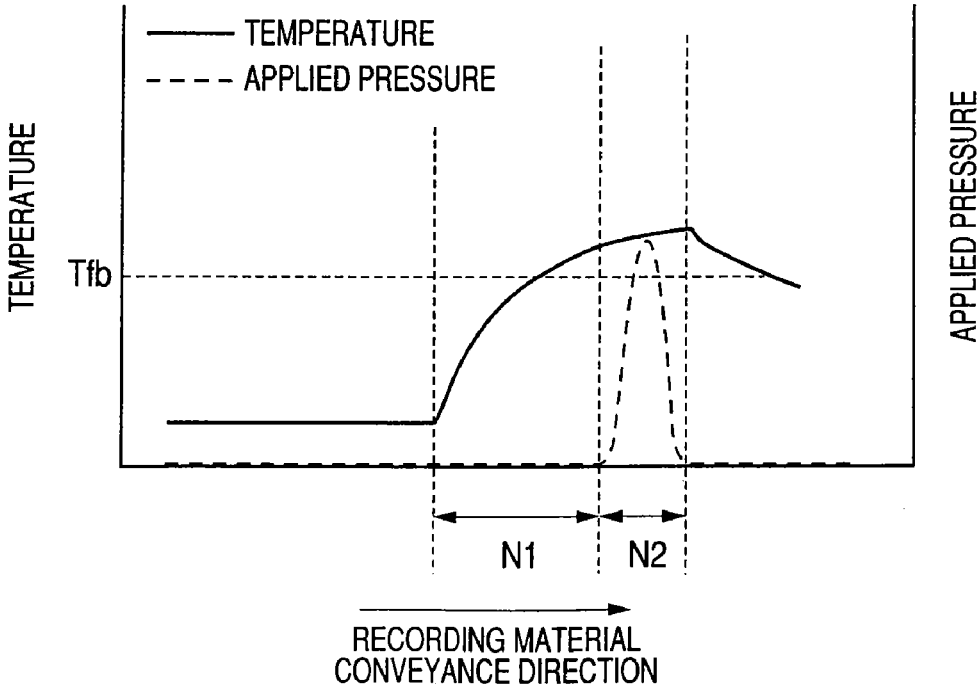
FIG. 36A is an explanatory view illustrating changes in temperature and pressure distribution on the recording paper sheet in the pre-nip portion and the pressure nip portion in the heat fixing process when in an ordinary paper mode.

Before and after or simultaneously with the rotation of the pressure roller 14, the heater 15 is energized by the energization control portion 41 (FIG. 30) as an energization control means. As a result, the heater 15 generates heat, and the rotating heat roller 16 is heated by the heater 15, with the running fixing belt 11 being heated by the heat roller 16. The heat of the fixing belt 11 is conducted to the running pressure belt 12 via the pressure nip portion N2 and the pre-nip portion N1, thereby heating the pressure belt 12. The temperature of the heat roller 16 is detected by a temperature detection element 18 (FIG. 28), and, based on an output signal S1 from the temperature detection element 18, the energization control portion 41 controls the power supplied to the heater 15 to perform temperature control on the heater 15. That is, the energization control portion 41 controls the energization to the heater 15 based on the output signal S1 from the temperature detection element 18 such that there can be maintained a predetermined set temperature (target temperature) for heating the unfixed toner image T at the pre-nip portion N1 to a temperature higher than the outflow start temperature Tfb (FIG. 36A).

In the fixing roller 13, the pressure roller 14, and the tension roller 17, the elastic layers 13*b*•14*b*•17*b* are formed of silicone sponge rubber layers having heat insulating property. Thus, it is possible to reduce the requisite heat capacity of the above-mentioned members 13•14•17 for heating the fixing belt 11 and the pressure belt 12 for heat-fixing the unfixed toner image T to the recording material P. Thus, in the image forming apparatus A in which the fixing device 112 according to this embodiment is mounted, it is possible to shorten the requisite time for the first image to be output after the input of a printer command (first print out time: FPOT). That is, it is possible to shorten the warming-up time. Further, in the fixing device 112 according to this embodiment, it is possible to reduce the power consumption during the standby time in which a printer command is waited for.

In the state in which the running of the pressure belt 12 and the fixing belt 11 and the energization to the heater 15 are being effected, the recording material P bearing the unfixed toner image T is introduced to the pre-nip portion N1, with the toner image bearing surface facing upwards. In the pre-nip portion N1, the recording material P is held weakly and uniformly by the fixing belt 11 and the pressure belt 12 due to the elasticity (restoring force) of the fixing belt 11 and the pressure belt 12, and is conveyed in this condition. At the same time, due to the pre-heating of the fixing belt 11 and the pressure belt 12, the recording material P is pre-heated from both the toner image bearing surface on the fixing belt 11 side and the toner image non-bearing surface on the pressure belt 12 side. In this way, the recording material P is held between the surface of the fixing belt 11 and the surface of the pressure belt 12 due to the elasticity of the fixing belt 11 and the pressure belt 12, and hence the entire surface of the recording material P is pressurized weakly and uniformly, and pre-heated uniformly.

The unfixed toner image T borne by the recording material P is sufficiently heated at the pre-nip portion N1 to a temperature higher than the outflow start temperature Tfb, and continues to be pressurized while being pinched and conveyed by the surface of the fixing belt 11 and the surface of the pressure belt 12 at the pressure nip portion N2.

Displacement Control of the Heat Roller 16 and the Tension Roller 17

When various types of paper differing in thickness such as thin paper, ordinary paper, and thick paper are used as the recording material P, the fixing device 112 according to this embodiment can change the nip width of the nip portion N1 in the recording material conveyance direction according to the kind of recording paper. That is, it has a mechanism for changing the length in the recording material conveyance direction of the first nip region. In the following, displacement control for the heat roller 16 and the tension roller 17 for changing the width of the pre-nip portion N1 is described.

A predetermined drive mechanism M1 as a drive means is connected to sliders SL1•SR1 supporting the heat roller 16, and a predetermined drive mechanism M2 as a drive means is connected to sliders SL2•SR2 supporting the tension roller 17. The drive mechanisms M1•M2 are drive-controlled by a microprocessor unit (MPU) as a control means for performing control over the entire image forming apparatus A.

When performing image formation based on a print signal output from an operation panel of the image forming apparatus A or a personal computer, the MPU obtains the basic weight of the designated recording material P based on a designation signal for the recording material P corresponding to the print signal. That is, based on the designation signal for the recording material P, it obtains the basic weight of the recording material P corresponding to the kind of designated recording material P by using a predetermined table or the like. Further, based on the basic weight, the MPU executes a mode for performing image formation on the designated recording material P. For example, when ordinary paper is designated as the recording material P, the basic weight of the ordinary paper is obtained based on an ordinary paper designation signal, and executes an ordinary paper mode for performing image formation on the ordinary paper based on the basic weight. When thick paper is designated as the recording material P, the basic weight of the thick paper is obtained based on a designation signal for the thick paper, and a thick paper mode for performing image formation on thick paper is executed based on the basic weight. When thin paper is designated as the recording material P, the basic weight of the thin paper is obtained based on a designation signal for the thin paper, and a thin paper mode for performing image formation on thin paper is executed based on the basic weight. In the ordinary paper mode, image formation is effected on a recording material P having a basic weight of 70 to 150 g/m$^2$. In the thick paper mode, image formation is effected on a recording material P having a basic weight of more than 150 g/m$^2$. In the thick paper mode, image formation is effected on a recording material P having a basic weight of less than 70 g/m$^2$. When executing the ordinary paper mode, the thick paper mode, and the thin paper mode, the MPU conducts, according to the modes, control to drive the drive mechanisms M1•M2 and to move the sliders SL1•SR1 and SL2•SR2 in a predetermined direction by a predetermined amount along the virtual lines L1•L2. Upon the movement of the sliders SL1•SR1 and SL2•SR2, the heat roller 16 and the tension roller 17 are displaced in a predetermined direction by a predetermined amount along the virtual lines L1•L2.

In this way, the heat roller 16 and the tension roller 17 are displaced along the virtual lines L1•L2, whereby it is possible to change the tension on the fixing belt 11 and the pressure belt 12. Thus, according to the kind of the recording material P, the relaxation degree of the relaxed portions 11*d*•12*d* of the fixing belt 11 and the pressure belt 12 is adjusted, whereby it is possible to change solely the nip width of the pre-nip portion N1 in the recording material conveyance direction without changing the pressurizing force at the pressure nip portion N2.

Figure 37A:
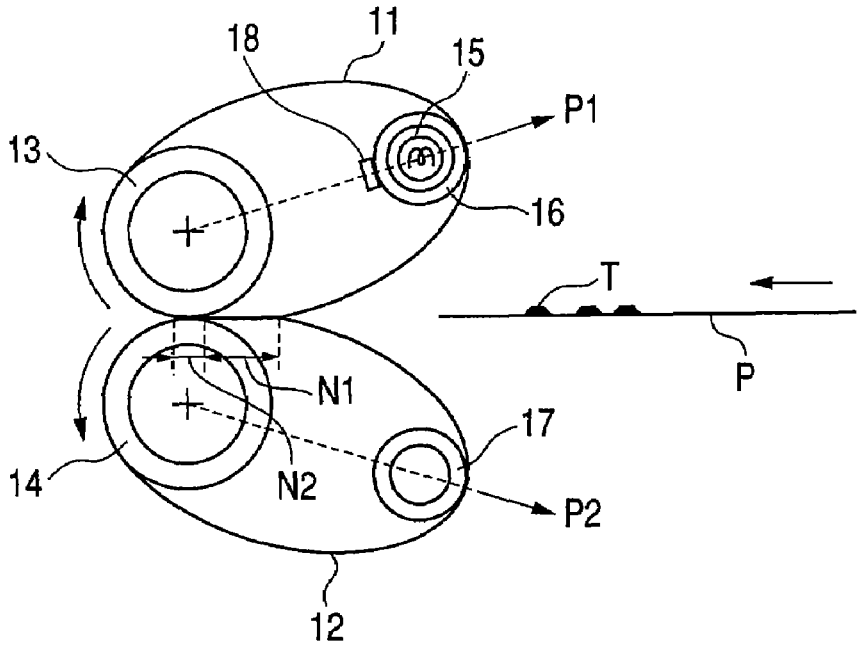
FIG. 37A is an explanatory view illustrating the pre-nip portion width in the fixing device when in the ordinary paper mode.
Figure 37B:
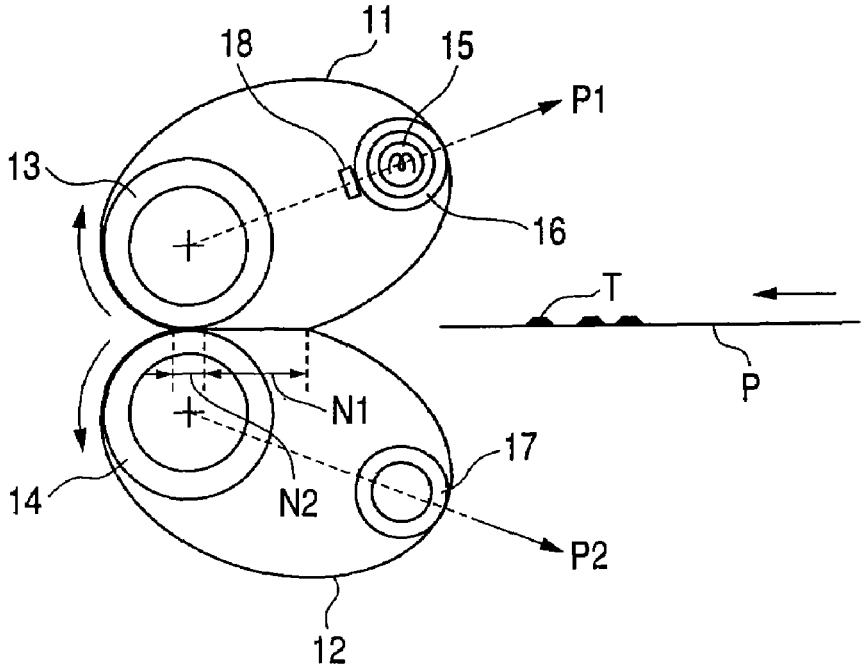
FIG. 37B is an explanatory view illustrating the pre-nip portion width in the fixing device when in the thick paper mode.
Figure 37C:
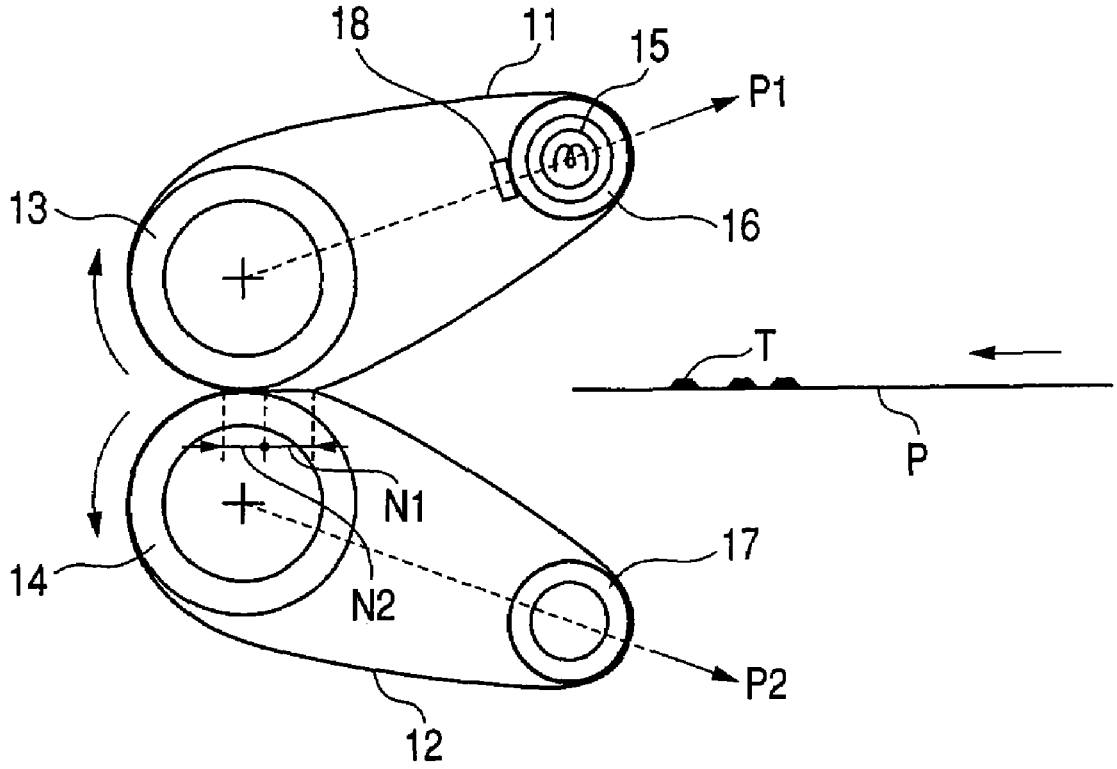
FIG. 37C is an explanatory view illustrating the pre-nip portion width in the fixing device when in the thin paper mode.

FIG. 37A is an explanatory view illustrating the width of the pre-nip portion N1 of the fixing device 112 when in the ordinary paper mode. FIG. 37B is an explanatory view illustrating the width of the pre-nip portion N1 of the fixing device 112 when in the thick paper mode. FIG. 37C is an explanatory view illustrating the width of the pre-nip portion N1 of the fixing device 112 when in the thin paper mode. Further, in the fixing device 112 according to this embodiment, the positions of the heat roller 16 and the tension roller 17 when in the ordinary mode, which is of relatively high frequency of use, are set to home positions (FIG. 28). Further, the heat roller 16 and the tension roller 17 are displaced from the positions according to the thick paper mode or the thin paper mode. The width of the pre-nip portion N1 in the ordinary paper mode is approximately 15 mm. In the thick paper mode, the heat roller 16 and the tension roller 17 are displaced toward the fixing roller 11 and the pressure roller 14 along the virtual lines L1•L2 by the sliders SL1•SR1 and SL2•SR2 to set the width of the pre-nip portion N1 to approximately 20 mm. In the thin paper mode, the heat roller 16 and the tension roller 17 are displaced away from the fixing roller 11 and the pressure roller 14 along the virtual lines L1•L2 by the sliders SL1•SR1 and SL2•SR2 to set the width of the pre-nip portion N1 to approximately 5 mm. The nip width of the pressure nip portion N2 in the recording material conveyance direction is approximately 5 mm. This nip width is shared by the ordinary paper mode, the thick paper mode, and the thin paper mode.

Figure 36B:
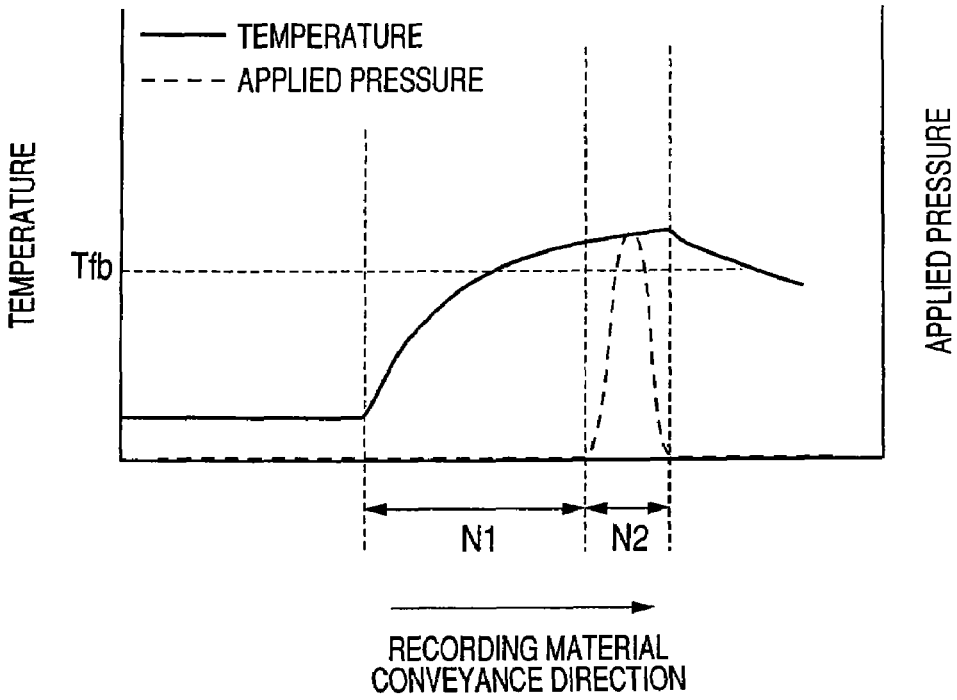
FIG. 36B is an explanatory view illustrating changes in temperature and pressure distribution on the recording paper sheet in the pre-nip portion and the pressure nip portion in the heat fixing process when in a thick paper mode.
Figure 36C:
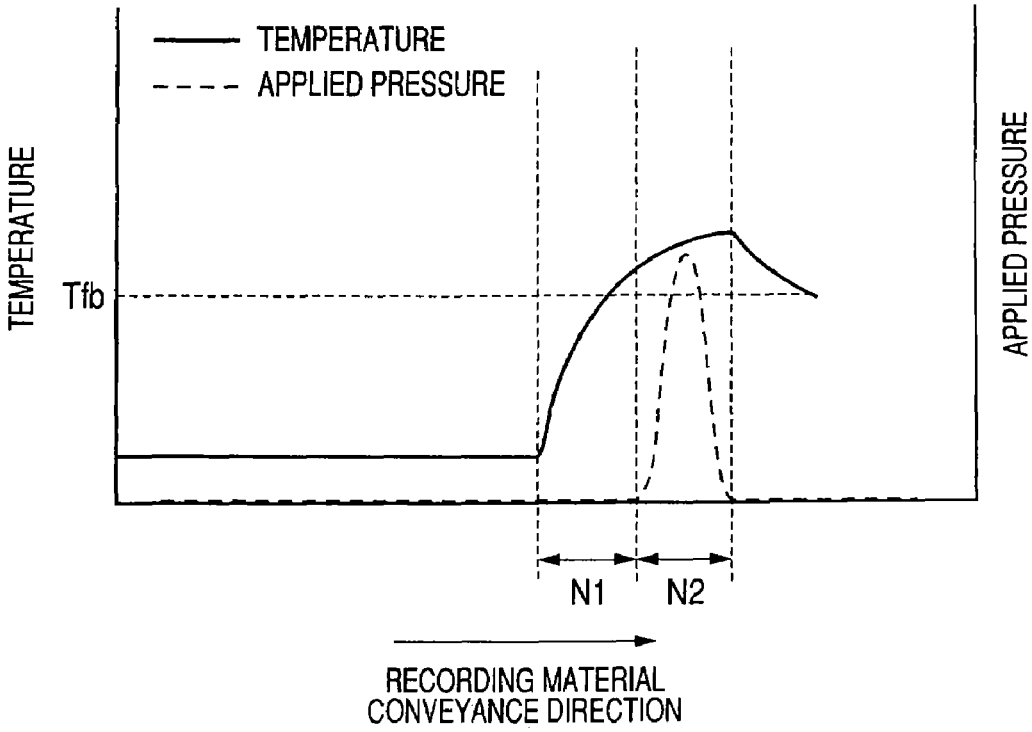
FIG. 36C is an explanatory view illustrating changes in temperature and pressure distribution on the recording paper sheet in the pre-nip portion and the pressure nip portion in the heat fixing process when in a thin paper mode.

FIG. 36A is a diagram illustrating temperature changes on the recording material P at the pre-nip portion N1 and the pressure nip portion N2 in the heat fixing process when in the ordinary paper mode. FIG. 36B is a diagram illustrating temperature changes pressurizing force distribution on the recording material P at the pre-nip portion N1 and the pressure nip portion N2 in the heat fixing process when in the thick paper mode. FIG. 36C is a diagram illustrating temperature changes pressurizing force distribution on the recording material P at the pre-nip portion N1 and the pressure nip portion N2 in the heat fixing process when in the thin paper mode. In FIGS. 36A to 36C, the pressurizing force distribution as illustrated in FIG. 35 is superimposed on the temperature profile, with the positions of different points in the nip being matched in the horizontal axis direction.

In FIGS. 36A, 36B, and 36C, symbol Tfb indicates the toner outflow start temperature in the flow tester. Using Flow Tester CFT-500D (manufactured by Shimadzu Corporation), toner pellets are heated and melted for flowing out under the conditions: die hole diameter: 1 mm, load value: 3969N (405 kgf), and temperature rise rate: 4° C./min. At this time, the temperature at the point in time when the toner starts to flow out of the die hole is regarded as the "outflow start temperature Tfb."

The temperature measurement on the recording material P as illustrated in FIGS. 36A, 36B, and 36C was performed as follows.

A thermocouple whose heat capacity at the temperature detecting portion is small (e.g., Type K thermocouple of a wire diameter of 50 μm, manufactured by Anritsu-Meter Co., Ltd.) was affixed to the recording material, and the recording material was pinched and conveyed by the pre-nip portion N1 and the pressure nip portion N2 of the fixing device 112 under temperature control. Further, the potential difference signal emitted from the thermocouple was measured by Memory High-Coder (8842) manufactured by Hioki E.E. Corporation. As a result, as can be seen from FIGS. 36A, 36B, and 36C, the temperature of the recording material has been increased to a level equal to or higher than the toner outflow start temperature in the flow tester before it enters the pressure nit portion N2.

When the recording material P passes through the pre-nip portion N1 and the pressure nip portion N2, the unfixed toner image T is heat-fixed to the surface of the recording material P as a fixed image having a sufficient fixing property and gloss. That is, due to the pre-nip portion N1 and the pressure nip portion N2, it is possible to secure the requisite time for the unfixed toner image T to be sufficiently melted at the pre-nip portion N1, and then to obtain the temperature distribution and pressure distribution for pressure-fixing the unfixed toner image T to the recording material P at the pressure nip portion N2. As a result, it is possible to substantially reduce generation of poor fixing, blister, offset, etc. of the unfixed toner image T. Further, the recording material P is delivered from the pressure nip portion N2.

As illustrated in FIG. 36B, in the thick paper mode, the temperature on the thick paper increases more gently as compared with the case of ordinary paper; however, by increasing the paper heating distance at the pre-nip portion N1, and increasing the heating time for the toner image T, it is possible to obtain the same appropriate target toner image gloss as that in the case of ordinary paper. On the other hand, as illustrated in FIG. 36C, in the thin paper mode, the temperature on the thin paper abruptly increases as compared with the case of ordinary paper. However, by shortening the paper heating distance at the pre-nip portion N1, and by shortening the heating time for the toner image T, the toner image T is not melted excessively, and it is possible to obtain the same target appropriate toner image gloss as that in the case of ordinary paper. Thus, if the kind of recording material P is changed, there is no need to change the conveyance speed of the recording material P and the predetermined set temperature at which the unfixed toner image T is heated, and the width of the pre-nip portion N1 is changed through displacement of the heat roller 16 and the tension roller 17. As a result, it is possible to maintain the target optimum gloss for the toner image T borne by the recording material P.

As described above, in the fixing device 112 according to this embodiment, it is possible to obtain the following effect. The heat roller 16 and the tension roller 17 are displaced along the virtual lines L1•L2 according to the kind of recording material P, whereby it is possible to change solely the nip width in the recording material conveyance direction of the pre-nip portion N1 without changing the pressurizing force of the pressure nip portion N2. As a result, it is possible to maintain the target optimum gloss for the toner image T borne by the recording material P.

Embodiment 6

Another example of the fixing device is described.

In this embodiment, the members and portions that are the same as those of the fixing device 112 of Embodiment 5 are indicated by the same reference numerals, and a redundant description thereof is omitted.

Figure 38:
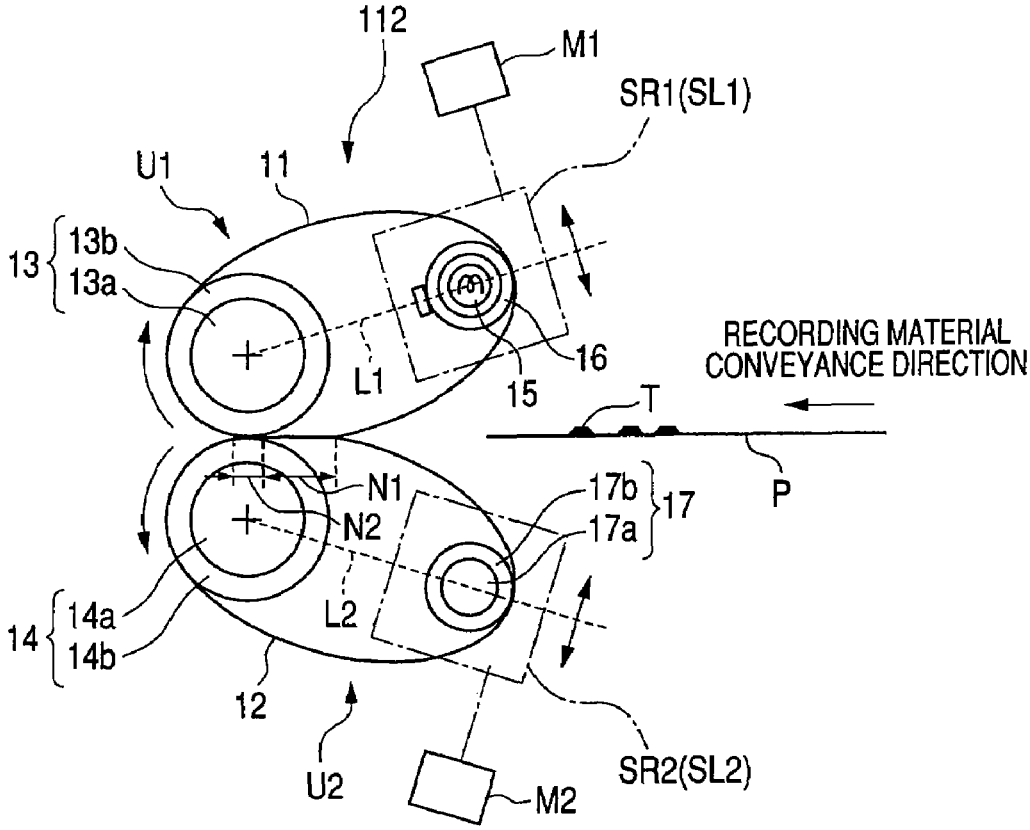
FIG. 38 is a schematic cross-sectional view of an example of the fixing device of Embodiment 6.

FIG. 38 is a schematic cross-sectional view of an example of the fixing device 112 according to this embodiment.

The fixing device 112 according to this embodiment is of the same construction as the fixing device 112 of Embodiment 1 except that the heat roller 17 and the tension roller 17 are displaced in a direction orthogonal to (crossing) the virtual lines L1•L2. Thus, the bearings 35L•35R (not shown) at both end portions of the heat roller 16 are supported by sliders SL1•SR1 provided on the first frame 31L•31R (not shown) so as to be movable in a direction perpendicular to (crossing) the virtual lines L1•L2. Further, the bearings 36L•36R (not shown) at both end portions of the tension roller 17 are supported by sliders SL2•SR2 provided on the second frame 33L•33R (not shown) so as to be movable in a direction perpendicular to (crossing) the virtual lines L1•L2.

Figure 39A:
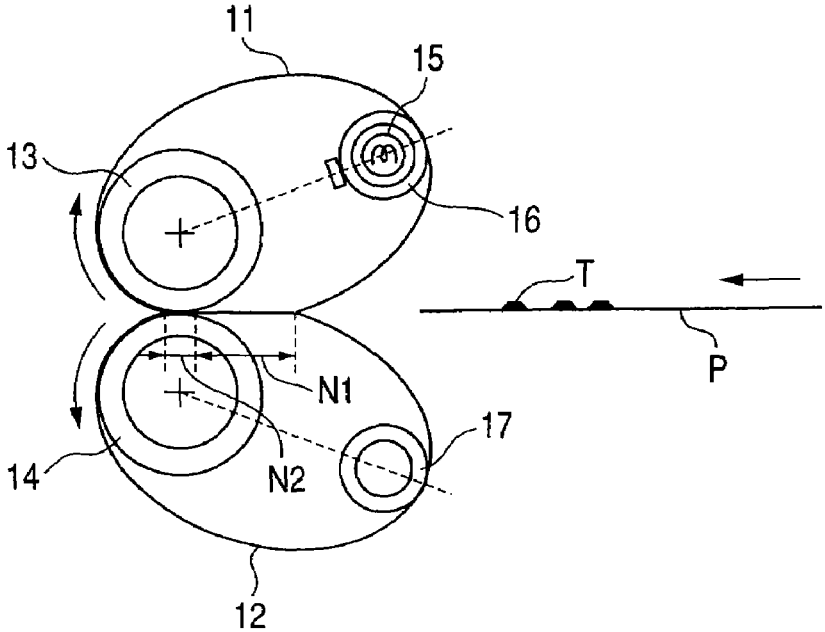
FIG. 39A is an explanatory view illustrating the pre-nip portion width in the fixing device when in the ordinary paper mode.
Figure 39B:
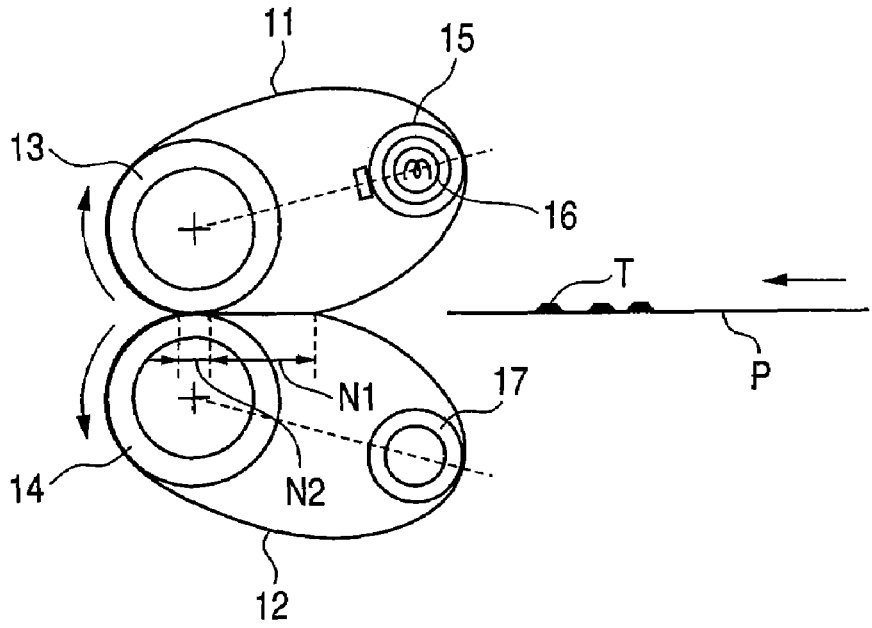
FIG. 39B is an explanatory view illustrating the pre-nip portion width in the fixing device when in the thick paper mode.
Figure 39C:
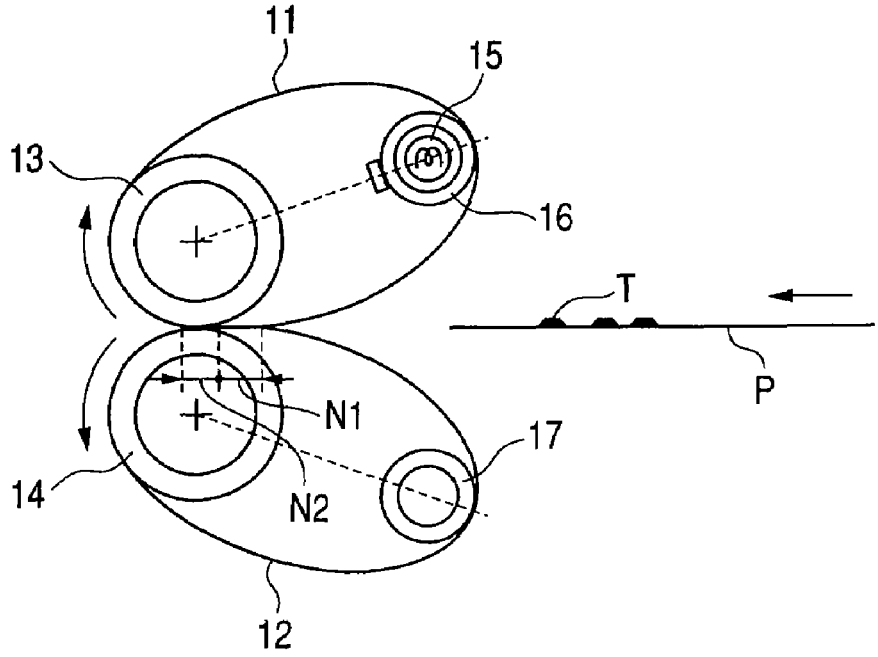
FIG. 39C is an explanatory view illustrating the pre-nip portion width in the fixing device when in the thin paper mode.

FIG. 39A is an explanatory view illustrating the width of the pre-nip portion N1 of the fixing device 112 when in the ordinary paper mode. FIG. 39B is an explanatory view illustrating the width of the pre-nip portion N1 of the fixing device 112 when in the thick paper mode. FIG. 39C is an explanatory view illustrating the width of the pre-nip portion N1 of the fixing device 112 when in the thin paper mode.

In the fixing device 112 according to this embodiment, the positions of the heat roller 16 and the tension roller 17 when, for example, in the ordinary mode, which is of relatively high frequency of use, are set to home positions (FIG. 38). Further, the heat roller 16 and the tension roller 17 are displaced from the positions according to the thick paper mode or the thin paper mode. The width of the pre-nip portion N1 in the ordinary paper mode is approximately 15 mm. In the thick paper mode, the heat roller 16 and the tension roller 17 are displaced toward each other in a direction perpendicular to the virtual lines L1•L2 by the sliders SL1•SR1 and SL2•SR2 to set the width of the pre-nip portion N1 to approximately 20 mm. In the thin paper mode, the heat roller 16 and the tension roller 17 are displaced away from each other in a direction perpendicular to the virtual lines L1•L2 by the sliders SL1•SR1 and SL2•SR2 to set the width of the pre-nip portion N1 to approximately 5 mm. The nip width of the pressure nip portion N2 in the recording material conveyance direction is approximately 5 mm. This nip width is shared by the ordinary paper mode, the thick paper mode, and the thin paper mode.

In the fixing device 112 according to this embodiment, the heat roller 16 and the tension roller 17 are displaced in a direction perpendicular to the virtual lines L1•L2 according to the kind of recording material P. As a result, it is possible to change solely the nip width in the recording material conveyance direction of the pre-nip portion N without changing the pressurizing force of the pressure nip portion N2.

Further, in the fixing device 112 according to this embodiment, there is no need to change the conveyance speed of the recording material P and the predetermined set temperature at which the unfixed toner image T is heated, and the width of the pre-nip portion N1 can be changed solely by displacing the heat roller 16 and the tension roller 17. Thus, if the kind of recording material P is changed, it is possible to obtain the target optimum toner image gloss.

Thus, also in the fixing device 112 according to this embodiment, it is possible to obtain the same effect as that of the fixing device 112 of Embodiment 1.

Experiment Example

In order to confirm the gloss, etc. of the toner image heat-fixed to the recording material P by the fixing device 112 of each of Embodiment 5 and Embodiment 6, the following experiment was conducted by using the fixing device 112 and a fixing device of a comparative example.

In the fixing device of the comparative example, the function to displace the heat roller 16 and the tension roller 17 in the fixing device 112 of Embodiment 5 is eliminated, and the width of the pre-nip portion N1 and the width of the pressure nip portion N2 are maintained at those of the ordinary paper mode. Otherwise, it is of the same construction as the fixing device of Embodiment 5.

<Evaluation>

Evaluation of Toner Image Fixing Property

Regarding the above-mentioned fixing devices, toner image fixing property evaluation was made under the following conditions.

In the conditions for evaluation, the surface temperature of the fixing belt was adjusted to 170° C. As the recording materials, there were used A4-size ordinary paper sheets having basic weights of 40 g/m$^2$, 64 g/m$^2$, 80 g/m$^2$, 105 g/m$^2$, 160 g/m$^2$, and 200 g/m$^2$. Color toner was output onto the recording materials so as to attain a spread amount of 1.0 mg/cm$^2$, forming color patches in the form of images 2 cm long and 5 cm wide. The toner images were introduced into the above-mentioned fixing devices at a process speed of 300 mm/s to make toner image fixing property evaluation.

In making fixing property evaluation, the gloss of the toner image portions after fixing was measured by using the gloss meter PG-LM (75°) manufactured by Nippon Denshoku Industries Co., Ltd. While the desirable image gloss differs depending upon the kind of image and the way people observe the image, generally speaking, in the case of a business document, technical report, or the like, which are output on ordinary paper sheets and which contain drawings, a lower toner image gloss is not desirable since it lacks a quality appearance. On the other hand, too high a toner image gloss leads to a large difference in gloss between the toner image portion and the paper surface, resulting in a dazzling image, which is not desirable. In view of this, in this experiment example, fixing property evaluation was made by the following evaluation standards. For practical use, a level equal to or higher than level A is desirable.

<Evaluation Standards>

A: The gloss is 10 or more but less than 30.

B: The gloss is less than 10 or 30 or more.

C: High temperature offset or low temperature offset is involved.

The evaluation results of Table 1 were obtained as follows: after the fixing belt was warmed to a target temperature, ten unfixed toner recording materials were successively introduced into the fixing device, evaluating the gloss of the ten toner images.

TABLE 1

| | Recording material basic weight | | | | | |
|---|---|---|---|---|---|---|
| | Thin paper *1 40 g/m$^2$ | Thin paper *1 64 g/m$^2$ | Thin paper *2 80 g/m$^2$ | Thin paper *2 105 g/m$^2$ | Thin paper *3 150 g/m$^2$ | Thin paper *3 200 g/m$^2$ |
| Embodiment 1 | A | A | A | A | A | A |
| Embodiment 2 | A | A | A | A | A | A |
| Comparative Example 1 | C | B | A | A | B | C |

*1: Output in the thin paper mode
*2: Output in the ordinary paper mode
*3: Output in the thick paper mode The thin paper results of Table 1 illustrate that, in the comparative example, the thin paper sheet of 40 g/m$^2$ involves generation of high temperature offset, and the thin paper sheet of 64 g/m$^2$ results in a toner image of too high a gloss. However, in the thin paper mode of Embodiments 5 and 6, the width of the pre-nip portion N1 is approximately 5 mm, which is relatively small as compared with that of the comparative example, and hence the toner on the thin paper sheet of 40 g/m$^2$ and the thin paper sheet of 64 g/m$^2$ is not heated excessively. Thus, high temperature offset is avoided, and a toner image of an appropriate gloss is obtained.

The thick paper results of Table 1 illustrate that, in the comparative example, the thick paper sheet of 200 g/m$^2$ involves generation of high temperature offset, and the thick paper sheet of 160 g/m$^2$ results in a toner image of too high a gloss. However, in the thick paper mode of Embodiments 5 and 6, the width of the pre-nip portion N1 is approximately 20 mm, which is relatively large as compared with that of the comparative example, and hence the toner on the thick paper sheet of 160 g/m$^2$ and the thick paper sheet of 200 g/m$^2$ is heated sufficiently. Thus, low temperature offset is avoided, and a toner image of an appropriate gloss is obtained.

Embodiment 7

Another example of the fixing device is described.

Figure 40:
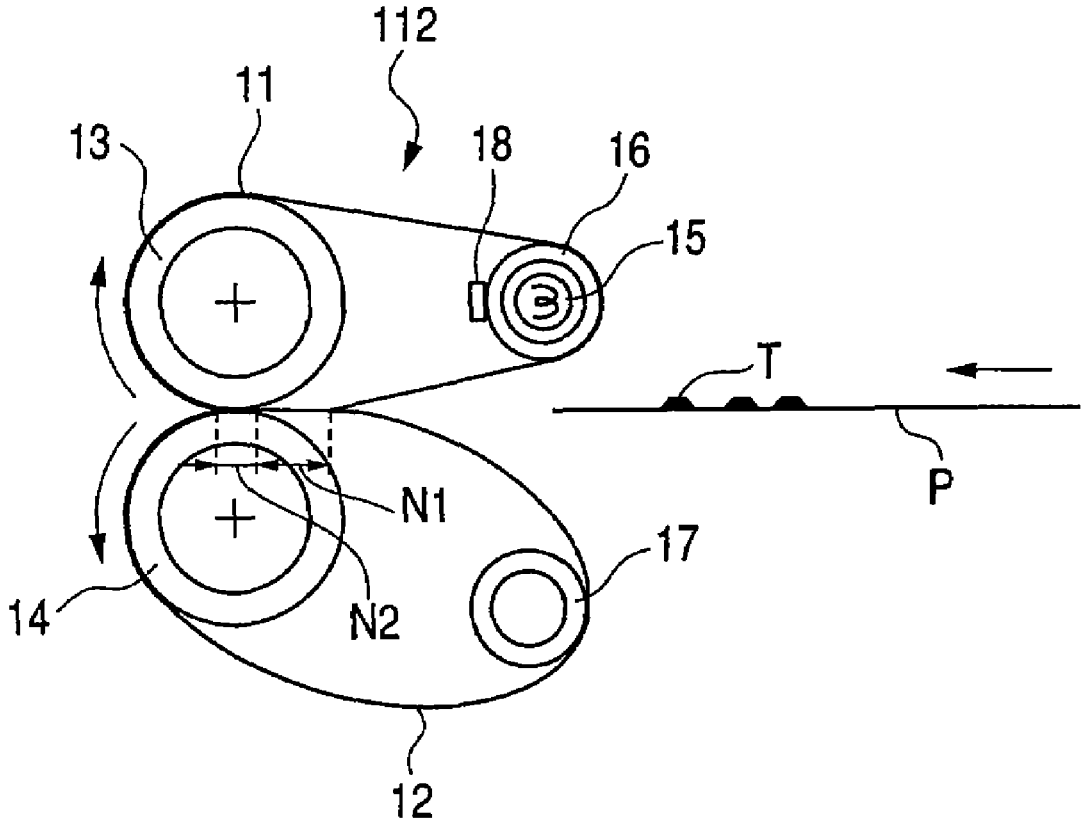
FIG. 40 is a schematic sectional view of an example of the fixing device of Embodiment 7.

FIG. 40 is a schematic cross-sectional view of an example of a fixing device according to this embodiment.

While in the fixing device 112 of Embodiments 5 and 6 the relaxed portions 11*d*•12*d* are formed in both of the fixing belt 11 and the pressure belt 12 in order to form the pre-nip portion N1, it is also possible to form the relaxed portion in one of the fixing belt 11 and the pressure belt 12. That is, also in a case in which one of the belts is wrapped as illustrated in FIGS. 32A and 33A, and in which the another belt is wrapped so as to have a relaxed portion as illustrated in FIGS. 32B and 33B, it is possible to form the pre-nip portion N1 on the upstream side in the recording material conveyance direction of the pressure nip portion N2.

In the fixing device 112 according to this embodiment, the surface of the relaxed portion 12*d* of the pressure belt 12 wrapped as illustrated in FIG. 33B is held in contact with the surface of the fixing belt 11 as illustrated in FIG. 32A to form the pre-nip portion N1. Although not shown, conversely, the surface of the relaxed portion 11*d* of the fixing belt 11 wrapped as illustrated in FIG. 32B may be held in contact with the surface of the pressure belt 12 as illustrated in FIG. 33A to form the pre-nip portion N1. Further, both the heat roller 16 and the tension roller 17 are displaced along the virtual lines L1•L2 according to the kind of recording material P. Alternatively, both the heat roller 16 and the tension roller 17 are displaced in a direction orthogonal to (crossing) the virtual lines L1•L2 according to the kind of recording material P. As a result, it is possible to change solely the nip width in the recording material conveyance direction of the pre-nip portion N1 without changing the pressurizing force of the pressure nip portion N2.

In the fixing device 112 according to this embodiment also, it is possible to change the nip width in the recording material conveyance direction of the pre-nip portion N1, and hence it is possible to obtain the same effect as that of the fixing device 112 of Embodiment 5.

<Others>

In each fixing device 112 described above, one of the heat roller 16 and the tension roller 17 may be displaced along the virtual lines L1•L2 or in a direction orthogonal to the virtual lines L1•L2 according to the kind of recording material P. Also in a fixing device 112 thus constructed, it is possible to change the nip width in the recording material conveyance direction of the pre-nip portion N1.

According to the present invention, it is possible to provide an image heating apparatus in which it is possible to secure a large nip width adaptable to an increase in speed, and which is free from "pressure-absence" causing image abnormality such as misregistration of an image and enables an image of sufficient gloss to be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2007-231317 filed on Sep. 6, 2007, and No. 2007-238840 filed on Sep. 14, 2007, which are hereby incorporated by reference herein in their entirety.

What is claimed is:

1. An image heating apparatus comprising:

a first endless belt;

a second endless belt held in contact with an outer peripheral surface of said first endless belt;

a heating portion for heating at least one of said first endless belt and said second endless belt;

a first pressure member held in contact with an inner peripheral surface of said first endless belt; and a second pressure member held in contact with an inner peripheral surface of said second endless belt, said first pressure member and said second pressure member holding said first endless belt and said second endless belt therebetween, said image heating apparatus heating a recording material bearing a toner image while the recording material is pinched and conveyed at a nip portion formed between said first endless belt and said second endless belt, wherein at least one endless belt of said first endless belt and said second endless belt is arranged in a relaxed state, wherein the nip portion has a first nip region formed between one endless belt of said first endless belt and said second endless belt and another endless belt of the first endless belt and said second endless belt due to relaxing of one endless belt, and a second nip region formed through contact between a region of said first endless belt with backup by said first pressure member and a region of said second endless belt with backup by said second pressure member, and wherein the nip portion starts from the first nip region in the recording material conveyance direction, and has the second nip region immediately after the first nip region.

2. An image heating apparatus according to claim 1, wherein, of said first endless belt and said second endless belt, at least the endless belt held in contact with the toner image is arranged in a relaxed state.

3. An image heating apparatus according to claim 1, further comprising a mechanism for changing a length in the recording material conveyance direction of the first nip region.

4. An image heating apparatus according to claim 3, wherein the mechanism changes the length of the first nip region according to a kind of recording material.

5. An image heating apparatus according to claim 3, further comprising:

a first support member held in contact with the inner peripheral surface of said first endless belt and supporting said first endless belt; and a second support member held in contact with the inner peripheral surface of said second endless belt and supporting said second endless belt, wherein at least one of said first support member and said second support member is displaced along a virtual line connecting a center of the support member and a center of the pressure member, to thereby change the length of the first nip region.

6. An image heating apparatus according to claim 3, further comprising:

a first support member held in contact with the inner peripheral surface of said first endless belt and supporting said first endless belt; and a second support member held in contact with the inner peripheral surface of said second endless belt and supporting said second endless belt, wherein at least one of said first support member and said second support member is displaced in a direction crossing a virtual line connecting a center of the support member and a center of said pressure member, to thereby change the length of the first nip region.

* * * * *